US011071347B2

(12) United States Patent
Kendall et al.

(10) Patent No.: US 11,071,347 B2
(45) Date of Patent: Jul. 27, 2021

(54) SUSPENSION MEMBRANES, FOOTWEAR INCLUDING THE SAME, FOOTWEAR COMPONENTS, AND RELATED METHODS

(71) Applicant: S-Ride, LLC, Hermosa Beach, CA (US)

(72) Inventors: Michael Kendall, San Diego, CA (US); Brent Rockne James, Hermosa Beach, CA (US); William James Spracher, Carpinteria, CA (US)

(73) Assignee: S-Ride, LLC, Rolling Hills Estates, CA (US)

( * ) Notice: Subject to any disclaimer, the term of this patent is extended or adjusted under 35 U.S.C. 154(b) by 39 days.

(21) Appl. No.: 16/428,750

(22) Filed: May 31, 2019

(65) Prior Publication Data

US 2019/0365032 A1 Dec. 5, 2019

Related U.S. Application Data

(60) Provisional application No. 62/678,750, filed on May 31, 2018.

(51) Int. Cl.

| | |
|---|---|
| ***A43B 13/18*** | (2006.01) |
| ***A43B 13/14*** | (2006.01) |
| ***A43B 7/08*** | (2006.01) |

(52) U.S. Cl.

CPC ..... *A43B 13/181* (2013.01); *A43B 7/08* (2013.01); *A43B 13/141* (2013.01)

(58) Field of Classification Search

None

See application file for complete search history.

(56) References Cited

U.S. PATENT DOCUMENTS 1,194,152 A 8/1916 Douglas
2,225,192 A 12/1940 White et al.
(Continued)

FOREIGN PATENT DOCUMENTS

CN 201587468 U 9/2010
FR 1068538 6/1954
(Continued)

OTHER PUBLICATIONS

English language machine translation of China Utility Model No. 201587468, Sep. 22, 2010.
(Continued)

*Primary Examiner* — Jila M Mohandesi
(74) *Attorney, Agent, or Firm* — Dascenzo Gates Intellectual Property Law, P.C.

(57) ABSTRACT

Articles of footwear including footbed membranes and rigid or semi-rigid frames may be configured to suspend and support a wearer's foot during all stages of the gait cycle. Footbed membranes may be configured to suspend the wearer's foot with nothing underneath the footbed membrane, maintaining a gap between the footbed membrane and the frame during the entire gait cycle. Footbed membranes may be formed of elastomeric materials having less than a threshold percentage of elongation in response to loading, to maintain suspension of the wearer's foot. The outsole, frame, and footbed membrane may be integrated such that the components work together to support the wearer's foot during the gait cycle and in static conditions as well. Methods of making such articles of footwear may include sewing the footwear upper to the footbed membrane via a sew wall, without cementing the upper.

22 Claims, 36 Drawing Sheets

(56) References Cited

U.S. PATENT DOCUMENTS

| | | | | |
|---|---|---|---|---|
| 2,491,930 | A | 12/1949 | Parlante | |
| 3,834,046 | A | 9/1974 | Fowler | |
| 4,236,326 | A * | 12/1980 | Inohara | A43B 13/181 36/29 |
| 4,283,864 | A | 8/1981 | Lipfert | |
| 4,297,796 | A | 11/1981 | Stirtz et al. | |
| 4,380,878 | A | 4/1983 | Skaja | |
| 4,505,055 | A | 3/1985 | Bergmans | |
| 4,663,865 | A * | 5/1987 | Telecemian | A43B 13/181 36/114 |
| 4,681,114 | A | 7/1987 | Lodispoto | |
| 4,702,255 | A | 10/1987 | Schenkl | |
| 4,706,316 | A | 11/1987 | Tanzi | |
| 4,743,323 | A | 5/1988 | Hettinga | |
| 4,873,301 | A | 11/1989 | Kiyosawa | |
| 4,910,887 | A | 3/1990 | Turner et al. | |
| 5,070,629 | A | 12/1991 | Graham et al. | |
| 5,331,752 | A | 7/1994 | Johnson et al. | |
| 5,390,430 | A | 2/1995 | Fitchmun et al. | |
| 5,561,920 | A | 10/1996 | Graham et al. | |
| 5,592,757 | A | 1/1997 | Jackinsky | |
| 5,595,002 | A | 1/1997 | Slepian et al. | |
| 5,680,714 | A | 10/1997 | Lopez | |
| 5,729,917 | A | 3/1998 | Slepian et al. | |
| 5,852,886 | A | 12/1998 | Slepian et al. | |
| 5,875,566 | A | 3/1999 | Bourdeau et al. | |
| 5,974,695 | A | 11/1999 | Slepian et al. | |
| 5,987,780 | A | 11/1999 | Lyden et al. | |
| 6,035,901 | A | 3/2000 | Stumpf et al. | |
| 6,226,895 | B1 * | 5/2001 | McClelland | A43B 9/06 12/142 D |
| 6,601,321 | B1 | 8/2003 | Kendall | |
| 7,013,581 | B2 * | 3/2006 | Greene | A43B 7/08 36/114 |
| 7,225,491 | B2 * | 6/2007 | Reed | A43B 7/1425 12/142 P |
| 7,254,906 | B2 | 8/2007 | Morris et al. | |
| 7,555,847 | B2 | 7/2009 | Kendall | |
| 7,556,846 | B2 * | 7/2009 | Dojan | A43B 13/20 36/141 |
| 8,595,956 | B2 * | 12/2013 | Byrne | A43B 13/186 36/31 |
| 9,743,711 | B2 * | 8/2017 | Dirsa | B29C 33/485 |
| 2004/0068893 | A1 | 4/2004 | Kendall | |
| 2004/0250448 | A1 | 12/2004 | Reed et al. | |
| 2005/0248106 | A1 | 11/2005 | Balconi et al. | |
| 2005/0268490 | A1 * | 12/2005 | Foxen | A43B 7/145 36/28 |
| 2007/0101612 | A1 | 5/2007 | Kilgore | |
| 2007/0246978 | A1 | 10/2007 | Yu | |
| 2009/0104426 | A1 | 4/2009 | Sauer et al. | |
| 2015/0250259 | A1 | 9/2015 | Attey et al. | |
| 2019/0335853 | A1 * | 11/2019 | Sussmann | A43B 13/04 |

FOREIGN PATENT DOCUMENTS

| | | |
|---|---|---|
| FR | 1098621 | 8/1955 |
| GB | 2243530 A | 11/1991 |
| KR | 10-2018-00033301 | 1/2018 |
| WO | WO 2017/222526 | 12/2017 |

OTHER PUBLICATIONS

English language machine translation of Korea Patent Application Publication No. 10-2018-0003301, Jan. 9, 2018.

English language machine translation of the description and claims of FR 1068538, Jun. 25, 1954.

English language machine translation of the description of FR 1098621, Aug. 16, 1955.

Screenshots of "Mizuno Wave technology" web page, www.mizunousa.com/category/running+content/wave+technology.do, available at least as early as Feb. 8, 2016.

* cited by examiner

SUSPENSION MEMBRANES, FOOTWEAR INCLUDING THE SAME, FOOTWEAR COMPONENTS, AND RELATED METHODS

RELATED APPLICATION

This application claims priority to U.S. Provisional Patent Application Ser. No. 62/678,750, which was filed on May 31, 2018, the complete disclosure of which is hereby incorporated by reference for all purposes.

FIELD

The present disclosure relates to suspension membranes, footwear including the same, footwear components, and related methods.

BACKGROUND

An article of footwear may include a sole and an upper that form a cavity, or foot compartment, in which a wearer places his or her foot when the article of footwear is donned and worn. The sole of the footwear engages the bottom of the wearer's foot and separates the foot from the ground. The sole often consists of one or more layers of materials, including leather, rubber, foam, and/or plastics that provide shock absorption and support to the wearer's foot. The upper extends outwardly from an outer periphery of the sole and covers at least a portion of the foot.

A wearer's gait cycle may be analyzed in the context of the foot and footwear. FIG. 1 illustrates a human foot 10 generally having a heel region 12, a midfoot region 14, and a forefoot region 16. Human foot 10 is described with reference to a lateral side 18 (e.g., the outer side) and a medial side 20 (e.g., the inner side). Human foot 10 includes an anterior transverse arch 22, approximately spanning between letter designations A and B, a lateral longitudinal arch 24, approximately spanning between letter designations B and C, and a medial longitudinal arch 26, approximately spanning between letter designations A and C. It is to be understood that anterior transverse arch 22, lateral longitudinal arch 24, and medial longitudinal arch 26 are contours generally present in human foot 10, though these contours may be more or less prominent, bigger or smaller, longer or shorter, angled differently, and/or positioned differently in different feet.

As used herein, the terms "medial" and "medial side" refer to inner side 20 of the foot 10 extending from a hallux 17 to heel region 12, and the terms "lateral" and "lateral side" refer to outer side 18 of the foot 10 extending from a small toe 19 to heel region 12. Similarly, disclosed articles of footwear include medial and lateral sides that conform to the medial and lateral sides 20, 18, respectively, of the foot 10. As described herein, heel region 12 is considered to include a posterior end 21 of foot 10, and the portion of an article of footwear that engages the heel region 12 is the posterior end, or "heel region," of the article of footwear. Conversely, forefoot region 16 is considered to include an anterior end 23 of foot 10, and the portion of an article of footwear that engages forefoot region 16 is the anterior end, or "toe end," of the article of footwear. Similarly, other portions of an article of footwear may be described as having regions corresponding to the regions of the wearer's foot they engage (e.g., the footwear may be described as having a "midfoot region," a "forefoot region," et al.)

Generally, when human foot 10 is contained within an article of footwear (e.g., a boot or shoe), the heel region of the shoe's outsole is the first part of the shoe to contact the ground during the gait cycle, with the wearer's heel region 12 being positioned in the heel region of the shoe. Of course, with some wearers this may not be the case (e.g., the midfoot or forefoot region of the shoe may be the first region to contact the ground or other surface on which the wearer is striding). However, a typical wearer's gait cycle will be described herein assuming that initial impact of the foot during a stride occurs within the heel region of the shoe, such as on an outer third of the heel region, with the foot then progressing towards pronation or mid-stance phase, generally moving weight towards the medial side of shoe (corresponding to medial side 20 of foot 10). Finally, the foot transitions to loading forefoot region 16 of foot 10 and the toe-off phase of the gait cycle, as the opposite foot is placed on the ground. Some prior art footwear have been designed with the wearer's gait cycle in mind, such as those that incorporate a 'rocker' concept, but these can be difficult to stand still in, as they do not provide sufficient stability for a wearer in a static condition.

Footwear such as dress shoes, athletic footwear, work boots, hiking boots, and others are worn for a variety of applications which require a significant workload in terms of duration of wear or impact. During walking or running, the human foot transfers energy (e.g., in the form of force from the shock impact of the wearer's foot striking the ground with the sole between the foot and the ground) into the sole and further to the ground through the sole. A substantial portion of this energy is lost to the wearer, such as by being disbursed into the material of the sole at the area of contact. A portion of the energy that is not lost is returned into the foot of the wearer, but generally not in an advantageous manner. For example, some of the energy may be reflected back into the foot at the point of impact, which may cause discomfort, and potentially injury—such forces are referred to herein as ground reaction forces.

A large percentage of the population experiences lower extremity (e.g., foot) pathology at some point during their lifetime. Symptoms may lead to a diagnosis of plantar fasciitis, neuromas of the forefoot, sesamoiditis, migration of the natural fat pad under the foot, and/or calcaneal (heel) injury, among others. Conventional shoes fail to resolve these problems and may, in some instances, contribute to their frequency. The support provided in conventional shoes may result in point source loading (which may in turn result in transmittal of ground forces to the wearer), instability, and/or excessive transmission of ground reaction forces back to the wearer's feet, in some cases. Foams, gels, and other cushioning structures have a tendency to bottom out, wear out, and/or lose their effectiveness. Additionally, foam and other materials may absorb water, thereby creating thermal issues, resulting in significant weight gain, and/or absorbing microbes which can cause infections in the wearer's feet.

Other existing devices for supporting and/or cushioning a wearer's foot, such as orthotic inserts, heel cups, soft molded insoles, and fluid- or gas-filled bladders embedded within the footwear are all susceptible to discomfort and foot fatigue in the wearer. Further still, cushioning elements that rely on compression may ultimately cause medical issues or injuries in wearers. While attempts have been made at suspending a wearer's foot within an article of footwear (e.g., U.S. Pat. Nos. 6,601,321 and 7,555,847 to Kendall, and U.S. Patent Application Publication No. 2015/0250259) to Attey et al.), these attempts have ultimately been unsuccessful, as these attempts all allow for portions of the wearer's foot to contact the insole (or other structure within the article of footwear) during the gait. These prior attempts thus suggest including a soft foam or other cushioning under the foot, and thus do not fully succeed in suspending the wearer's foot.

SUMMARY

Presently disclosed suspension membranes are configured to suspend a portion of a user's or wearer's body. For example, articles of footwear including disclosed sole assemblies having a footbed membrane and rigid frame are generally configured to maintain a wearer's foot suspended within an article of footwear. Disclosed articles of footwear may be configured to integrate inner and outer components of the article of footwear, with different components supporting the wearer's foot at different times during the gait cycle. In other words, the structural components of disclosed sole assemblies may be configured to operate in a coordinated manner in response to a walking gait of a wearer of an article of footwear including said sole assembly. A footbed membrane and frame are coupled to one another to form the sole assembly, with the sole assembly being configured to suspend the wearer's foot at all points during the gait cycle. Such sole assemblies may be configured to provide shock absorption, cushioning, orthopedic support, performance enhancement, and/or motion control for wearers. In some examples, footbed membranes may be selectively customized to allow for more or less penetration of the wearer's foot into a frame cavity between the footbed membrane and the frame. In some examples, footbed membranes may be selectively customized to account for different wearers' body weights, sizes, and/or foot morphologies. Presently disclosed sole assemblies may be effective to reduce ground reaction forces experienced by the wearer and thus in some cases may prevent injury, enhance comfort and/or performance, lower the wearer's center of gravity, treat and prevent foot pathology, enhance propulsion, off-load pressure in critical areas, reduce fatigue in the wearer, support the wearer's foot, provide energy return to the wearer, and/or increase stability while the wearer is standing and/or striding.

Disclosed footbed membranes for an article of footwear generally include an upper membrane surface configured to support a wearer's foot (and which may be contoured to correspond to the shape of the wearer's foot), a lower membrane surface opposite the upper membrane surface (with the lower membrane surface optionally being contoured to correspond to the upper membrane surface), a sew wall projecting away from the upper membrane surface and extending around an upper membrane perimeter of the upper membrane surface, and a lower wall projecting away from the lower membrane surface and extending around a lower membrane perimeter of the lower membrane surface. Disclosed frames for an article of footwear generally include a rocker bottom and an annular frame wall. The rocker bottom includes a lower frame side and an upper frame side opposite the lower frame side. The annular frame wall extends around a frame perimeter of the upper frame side and projects away from the upper frame side, and the annular frame wall is arranged with respect to the rocker bottom such that a frame cavity is defined by the upper frame side and an inner wall side of the annular frame wall. To form disclosed sole assemblies, a disclosed footbed membrane is secured to a disclosed frame such that the frame cavity is between the lower membrane surface of the footbed membrane and the upper frame side of the rocker bottom. The lower wall of the footbed membrane is generally coupled to the annular frame wall of the frame, to couple the footbed membrane to the frame. An upper and/or an outsole may be coupled to the sole assembly, such as to the sew wall of the footbed membrane, to complete disclosed articles of footwear.

One example of an article of footwear according to the present disclosure may include a rigid frame having a rocker bottom, an annular frame wall, and a lip. The rocker bottom includes a lower frame side and an upper frame side opposite the lower frame side. The annular frame wall extends around a perimeter of the upper frame side and projects away from the upper frame side, and includes an inner wall side, an outer wall side opposite the inner wall side, and a lip formed in the outer wall side. The annular frame wall is arranged with respect to the rocker bottom such that a frame cavity is defined by the upper frame side and the inner wall side of the annular frame wall. The annular frame wall is integrally formed with the rocker bottom such that the rigid frame is formed as a monolithic body, and the lip is configured to engage a footbed membrane configured to support a wearer's foot above the upper frame side when the wearer wears the article of footwear.

In a disclosed example, an article of footwear includes a sole assembly having a rigid frame and a footbed membrane coupled to the rigid frame. The rigid frame includes a rocker bottom and an annular frame wall. The rocker bottom includes a lower frame side and an upper frame side opposite the lower frame side. The annular frame wall extends around a frame perimeter of the upper frame side and projects away from the upper frame side, and the annular frame wall is arranged with respect to the rocker bottom such that a frame cavity is defined by the upper frame side and an inner wall side of the annular frame wall. The annular frame wall may be integrally formed with the rocker bottom such that the rigid frame is formed of a monolithic body. The footbed membrane may include an upper membrane surface configured to support and suspend a wearer's foot above the upper frame side when the wearer wears the article of footwear, a lower membrane surface opposite the upper membrane surface, and a lower wall projecting away from the lower membrane surface and extending around a membrane perimeter of the footbed membrane, wherein the lower wall is coupled to the annular frame wall, and wherein the upper membrane surface, the lower membrane surface, and the lower wall of the footbed membrane comprise a non-mesh, molded elastomeric material. Such disclosed sole assemblies are configured to prevent contact between the lower membrane surface and the upper frame side when the upper membrane surface is suspending the wearer's foot above the upper frame side.

While disclosed footbed membranes (and other suspension membranes) are generally formed of elastomers that resiliently stretch, or elongate, when compressed or loaded (e.g., by the wearer's foot), disclosed footbed membranes are configured to have a limited amount of elongation, such that contact between the lower membrane surface of the footbed membrane and the frame is prevented, thereby maintaining suspension of the wearer's foot. Such suspension is generally maintained without any matrix or cushioning materials positioned between the footbed membrane and the frame. Elongation of disclosed footbed membranes may be limited via, for example, the attachment to the upper of the article of footwear, selecting material or physical properties of the footbed membrane, incorporating internal members into the footbed membrane, and/or altering the stoichiometry of materials used in forming the footbed membrane. In some examples, elongation of the footbed membrane may be limited to a certain percentage of elongation, such as by selectively customizing the durometer, thickness, resilience, rebound rate, and/or force curve of the footbed membrane materials.

Methods of limiting elongation of the footbed membrane and methods of making footbed membranes and articles of footwear are also disclosed. Other suspension membranes are also disclosed.

DESCRIPTION

Figure 1:
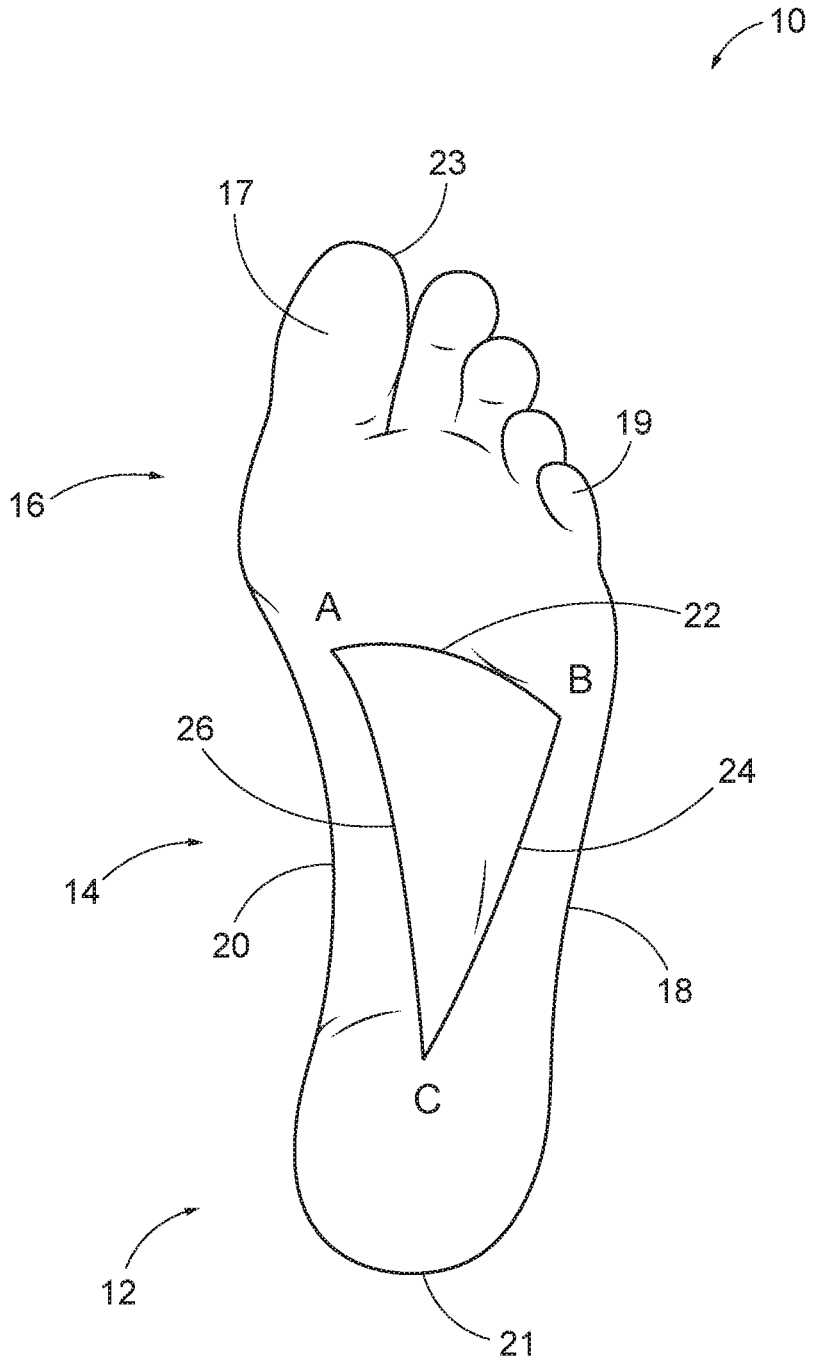
FIG. 1 is a representation of the underside (e.g., bottom) of a human foot, including a schematic representation of relative approximate positions of contours of the foot.

FIGS. 2-24*b*, 26, and 29-37 provide examples of sole assemblies 30, components thereof (e.g., footbed membranes 34, frames 36, and/or outsoles 38), and articles of footwear 32 that include sole assembly 30 (or one or more components thereof). Sole assemblies 30 are generally configured to support and suspend a wearer's foot when such sole assemblies 30 are incorporated into an article of footwear. Generally, footbed membrane 34 and frame 36 are assembled, or coupled together, to form sole assembly 30, with frame 36 being substantially rigid and footbed membrane 34 being configured to support the wearer's foot. Footbed membrane 34 and frame 36, together, serve to suspend the wearer's foot during use of disclosed articles of footwear 32. Footbed membrane 34 and frame 36 generally are configured to underlie the wearer's entire foot, though they may underlie and support just a portion of the wearer's foot, in some examples.

In the figures, elements that serve a similar, or at least substantially similar, purpose are labeled with like numbers in each of FIGS. 2-24*b*, 26, and 29-37, and these elements may not be discussed in detail herein with reference to each of FIGS. 2-24*b*, 26, and 29-37. Similarly, all elements may not be labeled in each of FIGS. 2-24*b*, 26, and 29-37 but reference numerals associated therewith may be utilized herein for consistency. Elements, components, and/or features that are discussed herein with reference to one or more of FIGS. 2-24*b*, 26, and 29-37 may be included in and/or utilized with any of FIGS. 2-24*b*, 26, and 29-37 without departing from the scope of the present disclosure. For example, any of various examples of footbed membrane 34 (or features thereof) may be combined with any of various examples of frame 36 (or features thereof), and/or any of various examples of frame 36 may be selectively modified to be combined with any of various examples of footbed membrane 34. Similarly, any of various examples of footbed membrane 34 may be modified to include features from any other example of footbed membrane 34, and any of various examples of frame 36 may be modified to include features from any other example of frame 36, according to the present disclosure. Also, any of various examples of outsole 38 may be combined with various examples of frame 36 and/or footbed membrane 34, with each of outsole 38, footbed membrane 34, and frame 36 being understood to optionally include any features or modifications described herein or illustrated herein in connection with various examples of the same. While footbed membranes 34 are described herein in the context of being incorporated into a sole assembly or article of footwear, such footbed membranes 34 may be generally applicable as suspension membranes, and useful in other applications, as will be described below. Thus, the variations and examples of footbed membrane 34 described herein also may be generally applicable to other uses of suspension membranes, and contemplated by the present disclosure.

Figure 2:
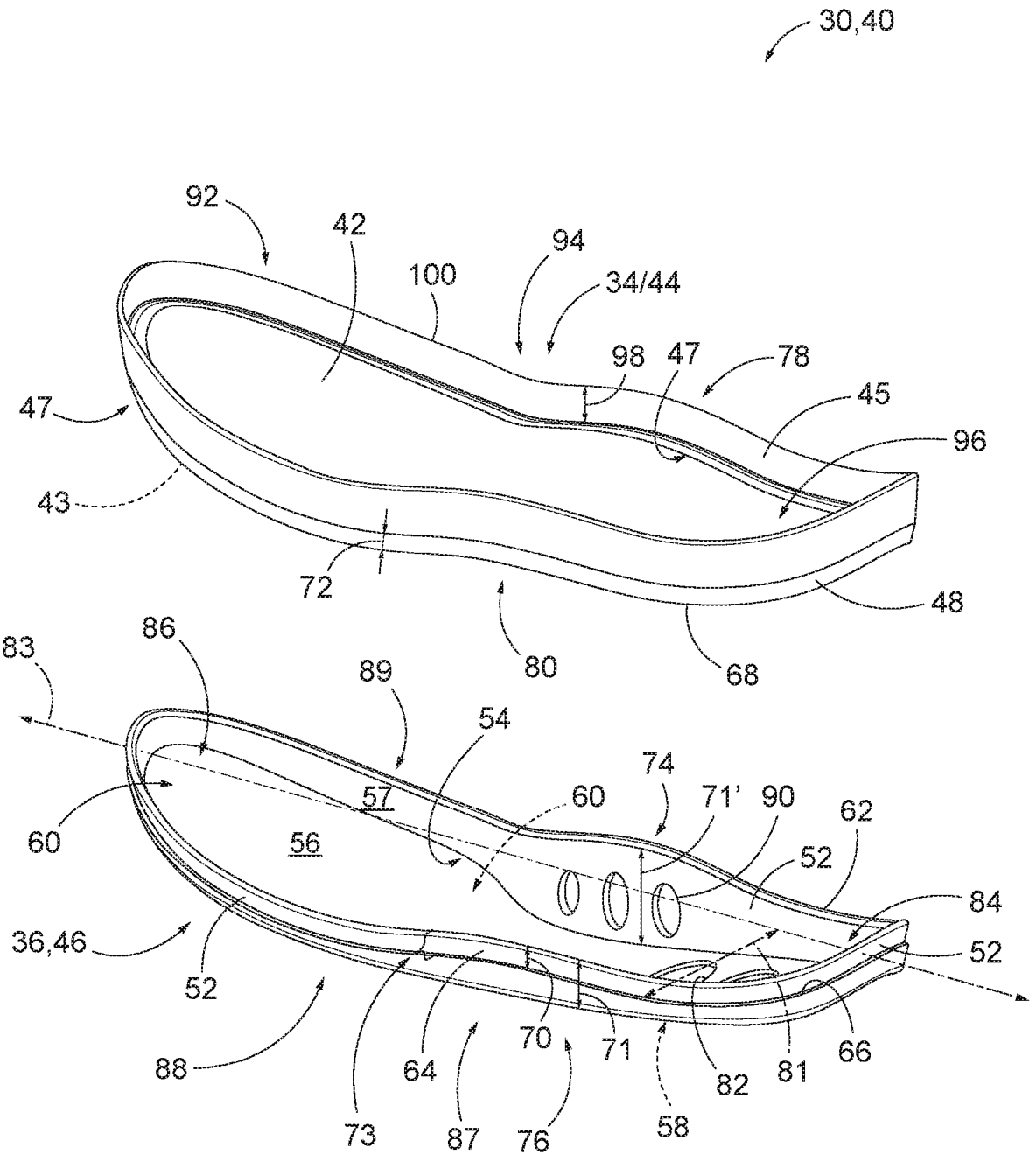
FIG. 2 illustrates a perspective, exploded view of one example of a sole assembly according to the present disclosure, including a frame and a footbed membrane, viewed from the lateral side of the sole assembly.

With reference to FIG. 2, a sole assembly 40 (which is an example of sole assembly 30) is shown in exploded view and includes a footbed membrane 44 (which is an example of footbed membrane 34) and a frame 46 (which is an example of frame 36). When sole assembly 40 is assembled, footbed membrane 44 is coupled to and/or engaged with frame 46, as will be described in further detail below. The figures will be used to describe footbed membrane 34 and frame 36 generally, as well as to point out specific features that may be included in some examples but are optional (e.g., not required to be included in all examples). For example, in the discussion of FIG. 2, footbed membrane 34 and frame 36 will be described generally, with references to footbed membrane 44 and frame 46 being used in instances illustrating particular features of the example shown in FIG. 2, though it is to be understood the features that may be described in the context of specific examples are not limited to those examples, and may be included in other examples of footbed membrane 34 and/or frame 36 disclosed herein.

Footbed membrane 34 includes an upper membrane surface 42 configured to support a wearer's foot and a lower membrane surface 43 opposite upper membrane surface 42. Upper membrane surface 42 is generally contoured to conform to the shape of the wearer's foot, though in some examples, upper membrane surface 42 may be substantially flat over some or all of upper membrane surface 42. Lower membrane surface 43 may be contoured to correspond to upper membrane surface 42. Footbed membrane 34 also includes a sew wall 45 projecting away from upper membrane surface 42, and extending around a membrane perimeter 47 of upper membrane surface 42. Sew wall 45 may be said to form a rim or "fence" around upper membrane surface 42. Footbed membrane 34 also includes a lower wall 48 projecting away from lower membrane surface 43 and extending around membrane perimeter 47 of lower membrane surface 43. In this example, membrane perimeter 47 is both a perimeter of upper membrane surface 42 and lower membrane surface 43 (e.g., membrane perimeter 47 is generally a perimeter of footbed membrane 44). In other examples, upper membrane surface 42 and lower membrane surface 43 may have different respective perimeters.

Frame 36 generally includes a rocker bottom 50 and an annular frame wall 52 extending around a frame perimeter 54 of an upper frame side 56 of rocker bottom 50. As seen in FIG. 2, annular frame wall 52 projects away from upper frame side 56 such that a frame cavity 60, or a frame volume 60, is defined by upper frame side 56 and an inner wall side 57 of annular frame wall 52. Frame 36 also includes a lower frame side 58 opposite upper frame side 56. Frame cavity 60 generally is devoid of foams, gels, and/or other cushioning materials, and footbed membrane 34 is configured to entirely suspend the wearer's foot above upper frame side 56 along the entire length of the wearer's foot. In use, footbed membrane 34 and frame 36 work together to suspend the wearer's foot. During standing, or during a gait cycle or other activity, footbed membrane 34 may be forced downward into frame cavity 60 due to loading from the wearer's body weight (transmitted via the wearer's foot), though sole assembly 30 is configured to prevent contact between frame 36 and lower membrane surface 43, so as to prevent the wearer's foot from "bottoming out," or contacting upper frame side 36. Additionally or alternatively, sole assembly 30 may be configured to prevent annular frame wall 52 from applying pressure to the sides or bottom of the wearer's foot during use, to optimize comfort for the wearer.

In other examples, sole assembly 30 may be a hybrid assembly, with a portion of sole assembly 30 providing suspension via footbed membrane 34, and a portion of sole assembly 30 providing compressive cushioning or another form of cushioning. For example, sole assembly 30 may include a footbed membrane 34 that is configured to suspend about 75% of a length of a wearer's foot in some examples, with about 25% of the length of the wearer's foot being supported by a different form of cushioning (e.g., conventional foam), such as the front 25% of the wearer's foot, underlying the wearer's forefoot. Of course, other ratios of suspension to other cushioning are also within the scope of the present disclosure, as well as other positioning for the conventional cushioning portion. In other words, while many examples of presently disclosed sole assemblies 30 and articles of footwear 32 do not include any material in frame cavity 60 between lower membrane surface 43 and upper frame side 56, such compression or cushioning materials may optionally be included within frame cavity 60 in some examples. In FIG. 2, annular frame wall 52 is integrally formed with rocker bottom 50 of frame 46, though in other examples, annular frame wall 52 may be coupled to rocker bottom 50. As used herein, frame 36 is considered to be a monolithic body, a unitary body, a single body, a single unit, and a single piece when annular frame wall 52 is integrally formed with rocker bottom 50. Such frames 36 may be cast as a single piece, molded as a single piece, 3D printed as a single piece, or otherwise formed such that annular frame wall 52 is undifferentiated from and unitary with rocker bottom 50.

Frame 36 is generally rigid or semi-rigid, and configured to resist flexion when loaded (e.g., during a wearer's gait cycle, or in static loading), and as such may be referred to herein as a rigid frame 36. In some examples, frame 36 may be rigid enough to substantially prevent flexion of the frame when loaded by a wearer. For example, frames 36 (and examples thereof, such as frame 46) may be formed to have a durometer of greater than 65, greater than 70, greater than 75, greater than 80, greater than 85, greater than 90, greater than 95, and/or between 95 and 100 on the Shore D scale. Suitable materials for frames 36 may include rigid plastic, ceramic, composite material (e.g., a composite fiber reinforced polymer), elastomeric polyurethane, high-glassed polyurethane, carbon graphite, graphite (e.g., graphene and graphene aerogel), polypropylene, non-thermoplastic polymers, aramid polymer fibers, nylons, glass fiber nylons, polyester resins, alloys (e.g., an aluminum-bismuth alloy), programmable materials (e.g., materials that respond to electronic control), and/or lightweight metals such as titanium and aluminum. In a specific example, frame 36 may be formed of a thermoplastic urethane (TPU). In some examples, frame 36 may be formed of a plurality of layers of any of such materials sandwiched or laminated together. The modulus of flexion, or modulus of elasticity of frame 36 may be varied based on the type of footwear, the intended use of the footwear (e.g., for specific sports), and/or to account for different weights, genders, etc. of wearers. As will be described in more detail below, frame 36 may be configured to propel the wearer forward during the gait cycle (e.g., provide energy return), while still facilitating a natural or normal movement through the gait cycle. Thus, frame 36 is configured to correspond to a wearer's gait cycle and support the wearer's foot through the gait cycle.

To form sole assembly 30 (e.g., sole assembly 40), footbed membrane 34 (e.g., footbed membrane 44) and frame 36 (e.g., frame 46) are engaged with, or operably coupled to, one another, generally via coupling annular frame wall 52 of frame 36 to lower wall 48 of footbed membrane 34. For example, annular frame wall 52 of frame 46 may be nested within lower wall 48 of footbed membrane 44 to form sole assembly 40. Footbed membrane 34 may be sized with respect to frame 36 such that footbed membrane 34 is stretched (e.g., pre-tensioned) in order to fit over and/or around annular frame wall 52, in some examples. In other words, frame 36 may be slightly wider than footbed membrane 34 in resting, unstressed configurations. In some examples, frame 36 is wide enough such that the center of gravity for a wearer is lowered and widened, as compared to prior art articles of footwear. In some examples, an upper wall surface 62 of annular frame wall 52 may be adjacent and/or contacting lower membrane surface 43 when footbed membrane 34 and frame 36 are engaged with one another. In this manner, it may be said that frame 36 supports membrane perimeter 47 of lower membrane surface 43 when footbed membrane 34 is engaged with frame 36. As used herein, structures may be said to be "engaged" with one another when the structures are coupled together and/or when one or both structures exerts force on the other when loaded, whether or not they are in direct physical contact with one another. For example, footbed membrane 34 may be coupled to frame 36 by directly adhering lower wall 48 to annular frame wall 52, or footbed membrane 34 may be coupled to frame 36 via one or more intervening layers or structures positioned between lower wall 48 and annular frame wall 52.

When footbed membrane 34 is loaded by a wearer, the reactive load may transfer to frame 36 at or near membrane perimeter 47, and frame 36 transfers the load to the ground surface under the article of footwear. As the load is removed from footbed membrane 34 (e.g., when the wearer picks up his or her foot), energy stored in footbed membrane 34 from being deformed springs back and returns at least a portion of this energy to the wearer.

In the example shown in FIG. 2, footbed membrane 44 is configured to only be attached to frame 46 at membrane perimeter 47, adjacent annular frame wall 52. In this arrangement, an outer wall side 64 of annular frame wall 52 (opposite of inner wall side 57) may be adjacent and/or contacting an inner surface of lower wall 48 of footbed membrane 44 when footbed membrane 44 and frame 46 are engaged with one another. Additionally or alternatively, a lip 66 may be formed in outer wall side 64 of annular frame wall 52 and configured to engage footbed membrane 34, 44 to secure footbed membrane 34, 44 to frame 36, 46. In some examples, lip 66 may be configured to limit the extent to which frame 36 is nested within footbed membrane 34. For example, lip 66 may be adjacent to, exert force on, and/or contact a lower surface 68 of lower wall 48 when footbed membrane 44 (or other footbed membrane 34) and frame 46 (or other frame 36) are engaged with one another. Lip 66, when included in a given frame 36, may extend substantially around the entire annular frame wall 52, or may extend around only one or more portions of annular frame wall 52. Lip 66 is generally formed in and/or positioned adjacent or on outer wall side 64 of annular frame wall 52. Lip 66 may be formed at the intersection between rocker bottom 50 and annular frame wall 52, or lip 66 may be formed on annular frame wall 52 (thereby demarking an upper portion 73 of annular frame wall 52). Additionally or alternatively, a wall height 70 of upper portion 73 of annular frame wall 52 above lip 66 may be substantially equal to a height 72 of lower wall 48 of footbed membrane 34. In other examples, height 72 of lower wall 48 may be less than wall height 70 of upper portion 73 of annular frame wall 52, or height 72 of lower wall 48 may be greater than wall height 70 of upper portion 73 of annular frame wall 52.

Wall height 70 is defined by the vertical distance between a given respective point on upper wall surface 62 of annular frame wall 52 and a corresponding respective point on lip 66 vertically below the point on upper wall surface 62. Wall height 70 and/or an overall height 71 of annular frame wall 52 may be substantially constant around annular frame wall 52 in some examples. Alternatively, wall height 70 and/or overall height 71 may vary around annular frame wall 52. Similarly, height 72 may be substantially constant around lower wall 48 in some examples, or height 72 may vary around lower wall 48. In some examples, wall height 70 and height 72 may vary in corresponding ways, such that, for example, if one or more first portions of lower wall 48 have a smaller height 72 than one or more second portions of lower wall 48, then one or more corresponding first portions of annular frame wall 52 may have a smaller wall height 70 than one or more corresponding second portions of annular frame wall 52.

In some examples, frame 36 is configured to affect, or in some cases essentially control, the topography of footbed membrane 34, via annular frame wall 52. For example, contours of footbed membrane 34 may correspond to contours of annular frame wall 52 (e.g., areas of annular frame wall 52 having varying heights 70 and/or 71). In areas where annular frame wall 52 extends a greater amount above upper frame side 56 (e.g., having a greater overall height 71), footbed membrane 34 may also be positioned a corresponding greater amount above upper frame side 56 when footbed membrane 34 and frame 36 are engaged. In the example shown in FIG. 2, for example, the overall height 71' in a medial arch region 74 of frame 46 is greater than overall height 71 in a lateral arch region 76 of frame 46. Accordingly, footbed membrane 44 has a corresponding contour in a medial arch region 78 and a lateral arch region 80 of footbed membrane 44.

Rocker bottom 50 of frame 46 includes a plurality of apertures 82 (in this case, two) formed through rocker bottom 50, extending from upper frame side 56 to lower frame side 58. In the example of frame 46, rocker bottom 50 includes two substantially oval-shaped apertures 82 formed in a heel region 84 of rocker bottom 50. Apertures 82 in this example are arranged such that a respective longitudinal axis 81 of each respective aperture 82 is substantially transverse to (e.g., perpendicular to) a longitudinal axis 83 of rocker bottom 50. Additionally or alternatively, and as shown in the example of FIG. 2, apertures 82 may be formed through rocker bottom 50 without intersecting annular frame wall 52.

Other examples of frame 36 may include more apertures 82, fewer or zero apertures 82, differently shaped or sized apertures 82, and/or apertures 82 in other positions or orientations than those illustrated. For example, other frames 36 may include one or more apertures 82 positioned within a forefoot region 86 of frame 36, and/or one or more apertures 82 positioned within a midfoot region 88 of frame 36, even though frame 46 shown in FIG. 2 is devoid of apertures 82 in both forefoot region 86 and midfoot region 88 of rocker bottom 50. In other words, in various examples of frame 36 including a plurality of such apertures 82, a first subset of the plurality of apertures 82 may be positioned within forefoot region 86 of frame 36, a second subset of the plurality of apertures 82 may be positioned within heel region 84 of frame 36, and/or a third subset of the plurality of apertures 82 may be positioned within midfoot region 88 of frame 36.

As used herein, the term "aperture" should be understood to include any void, opening, hole, gap, perforation, cut-out, and/or slit formed through a structure. Such apertures may be cut, drilled, punched, molded, stamped, bored, printed, and/or otherwise formed by any suitable technique. While apertures 82 shown in FIG. 2 are substantially oval in shape, other examples of apertures 82 may be substantially elliptical, substantially circular, slot-shaped, polygonal, tear drop shaped, tapered, curvilinear, amorphous, and/or irregularly shaped. One or more apertures 82 may be centrally located in rocker bottom 50, may be positioned within a lateral portion 87 of frame 36, and/or may be positioned within a medial portion 89 of frame 36. Apertures 82 may be configured to increase flexibility of frame 36, to allow air flow into frame cavity 60, and/or to minimize the weight or mass of rocker bottom 50. In some examples, apertures 82 may be configured to affect the modulus of elasticity of frame 36. For example, more and/or different sizes or shapes of apertures 82 may be included to reduce the modulus of elasticity of frame 36, or apertures 82 may be adjusted (e.g., by reducing the number of them and/or changing their size and/or shape) to increase the modulus of elasticity of frame 36. In some examples, apertures 82 interact with footbed membrane 34, and the number, size, and/or shape of apertures 82 may be selectively adjusted, or variable, based on the type of footwear frame 36 is used in, the wearer's average weight, or other considerations. In some examples, apertures 82 may be sized, shaped, and/or positioned to optimize weight savings while minimizing any reduction in rigidity of frame 36. For example, the use of apertures 82 having a substantially oval shape may prevent a reduction in rigidity of frame 36 more than other shapes.

In some examples, frame 36 includes one or more wall holes 90 formed through annular frame wall 52, extending from inner wall side 57 to outer wall side 64. For example, frame 46 includes three substantially oval-shaped wall holes 90, formed within midfoot region 88 of frame 46. Other examples of frame 36 may include more wall holes 90, fewer or zero wall holes 90, differently shaped or sized second wall holes 90, and/or wall holes 90 in other positions or orientations. For example, other examples of frames 36 may include one or more wall holes 90 positioned within forefoot region 86 of frame 36, and/or one or more wall holes 90 positioned within heel region 84 of frame 36, though the example of frame 46 shown in FIG. 2 is devoid of wall holes 90 in both forefoot region 86 and heel region 84. While wall holes 90 shown in FIG. 2 are substantially oval in shape, other examples of wall holes 90 may be substantially elliptical, substantially circular, slot-shaped, polygonal, tear drop shaped, tapered, curvilinear, amorphous, and/or irregularly shaped. One or more wall holes 90 may be positioned within lateral portion 87 of frame 36, and/or may be positioned within medial portion 89 of frame 36. In frame 46 of FIG. 2, three wall holes 90 are formed within medial portion 89 of frame 36 (e.g., within medial arch region 74). As used herein, the term "hole" should be understood to include any void, opening, aperture, gap, perforation, cut-out, and/or slit formed through a structure. Such holes may be cut, drilled, punched, molded, stamped, bored, printed, and/or otherwise formed by any suitable technique.

Turning now to footbed membrane 34, upper membrane surface 42, lower membrane surface 43, sew wall 45, and lower wall 48 are all generally integrally formed together, but may be formed separately in some examples. As used herein, footbed membrane 34 is considered to be a monolithic body, a unitary body, a single body, a single unit, and a single piece when upper membrane surface 42, lower membrane surface 43, sew wall 45, and lower wall 48 are integrally formed together. Such footbed membranes 34 may be cast as a single piece, molded as a single piece, 3D printed as a single piece, or otherwise formed such that upper membrane surface 42, lower membrane surface 43, sew wall 45, and lower wall 48 are undifferentiated from and unitary with one another. Similarly, upper membrane surface 42, lower membrane surface 43, sew wall 45, and lower wall 48 are all generally formed of a single material, though in some examples, different components may be formed of different materials and/or may include one or more different materials layered thereon, embedded therein, or adhered thereto. Sew wall 45 and lower wall 48 may be substantially parallel to one another, and/or may be substantially co-planar. In some examples, footbed membrane 34 is flexible and/or moldable. For example, lower wall 48 may have some stiffness, but may be sufficiently flexible to conform to and be positioned around annular frame wall 52 of frame 36 when footbed membrane 34 is secured to frame 36. Similarly, sew wall 45 may have some stiffness, but be sufficiently flexible for suitable attachment to an upper of an article of footwear as will be described herein. Sew wall 45 may be optional in some examples.

Footbed membrane 34 is generally formed of an elastomer, and thus may resiliently deform (e.g., stretch, or elongate), along one or more directions, in response to a load applied to upper membrane surface 42 (e.g., when weighted by a wearer's foot). As footbed membranes 34 and frames 36 according to the present disclosure are designed to suspend the wearer's foot, such elongation is limited, or controlled, such that suspension of the wearer's foot can be maintained.

In other words, footbed membranes 34 according to the present disclosure are designed such that they do not stretch or elongate enough for lower membrane surface 43 to contact upper frame side 56 of frame 36 when a weight or load is applied downward on upper membrane surface 42 of footbed membrane 34. Thus, footbed membranes 34 may be configured to have a maximum elongation in response to a force applied to upper membrane surface 42. Additionally or alternatively, disclosed footbed membranes 34 may be configured to stretch in a controlled manner in response to the force applied to upper membrane surface 42. For example, footbed membrane 34 may be designed to have a linear load curve spring rate in response to a force applied to upper membrane surface 42. In other examples, footbed membrane 34 may have a non-linear load response to a force applied to upper membrane surface 42. For example, footbed membrane 34 may be configured to stretch, or elongate, in response to a load, up to a predetermined point, and then resist further elongation. In other words, footbed membrane 34 may be configured to exhibit a substantially linear modulus of elasticity until elongation of footbed membrane 34 reaches an elastic limit, at which point elongation of footbed membrane 34 substantially stops. Footbed membrane 34 may be configured to store energy as a result of the resilient deformation, and return the stored energy back to the wearer's foot when the wearer lifts the wearer's foot, thereby removing the load from footbed membrane 34.

Footbed membrane 34 has substantially uniform material properties and/or cross-sectional shape in some examples. In other examples, footbed membrane 34 may have zone-specific and/or load-specific material properties and/or cross-sectional shape. For example, footbed membrane 34 may be optimized to accommodate varying loads distributed in different areas of footbed membrane 34 when in use. For example, footbed membrane 34 may have different thicknesses and/or be formed of a different durometer material in various regions of footbed membrane, for different expected loads (e.g., due to specific support needs for various applications, and/or to support different ranges of expected weights of wearers. In other words, the thickness, durometer, and/or other properties of footbed membrane 34 may vary as a function of footbed location, throughout the entire footbed membrane 34, in some examples. Precise dimensions of the thickness of footbed membrane 34 may be dictated by a mold for forming footbed membrane 34. Specific examples will be described in connection with FIGS. 18-20. Materials for footbed membrane 34 may be selected to have desired properties such as light resistance, abrasion resistance, a desired minimum tensile strength, and/or having the ability to provide energy return to the wearer (e.g., storing and releasing energy during use). Additionally or alternatively, materials for footbed membrane 34 may be engineered to have a certain durometer (or range of durometers), a certain thickness (or range of thicknesses), a certain resilience (or range of resilience), a certain rebound rate (or range of rebound rates), and/or to have a certain desired force curve in response to a load. Such material properties may be altered and/or customized for different sizes of articles of footwear, for different expected weights of respective wearers, and/or for different activities/applications for the article of footwear. Additionally or alternatively, different areas or regions of footbed membrane 34 may be optimized or configured to have different properties as described above.

Figure 3:
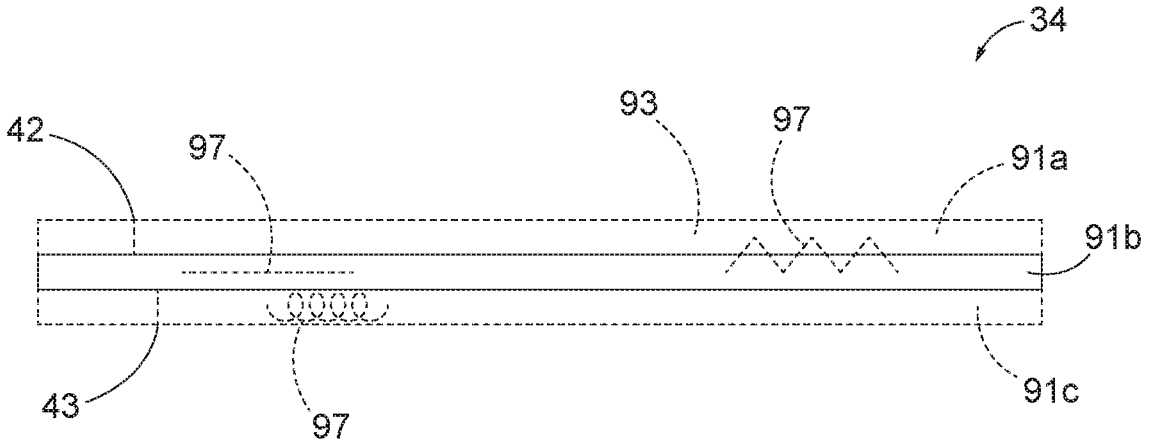
FIG. 3 is a cross-sectional, schematic representation of non-exclusive examples of footbed membranes according to the present disclosure.

With reference to FIG. 3, cross-sections of examples of footbed membrane 34 are schematically represented. Generally, in the figures, elements that are likely to be included in a given example are illustrated in solid lines, while elements that are optional to a given example are illustrated in broken lines. However, elements that are illustrated in solid lines are not essential to all examples of the present disclosure, and an element shown in solid lines may be omitted from a given example without departing from the scope of the present disclosure. As shown in FIG. 3, in some examples, footbed membrane 34 may be formed of one or more layers 91, such as layers 91*a*, 91*b*, and/or 91*c*, one of which may form at least a portion of upper membrane surface 42, and another of which may form at least a portion of lower membrane surface 43. While layers 91 are primarily described herein in connection with footbed membrane 34, all concepts of layers 91 (e.g., regional, selective placement for specific applications or performance or orthopedic results) may also be applied to other aspects of presently disclosed footwear, such as to outsoles 38 and/or to frames 36.

In an illustrative example, footbed membrane 34 includes layer 91*a* and layer 91*b*, with layer 91*a* forming upper membrane surface 42, and layer 91*b* forming lower membrane surface 43. In another example, footbed membrane 34 includes layer 91*b* and layer 91*c*, with layer 91*b* forming upper membrane surface 42, and layer 91*c* forming lower membrane surface 43. In another example, footbed membrane 34 includes layer 91*a*, layer 91*b*, and layer 91*c*, with layer 91*a* forming upper membrane surface 42, and layer 91*c* forming lower membrane surface 43. In yet other examples, footbed membrane 34 may include just one layer (e.g., layer 91*b*), with that layer forming both upper membrane surface 42 and lower membrane surface 43. In still other examples, footbed membrane 34 may include more or additional layers of the same or different materials. In some examples, one or more layers 91 may extend over the entire surface area of footbed membrane 34. Additionally or alternatively, one or more layers 91 may be present in one or more discrete regions of footbed membrane 34 and absent in one or more other such regions. In such examples, upper membrane surface 42 may be defined by a combination of one or more layers of material, and/or lower membrane surface 43 may be defined by a combination of one or more layers of material. For example, in a footbed membrane including layer 91*a* covering just a portion of layer 91*b*, upper membrane surface 42 may be defined by a combination of layer 91*a* and layer 91*b* (e.g., the portions of layer 91*b* not covered by layer 91*a*). In examples of footbed membrane 34 including more than one layer 91, one or more respective layers 91 may be adhered, cemented, cured (e.g., co-cured), laminated, coated, deposited, sprayed, and/or otherwise coupled to one or more other respective layers 91.

Whether footbed membrane 34 includes one layer (e.g., layer 91*b*), or a plurality of layers 91, footbed membrane 34 may be configured to have a maximum percentage of elongation when loaded by a wearer. In examples including more than one layer, footbed membrane 34 may be configured to have a maximum aggregate percentage of elongation of the layers acting together. In either case (e.g., regardless of whether footbed membrane 34 includes a single layer of material or a plurality of layers of material), the maximum percentage of elongation of footbed membrane 34 may be 20% or less, 15% or less, 14% or less, 13% or less, 12% or less, 11% or less, 10% or less, 9% or less, 8% or less, 7% or less, 6% or less, 5% or less, 4% or less, 3% or less, 2% or less, and/or 1% or less, in some examples. In some examples, footbed membrane 34 may be characterized by the stretch in response to a given force per unit of surface area at a given temperature. In some examples, the overall modulus of elasticity of footbed membrane 34 may be selectively adjusted, and/or the effective modulus of elasticity may be selectively adjusted regionally (e.g., with one or more regions, or areas, of footbed membrane 34 having a different modulus of elasticity than one or more other regions of footbed membrane 34, due to placement and selection of various layers of material to form footbed membrane 34). Such selective regional adjustment of the modulus of elasticity may be included in disclosed footbed membranes 34 regardless of whether they are formed of a homogenous single layer of material or include two or more layers. In one example, a high modulus fiber layer (e.g., graphene) may be included in an arch region of footbed membrane 34 to provide greater support for the wearer's foot in the arch region than in other regions of footbed membrane 34. Various layers 91 may be selected to have more or less deformation under load conditions than other layers to affect the overall properties of footbed membrane 34.

Similarly, whether footbed membrane 34 includes one layer (e.g., layer 91*b*) or a plurality of layers, footbed membrane 34 may be customized in one or more desired areas, or regions, of footbed membrane 34 to, for example, enhance performance for a specific sport, or to address specific injuries or orthopedic pathologies. For example, material characteristics and/or placement and selection of layers used to form footbed membrane 34 may be selected to address such specific applications. In one specific example, material chemistry of footbed membrane 34 may be customized in desired areas to off-load forces in that area, such as by applying or compositing graphene into areas of footbed membrane 34 positioned under the wearer's metatarsal bones to reduce flex in that area and thus off-load forces in that area (e.g., for treatment of metatarsalgia). Of course the same result can be accomplished in other examples of presently disclosed footbed membranes 34 using different materials, and/or by reducing the elasticity of footbed membrane 34 in other areas to address other orthopedic concerns. Additionally or alternatively, examples of footbed membrane 34 may be customized to enhance performance, such as by adjusting characteristics in specific regions or areas. In one specific example, footbed membranes 34 may be configured to enhance storage of kinetic energy under the metatarsal heads to enhance propulsion in running. As another example, a stiffer material (e.g., graphene) may be added to specific areas of footbed membrane 34, such as to the lateral region, under the lateral cuneiforms, under the cuboid, under the lateral region of the calcaneus, and/or under the fifth metatarsal head to reduce flexion in those areas, thereby providing additional lateral support and motion control. Such adjustments and other customizations may be useful in sports that require quick lateral movements, such as in basketball.

In some examples of footbed membrane 34 having more than one layer 91, different respective layers 91 may be configured to have different material properties in at least one of thickness, elongation, durometer, thermal properties, resilience, UV light resistance, abrasion resistance, and tensile strength. In one specific example, a first respective layer (e.g., layer 91*a*) may have a higher percentage of elongation than a second respective layer (e.g., layer 91*b*). Additionally or alternatively, different respective layers may have different durometers. For example, a first respective layer (e.g., layer 91*b*) may have a higher durometer than a second respective layer (e.g., layer 91*a*). In some examples, the percentage of difference in durometer between two respective layers may be at least 5%, at least 10%, at least 20%, at least 30%, at least 40%, and/or at least 50%. In some examples, one or more respective layers 91 may be configured for thermal enhancement of footbed membrane 34, such as by being configured to provide thermal insulation of the wearer's foot. For example, footbed membrane 34 may be separated from or insulated from other components of the article of footwear, and/or insulated from or separated from the wearer's foot, in some examples.

In some examples, different respective layers 91 may be formed of different materials. For example, footbed membrane 34 may include a layer of polyurethane elastomer (e.g., layer 91*b*) sandwiched between two other layers (e.g., layers 91*a* and 91*c*). In some examples, footbed membrane 34 may include two layers (e.g., layer 91*a* and layer 91*b*), with the first layer (e.g., layer 91*a*) being formed of a different material than the second layer (e.g., layer 91*b*). In some examples, one of layers 91 may be a secondary membrane, a mesh, a net, cabling, and/or an elastomeric layer that is positioned above, below, and/or at least partially within another layer. For example, layer 91*a* may be a secondary membrane positioned above layer 91*b*. As another example, layer 91*c* may be a mesh positioned below layer 91*b*. As yet another example, layer 91*a* may be cabling that is at least partially positioned within (e.g., at least partially embedded within) layer 91*b*. In some examples, one or more layers 91 may be configured to prevent elongation of a different respective layer beyond a predetermined limit. For example, layer 91*b* may be configured to have less elongation than layer 91*a*, and layer 91*b* may be positioned with respect to layer 91*a* (e.g., "under," or "below," layer 91*a*) to limit elongation of layer 91*a*. In another example, layer 91*b* may be configured to allow greater elongation than layer 91*a*, and layer 91*a* may be positioned with respect to layer 91*b* (e.g., "above" layer 91*b*) to limit elongation of layer 91*b*.

In some footbed membranes 34, at least one of layers 91 may be formed of an elastomer, while one or more other layers 91 may be formed of a fabric material. For example, layer 91*b* may be formed of an elastomer, while layer 91*a* may be a fabric (or other) protective covering above layer 91*b*, and/or layer 91*c* may be a fabric (or other) layer below layer 91*b*, such as to further restrict elongation of layer 91*b*. As used herein, terms such as "above" and "below" are merely conventions for convenient reference to the figures, and are not meant to be limiting, though these terms generally refer to the arrangements as the disclosed sole assemblies would be used. For example, a layer may be said to be "above" another layer if it is farther from the ground when such layered footbed membrane is incorporated into an article of footwear and worn on a ground surface. Similarly, a layer may be said to be "below" another layer if it is closer to the ground surface in the same context.

One or more layers 91 of footbed membrane 34 may be impregnated with another material. For example, one or more layers 91 may be a first material impregnated with an elastomer, such as a polyurethane elastomer. In one specific example, footbed membrane 34 may include a layer 91 that is a low-modulus fabric impregnated with a polyurethane or other elastomer. Additionally or alternatively, one or more layers 91 of footbed membrane 34 may be formed of or include silicone. Additionally or alternatively, one of layers 91 may be a laminate covering 93 coupled to or forming upper membrane surface 42. In some examples, such laminate covering 93 may be configured to have a limited percentage of elongation, such as a maximum percentage of elongation of less than 85%, less than 75%, less than 65%, less than 55%, less than 45%, less than 35%, less than 25%, less than 20%, less than 15%, less than 10%, less than 5%, and/or less than 3%. Such laminate covering 93 may be configured to provide an inert or comfortable contact with the wearer's foot.

Whether footbed membrane 34 is formed of a plurality of layers 91, or a single layer 91, footbed membrane 34 (e.g., one or more layers 91 of footbed membrane 34) may be formed of a solid elastomer, which may be a non-mesh material. In one specific example, footbed membrane 34 may include a shape memory alloy and/or bulk metallic glasses. The entire footbed membrane 34 (e.g., upper membrane surface 42, lower membrane surface 43, lower wall 48, and sew wall 45) may be formed of a solid elastomeric material in some examples. Suitable materials for footbed membrane 34 include one or more of Kevlar, Vectran, a Vectran hybrid polyester, an elastomeric polyester, Dyneema, Ultrasuede, elastomeric polyurethane, and/or silicone. Additionally or alternatively, footbed membrane 34 may include organic polymers, polyacetals, polyureas (e.g., elastomeric polyureas), polyurethanes, polyolefins, polyacrylics, polycarbonates, polyalkyds, polystyrenes, polyesters, polyamides, polyaramides, polyamideimides, polyarylates, polyarylsulfones, polyethersulfones, polyphenylene sulfides, polysulfones, polyimides, polyetherimides, polytetrafluoroethylenes, polyetherketones, polyether etherketones, polyether ketone ketones, polybenzoxazoles, polyoxadiazoles, polybenzothiazinophenothiazines, polybenzothiazoles, polypyrazinoquinoxalines, polypyromellitimides, polyquinoxalines, polybenzimidazoles, polyoxindoles, polyoxoisoindolines, polydioxoisoindolines, polytriazines, polypyridazines, polypiperazines, polypyridines, polypiperidines, polytriazoles, polypyrazoles, polycarboranes, polyoxabicyclononanes, polydibenzofurans, polyphthalides, polyanhydrides, polyvinyl ethers, polyvinyl thioethers, polyvinyl alcohols, polyvinyl ketones, polyvinyl halides, polyvinyl nitriles, polyvinyl esters, polysulfonates, polysulfides, polythioesters, polysulfonamides, polyphosphazenes, polysilazanes, polysiloxanes, fluoropolymers, polybutadienes, and/or polyisoprenes. Such materials may be blended and/or copolymerized with one another, such as with a polyurethane or polyuria. Aromatic diisocyanates for the preparation of polyurethane prepolymers include TDI, MDI, and PPDI. Useful aliphatic diisocyanates can include, for example, 1,6-hexamethylene diisocyanate (HDI); 1,3-cyclohexyl diisocyanate; 1,4-cyclohexyl diisocyanate (CHDI); the saturated diphenylmethane diisocyanate known as H(12)MDI; (also known commercially as bis{4-isocyanatocyclohexyl}methane, 4,4'-methylene dicyclohexyl diisocyanate, 4,4-methylene bis(dicyclohexyl)diisocyanate, methylene dicyclohexyl diisocyanate, methylene bis(4-cyclohexylene isocyanate), saturated methylene diphenyl diisocyanate, and saturated methyl diphenyl diisocyanate), isophorone diisocyanate (IPDI); or the like; or a combination comprising at least one of the foregoing isocyanates. An exemplary aliphatic diisocyanate is H(12)MDI. Other exemplary polyisocyanates include hexamethylene diisocyanate (HDI), 2,2,4- and/or 2,4,4-trimethyl-1,6-hexamethylene diisocyanate, dodecamethylene diisocyanate, 1,4-diisocyanatocyclohexane, 1-isocyanato-3,3,5-trimethyl-5-isocyanatomethylcyclohexane (IPDI), 2,4'- and/or 4,4'-diisocyanato-dicyclohexyl methane, 2,4- and/or 4,4'-diisocyanato-diphenyl methane and mixtures of these isomers with their higher homologues which may be obtained by the phosgenation of aniline/formaldehyde condensates, 2,4- and/or 2,6-diisocyanatotoluene and any mixtures of these compounds. In one specific example, layer 91*a* may be formed of a silicone blend and layer 91*b* may be formed of elastomeric polyurethane. Additionally or alternatively, frames 36 and/or outsoles 38 according to the present disclosure may be formed of one or more layers, as described above in connection with footbed membrane 34. Additionally or alternatively, footbed membrane 34 may include one or more programmable materials (e.g., materials that respond to electronic control). Such programmable materials may be incorporated into footbed membrane 34 for orthopedic control or manipulation, while a wearer uses the article of footwear. For example, one or more programmable materials may be inserted into the arch region of footbed membrane 34 to increase support. In some examples, the entire footbed membrane 34 may be formed of one or more programmable materials.

Still with reference to FIG. 3, some examples of footbed membrane 34 include one or more internal members 97 that are at least partially positioned, formed, embedded, and/or inserted within or on footbed membrane 34, such as within or on one or more layers 91 of footbed membrane 34. For example, one or more internal members 97 may be at least partially embedded within one or more layers 91 of footbed membrane 34. Internal members 97 may be configured to limit elongation of footbed membrane 34 in one or more direction. For example, one or more internal members 97 may be positioned and configured to limit elongation of footbed membrane 34 in a longitudinal direction (e.g., along longitudinal axis 83 of FIG. 2), and/or one or more internal members 97 may be positioned and configured to limit elongation of footbed membrane 34 in a transverse direction substantially perpendicular to the longitudinal axis of footbed membrane 34. Such internal members 97 may include, for example, a cable, a thread, a wire, and/or a string. Internal members 97 may take any suitable shape or form, including but not limited to a coil, a helix, a zig-zag, and/or a different wavy pattern.

Internal members 97 may extend through multiple layers 91 in some examples. For example, FIG. 3 illustrates a zig-zag internal member 97 extending partially through layers 91*a* and 91*b*. FIG. 3 further illustrates a coiled internal member 97 within layer 91*c* and a linear internal member 97 within layer 91*b*. Footbed membrane 34 may include zero internal members 97, a single internal member 97, or a plurality of internal members 97 in various examples. Internal members 97 may extend substantially along an entire length of footbed membrane 34, substantially along an entire width of footbed membrane 34, partially along a length of footbed membrane 34, and/or partially along a width of footbed membrane 34. Internal members 97 may be oriented substantially parallel to a longitudinal axis of footbed membrane 34 (e.g., longitudinal axis 83 of FIG. 2), substantially perpendicular to such longitudinal axis, and/or at a non-perpendicular angle to the longitudinal axis of footbed membrane 34, in various examples. Internal members 97 may be configured to resiliently deform in some examples. Additionally or alternatively, one or more internal members 97 may be configured to enhance energy return of sole assembly 30 when a wearer is striding.

Returning to FIG. 2, sew wall 45 may have a sew wall height 98 defined as the vertical distance between a respective point on an upper sew wall surface 100 of sew wall 45 and a corresponding respective point on upper membrane surface 42. In some examples, sew wall height 98 may be substantially constant along the entire sew wall 45 (e.g., around membrane perimeter 47 of footbed membrane 34). In other examples, sew wall height 98 is variable at different locations along sew wall 45. Sew wall height 98 is at least 2 millimeters (mm), at least 3 mm, at least 4 mm, at least 5 mm, at least 6 mm, at least 7 mm, at least 8 mm, at least 9 mm, at least 10 mm, at least 11 mm, at least 12 mm, at least 13 mm, at least 14 mm, and/or at least 15 mm in some examples, and may be configured to have a sufficient height to provide a sufficient surface area to secure footbed membrane 34 to an upper of an article of footwear as will be described herein. Typical examples of sew wall 45 have a sew wall height 98 of between about 3 and 11 mm. Sew wall 45 generally has a Shore A durometer of between 30 and 85, with some typical examples having a durometer between 50 and 90 on the Shore A scale. The durometer of sew wall 45 may be selected or adjusted for desired functionality. Sew wall 45 may be thin and compliant enough to permit it to be sewn through to attach footbed membrane 34 to an upper of an article of footwear. For example, sew wall 45 may be less than 1 mm, less than 2 mm, less than 3 mm, less than 4 mm, less than 5 mm, less than 6 mm, less than 7 mm, less than 8 mm, less than 9 mm, and/or less than 10 mm in thickness. In specific examples, the thickness of sew wall 45 may be between about 1 mm and about 5 mm. Sew wall 45 is generally configured to be sewn through using standard sewing equipment present in shoe manufacturing facilities, and yet be strong enough to withstand securement forces and adequately anchor the upper of the article of footwear to footbed membrane 34. Accordingly, in some examples, sew wall 45 has a minimum shear and tensile strength of between 3,000 and 7,500 PSI.

When footbed membranes 34 according to the present disclosure and frames 36 according to the present disclosure are coupled to one another and/or engaged with one another to form sole assembly 30, lower membrane surface 43 of footbed membrane 34 faces upper frame side 56 of frame 36, and frame cavity 60 is thereby defined (e.g., located) between lower membrane surface 43 of footbed membrane 34 and upper frame side 56 of frame 36. Footbed membranes 34 according to the present disclosure are configured to support and suspend a wearer's foot above frame cavity 60 when in use. Thus, sole assembly 30 is configured to prevent the wearer's foot from contacting frame 36 (e.g., upper frame side 56) via the interaction of footbed membrane 34 and frame 36. In other words, sole assembly 30 is configured to prevent lower membrane surface 43 from contacting upper frame side 56 (and/or frame 36, in general) when footbed membrane 34 is weighted by a wearer (e.g., standing or striding in an article of footwear containing sole assembly 30).

For example, with reference to FIG. 2, frame 36 (e.g., annular frame wall 52 of frame 36) may be configured to pull footbed membrane 34 taut when the two are engaged to form sole assembly 30. For example, footbed membrane 34 may be pre-stretched to a certain percentage of elongation from a resting configuration when footbed membrane 34 is secured to frame 36. For example, footbed membrane 34 may be stretched to at least 1% elongation beyond the resting configuration, at least 2% elongation beyond the resting configuration, at least 3% elongation beyond the resting configuration, at least 4% elongation beyond the resting configuration, at least 5% elongation beyond the resting configuration, at least 6% elongation beyond the resting configuration, at least 7% elongation beyond the resting configuration, at least 8% elongation beyond the resting configuration, at least 9% elongation beyond the resting configuration, and/or at least 10% elongation beyond the resting configuration, when secured to frame 36. In this manner, presently disclosed footbed membranes 34 may be said to "pull" a wearer's foot into a desired position, rather than "pushing" it like conventional arch support structures are designed to do.

In some examples, sole assembly 30 may be configured to maintain a minimum gap between lower membrane surface 43 of footbed membrane 34 and upper frame side 56 of frame 36 when footbed membrane 34 is weighted by a wearer of an article of footwear 32 into which sole assembly 30 is incorporated. For example, sole assembly 30 may be configured such that lower membrane surface 43 is spaced apart from upper frame side 56 by at least 1 millimeter (mm), at least 2 mm, at least 3 mm, at least 4 mm, at least 5 mm, at least 10 mm, at least 15 mm, and/or at least 20 mm when sole assembly 30 is not weighted, and/or footbed membrane 34 may be configured such that lower membrane surface 43 is spaced apart from upper frame side 56 by at least 1 mm, at least 2 mm, at least 3 mm, at least 4 mm, at least 5 mm, at least 10 mm, at least 15 mm, and/or at least 20 mm when sole assembly 30 is weighted by a wearer. Additionally or alternatively, footbed membrane 34 may be configured to suspend between 80 pounds per square inch and 1200 pounds per square inch above upper frame side 56 such that lower membrane surface 43 is prevented from contacting upper frame side 56 when footbed membrane 34 is weighted. To this end, footbed membrane 34 may be configured to resist elongation beyond a predetermined threshold, which may be defined as a percentage of elongation (e.g., less than 50%, less than 40%, less than 30%, less than 25%, less than 20%, less than 15%, less than 10%, and/or less than 5%), and/or as an absolute measure of elongation. Additionally or alternatively, footbed membrane 34 maybe configured to suspend at least 1.1 times a wearer's body weight, at least 2 times a wearer's body weight, at least 3 times a wearer's body weight, at least 4 times a wearer's body weight, at least 5 times a wearer's body weight, at least 6 times a wearer's body weight, at least 7 times a wearer's body weight, at least 8 times a wearer's body weight, at least 9 times a wearer's body weight, and/or at least 10 times a wearer's body weight, such that lower membrane surface 43 is prevented from contacting upper frame side 56 when so weighted in both static and dynamic uses.

Figure 4:
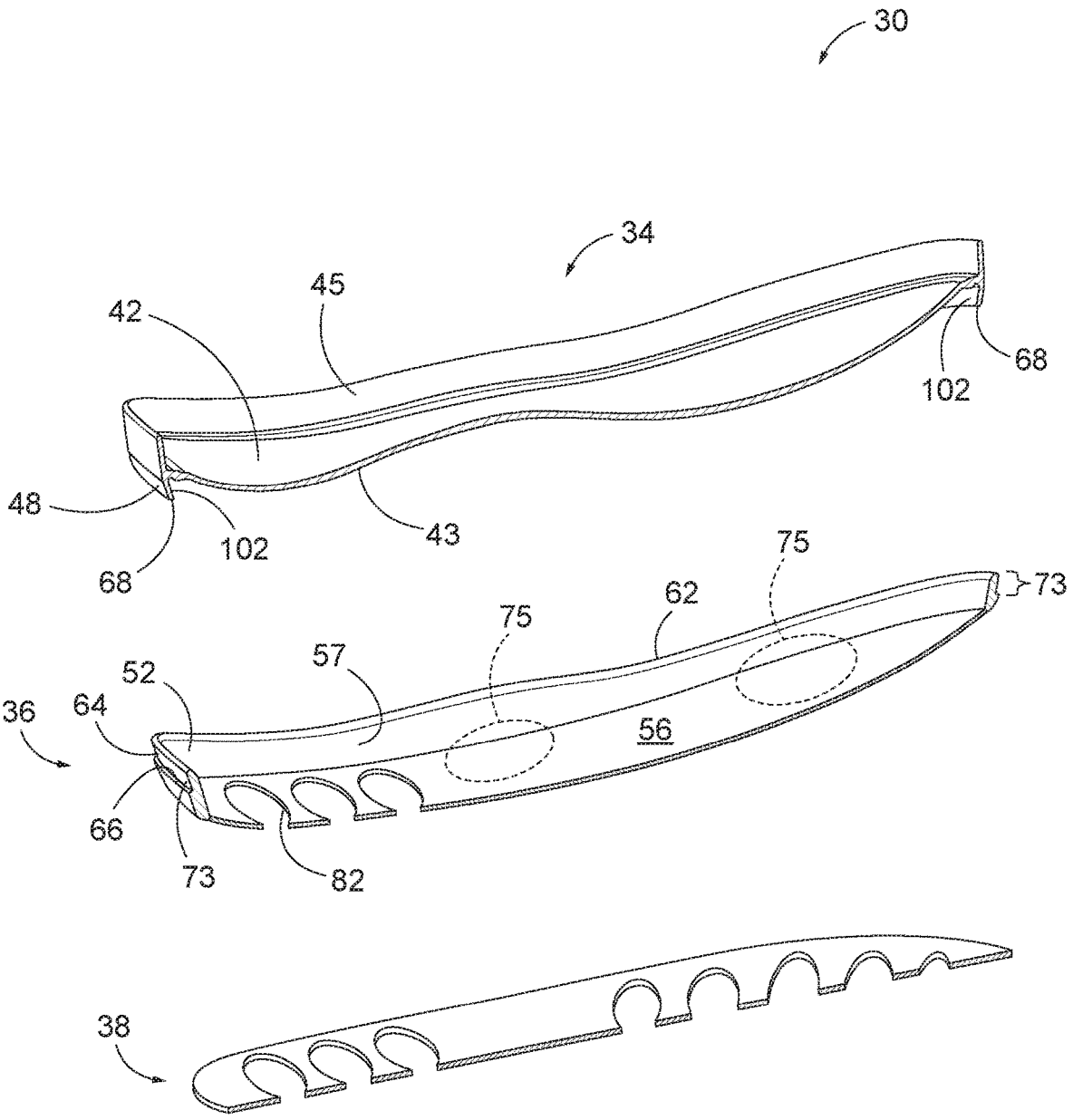
FIG. 4 illustrates an exploded, perspective, cutaway view of one example of a sole assembly according to the present disclosure, including a frame, a footbed membrane, and an outsole.

In general, footbed membrane 34 may be secured to frame 36 in any suitable fashion. With reference to FIGS. 2, 4, 4*b*, and 4*c* (of which FIG. 4 illustrates an exploded, partial cutaway view of an example of sole assembly 30 including footbed membrane 34, frame 36, and outsole 38), footbed membrane 34 is adhered, bonded, welded, mechanically fastened, and/or cemented to frame 36 by coupling lower wall 48 of footbed membrane 34 to annular frame wall 52 of frame 36. For example, outer wall side 64 of annular frame wall 52 may be adhered to an inner surface 102 (FIG. 4) of lower wall 48 of footbed membrane 34. Additionally or alternatively, lower surface 68 of lower wall 48 of footbed membrane 34 may be adhered to annular frame wall 52, such as to lip 66. Additionally or alternatively, upper wall surface 62 of annular frame wall 52 may be adhered to lower membrane surface 43 of footbed membrane 34. In some examples, lower surface 68 of lower wall 48 may engage lip 66 without necessarily being coupled or adhered thereto, such as by physically contacting lip 66 when footbed membrane 34 is coupled to frame 36. In some examples, footbed membrane 34 may be adhered to frame 36, but not to any other components of the article of footwear into which sole assembly 30 is incorporated. For example, as will be explained in further detail below, footbed membrane 34 is not adhered to an upper of the article of footwear in some examples, but rather is only secured to the upper via sew wall 45 in some examples. In some examples, footbed membrane 34 and frame 36 may be integrally formed together (e.g., co-molded).

Outsole 38 may be manipulated, in various examples of sole assembly 30, in order to create desired properties in the sole assembly. For example, the height (e.g., thickness) of outsole 38 may be increased or decreased, over the entire outsole 38, or within one or more specific portions, or regions, of outsole 38, in order to create desired effects. Additionally or alternatively, the durometer of outsole 38 may be increased or decreased in one or more regions of outsole 38 in order to provide increased or decreased stiffness in one or more regions of outsole 38. Additionally or alternatively, outsole 38 may include different materials in one or more different regions. In a specific example, outsole 38 may include a thicker and/or firmer material in a medial portion of outsole 38 that may be under the wearer's arch when the article of footwear is worn. High energy return fibers or materials may be incorporated into outsole 38, frame 36, and/or footbed membrane 34 in various different examples.

Figure 4B:
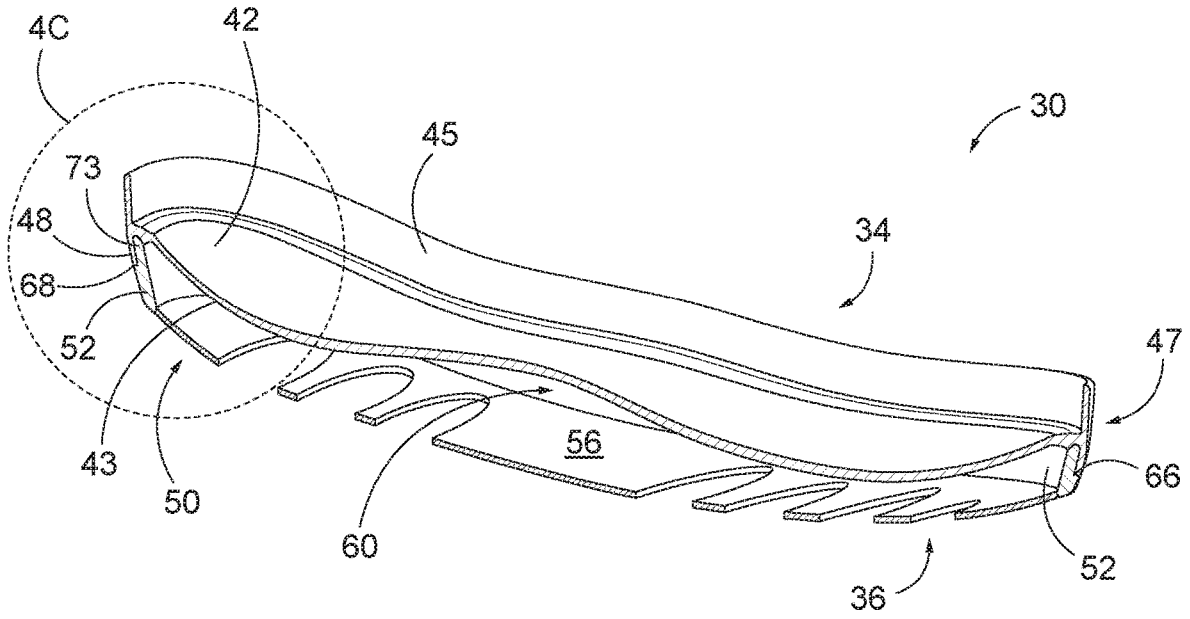
FIG. 4*b* illustrates the cutaway sole assembly of FIG. 4, shown with the frame and footbed membrane assembled together.
Figure 4C:
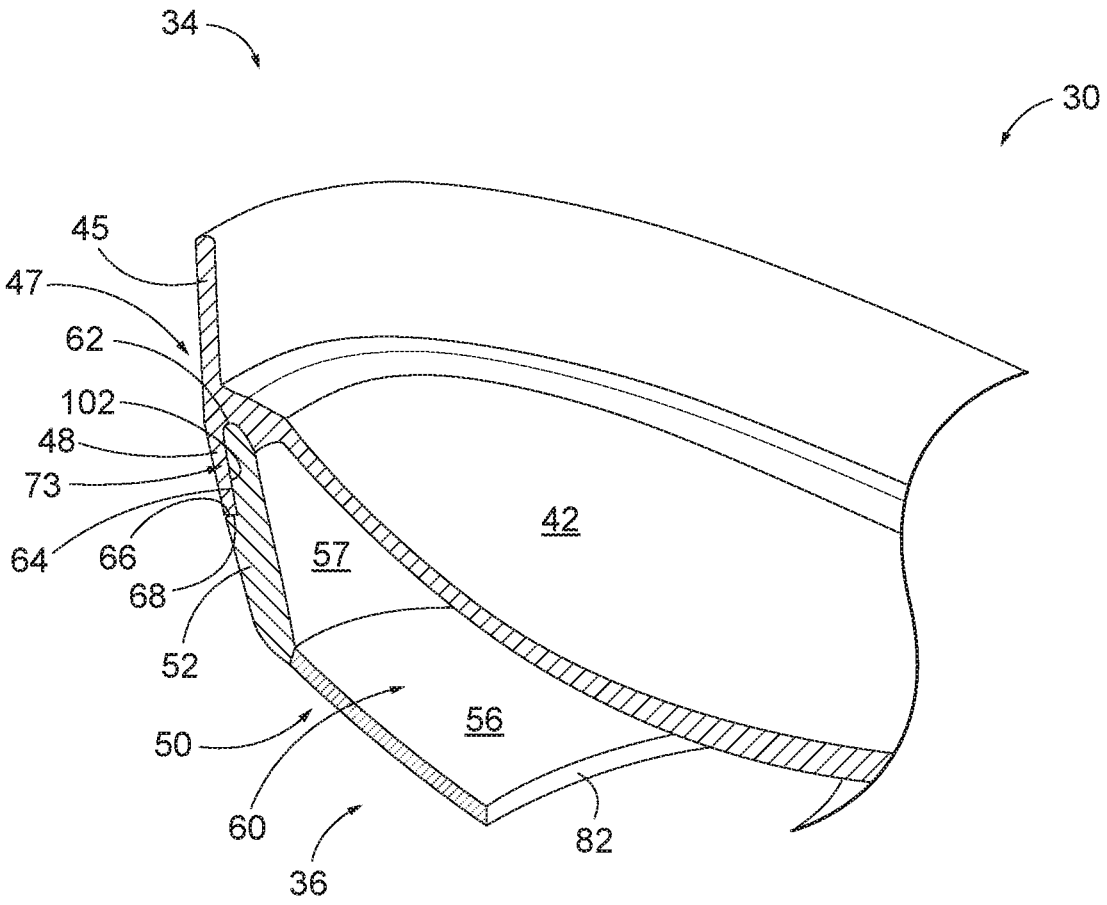
FIG. 4*c* is a close-up view of a portion of FIG. 4*b*, as indicated in FIG. 4*b*.

FIG. 4*b* illustrates sole assembly 30, assembled (e.g., with footbed membrane 34 secured to frame 36), though outsole 38 is not shown in FIG. 4*b*, for clarity. FIG. 4*c* shows a close-up of a portion of FIG. 4*b*, as indicated. As shown in FIGS. 4*b* and 4*c*, when footbed membrane 34 and frame 36 are coupled to one another to form sole assembly 30, frame cavity 60 is defined between lower membrane surface 43 of footbed membrane 34 and upper frame side 56 of frame 36. Annular frame wall 52 of frame 36, sew wall 45 of footbed membrane 34, and/or lower wall 48 of footbed membrane 34 may all be substantially co-planar and/or parallel with one another, as shown in FIG. 4*c*. Lower wall 48 of footbed membrane 34 may be configured to engage lip 66 of annular frame wall 52 such that inner surface 102 of lower wall 48 is positioned to face outer wall side 64 of annular frame wall 52, and such that lower surface 68 of lower wall 48 is engaged with or adjacent to lip 66. In this configuration, upper wall surface 62 of annular frame wall 52 may be engaged with (e.g., coupled to, exerting force on, and/or contacting) a portion of lower membrane surface 43 adjacent membrane perimeter 47. Such engagement of annular frame wall 52 and footbed membrane 34 generally extends around the entire membrane perimeter 47 of sole assembly 30.

In use, disclosed sole assemblies 30 are incorporated into an article of footwear, with the wearer's foot being supported by footbed membrane 34 when wearing the article of footwear. Footbed membrane 34 and frame 36, therefore, are generally configured to extend along substantially an entire length of the wearer's foot, though in some examples, sole assembly may extend under only a portion of the wearer's foot. Regions of the wearer's foot are therefore supported in corresponding portions of sole assembly 30. For example, with reference to FIGS. 1 and 2, forefoot region 16 of foot 10 is positioned to be supported by forefoot region 86 of frame 36 (and a corresponding forefoot region 92 of footbed membrane 34) when the wearer's foot is in an article of footwear including such sole assembly 30. Similarly, midfoot region 14 of foot 10 is positioned to be supported by midfoot region 88 of frame 36 (and a corresponding midfoot region 94 of footbed membrane 34), and heel region 12 of foot 10 is positioned to be supported by heel region 84 of frame 36 (and a corresponding heel region 96 of footbed membrane 34). In other words, these regions may be generally positioned underneath the corresponding forefoot, arch (or midfoot), and heel regions of a wearer's foot, respectively, when an article of footwear incorporating a disclosed sole assembly 30 is being worn by the wearer.

Generally, such presently disclosed sole assemblies 30 may be configured to reduce ground reaction forces experience by a wearer of an article of footwear including sole assembly 30. For example, in a biomechanical study comparing an example of an article of footwear according to the present disclosure with leading commercial athletic shoes, a significant reduction in ground reaction forces was found in the example of presently disclosed articles of footwear that was tested. For example, the example of article of footwear 32 that was tested exhibited a 52% reduction in ground reaction forces compared to one commercially available shoe, a 21% reduction in ground reaction forces compared to a second commercially available shoe, and a 14% reduction in ground reaction forces compared to a third commercially available shoe. In this and other manners, sole assemblies 30 and articles of footwear including the same may be designed to reduce and/or prevent injuries among wearers. In some examples, sole assembly 30 effectively lowers the center of gravity of a wearer (e.g., by widening the footbed, lowering the footbed, and/or moving support to the outer perimeter of the article of footwear), provides stability to the wearer, enhances propulsion experienced by the wearer during the toe-off phase of the gait cycle, reduces fatigue of the wearer, and/or supports soft tissues of the wearer of the article of footwear including said sole assembly 30. In addition to being configured to support a wearer's foot during the gait cycle (e.g., while walking, running, or in other dynamic conditions), presently disclosed sole assemblies 30 may also be configured to support and provide stability for a wearer's foot in static conditions (e.g., while the wearer is standing).

During the gait cycle of a wearer, footbed membrane 34 may be configured to transfer forces to frame 36 at membrane perimeter 47 of lower membrane surface 43. In some examples, frames 36 may be configured to interact with footbed membranes 34, and/or with other structural components of sole assembly 30 or article of footwear 32, such as with an upper and/or outsole 38. For example one or more structural components may be configured to operate in a coordinated manner in response to a walking gait of a wearer of article of footwear 32, thereby integrating sole assembly 30, outsole 38, and/or other elements inside article of footwear 32 to work together and support the wearer's foot during various phases of the gait cycle. As used herein, the term "gait" refers to the natural progression of the feet of the wearer who is walking or running while wearing footwear 32.

Different regions of various structural components may be configured to "activate" (e.g., absorb energy, and/or return energy to the wearer's foot) at different phases, or times, during the gait cycle (e.g., in a dynamic condition). In other words, because different portions of sole assembly 30 are loaded at different points during the gait cycle, different features of sole assembly function (e.g., support and/or impart energy to the wearer's foot) at those different points of the gait cycle. For example, upon a heel strike, a portion of footbed membrane 34 may flex (e.g., heel region 96 and/or midfoot region 94), and at least partially absorb and disperse the shock force of impact through sole assembly 30. The flexing, absorption of force, and dispersal of force may be augmented by the configuration of heel region 84 of frame 36. At this point in a walking gait, footbed membrane 34 may deform and operate to settle the foot in a balanced position, which may reduce twisting and faltering, thereby facilitating proper body alignment and forward momentum. Footbed membrane 34 may cushion the wearer's foot (e.g., heel) at impact, while frame 36 may be configured to stabilize the wearer's foot. As the natural walking gait progresses, due to the resilience and/or coefficient of restitution of footbed membrane 34, footbed membrane 34 may spring back into its default unstressed orientation, which, in combination with the action of rocker bottom 50 of frame 36, may thereby aid in making the walking gait easier by returning energy towards the heel of the wearer, pushing or otherwise urging the wearer's foot (and thus the wearer) forward and/or upward away from the ground.

Figure 7:
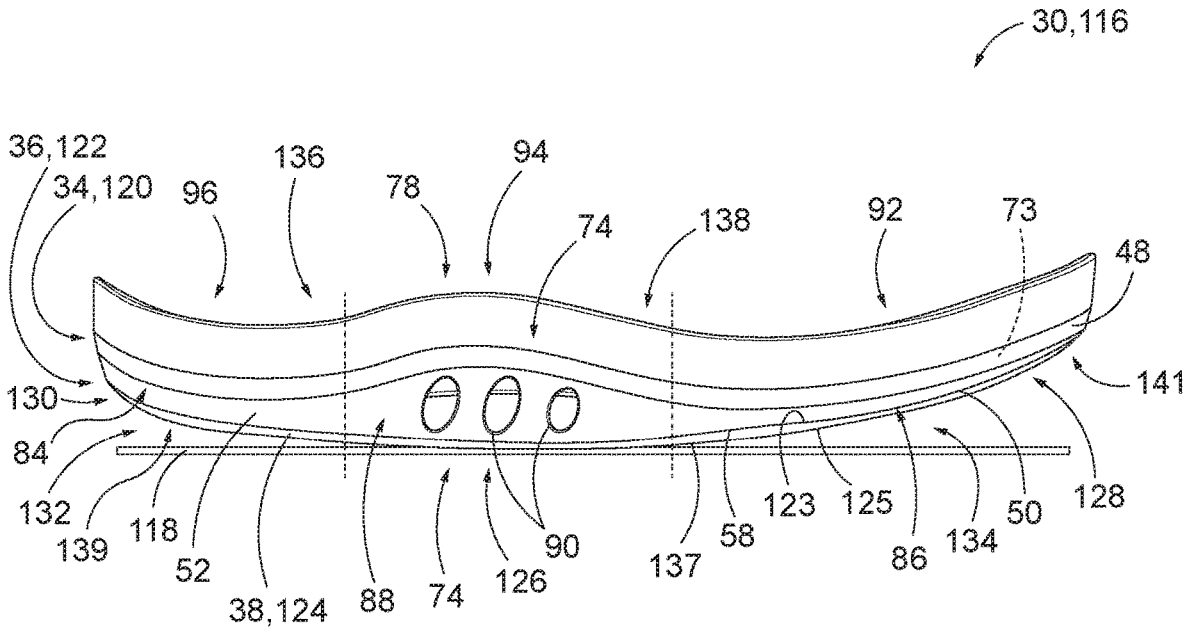
FIG. 7 illustrates a side elevation view of one example of a sole assembly according to the present disclosure.

After heel region 96 of footbed membrane 34 and heel region 84 of frame 36 are activated in the first phases of the gait cycle, midfoot region 88 of frame 36 and midfoot region 94 of footbed membrane 34 activate and may be configured to provide optimal support and biomechanical efficiency. For example, frame 36 may be configured to roll from heel region 84 to midfoot region 88 (e.g., via a heel ramp 139, as shown in FIG. 7). In some cases, frame 36 is configured to cause the wearer's foot to roll such that the weight is directed towards medial portion 89 of frame 36. Lastly, forefoot region 92 of footbed membrane 34 and forefoot region 86 of frame 36 (along with outsole 38, in some examples) activate, and may be configured to enhance propulsion at the toe-off portion of the gait cycle (e.g., when the wearer is lifting the foot off the ground), thereby reducing pressure in critical areas of the foot, enhancing performance, and/or reducing fatigue experienced by the wearer in some examples. In some examples, frame 36 is configured to roll from midfoot region 88 to forefoot region 86 (e.g., via a midfoot ramp 141, as shown in FIG. 7). Because frame 36 may be configured to roll into midfoot region 88 towards the beginning of the gait cycle and to roll into forefoot region 86 later in the gait cycle, it may be said that heel ramp 139 (FIG. 7) "activates" earlier in the gait cycle than midfoot ramp 141 (FIG. 7), and/or that heel region 84 activates earlier than forefoot region 86 of frame 36.

In addition to supporting the wearer's foot throughout the gait cycle (e.g., in dynamic conditions), presently disclosed sole assemblies 30 and articles of footwear 32 are also configured to provide stability in static conditions, such as when the wearer is standing. For example, sole assemblies 30 and articles of footwear 32 may be configured to lower the center of gravity for a wearer (as compared to conventional shoes in which the wearer's foot is not suspended above a frame) and/or to lower a heel height for the wearer, which may improve posture.

By varying the cross-sectional physical shape and/or the material properties in different sections or areas of footbed membrane 34, the foot load-deformation profile can be controlled. The rate of energy return from footbed membrane 34 as the load from the wearer's foot is removed may be controlled through the footbed membrane's rebound properties. Dampened and dynamic energy return may be controlled through the elastomer chemistry of the materials used to form footbed membrane 34. For example, by varying the chemistry of the footbed membrane 34 materials through pre-polymers, curatives, stoichiometry, additives, and/or processing, the elongation and energy return rates can be controlled. In some specific examples, the chemistry of footbed membrane 34 may be varied by varying the ratio of A side to B side (e.g., varying the ratio of resin to pre-polymer, or varying the ratio of resin to polymer), using different resins, using different pre-polymers having different properties and/or polymeric lengths, changing reaction speeds via catalytic agents and/or curative agents, producing different durometer materials, co-curing various layers of footbed membrane 34 with different durometers for chemical bonding, changing cure time of footbed membrane 34, changing cure temperatures of footbed membrane 34, and/or co-curing one or more layers with pre-cured matrices that are configured to control or limit elongation of footbed membrane 34.

As footbed membrane 34 is deformed (e.g., stretches) under the applied pressure from a wearer's foot, the deformation is controlled and limited so as to not allow footbed membrane 34 to make contact with frame 36 or the ground surface underneath. As footbed membrane 34 stretches in a given direction, the elongation reaches a point where the elongation stops as the applied tensile forces increase, thereby preventing the wearer's foot from further deforming footbed membrane 34 in some examples. The limiting of the elongation of footbed membrane 34 can be achieved through one or more of several methods and is not limited to just the discussed examples. In some examples, footbed membrane 34 may include respective sections or areas that are configured to reach the elastic limit before other sections or areas, thereby resulting in the support of the wearer's foot being increased or altered in different respective areas. For example, some portions (sections) of footbed membrane 34 having a thinner cross-section may be configured to reach their elastic limit before adjacent areas of thicker cross-sections that remain within their elastic limit and act as dampened springs. In some examples, perforations in footbed membrane 34 may be configured to resist elongation of certain areas of footbed membrane 34.

While in many examples, sole assemblies 30 are devoid of any structures within frame cavity 60 (e.g., between lower membrane surface 43 of footbed membrane 34 and upper frame side 56 of frame 36), in some examples, sole assembly 30 may include, for example, an inflatable element positioned within frame cavity 60. FIG. 4 schematically illustrates an example of such an inflatable element, in the form of optional inflatable element 75, which may be coupled to upper frame side 56 and/or to lower membrane surface 43, or may be coupled to neither and simply positioned within frame cavity 60 (e.g., "floating" within frame cavity 60). In some examples, inflatable element 75 is integrally formed with frame 36. In some examples, inflatable element 75 is integrally formed with footbed membrane 34. Inflatable element 75 may be, for example, a pouch, a bag, and/or a balloon filled with a gas or a fluid. The volume of inflatable element 75 may be substantially fixed, or may be selectively adjustable. For example, the volume of inflatable element 75 may be increased to support a greater weight, in some examples. Inflatable element 75 may be compressible or incompressible in various examples. Inflatable element 75 is generally configured to further limit elongation of footbed membrane 34, and thus may act as a redundancy or failsafe in preventing contact between lower membrane surface 43 of footbed membrane 34 and upper frame side 56 of frame 36 (e.g., maintaining suspension of the wearer's foot). For example, as deformation of footbed membrane 34 reduces the volume of frame cavity 60, inflatable element 75 may be configured to spread, thereby increasing its footprint or surface area, and prevent or resist further deformation of footbed membrane 34.

Footbed membranes 34 according to the present disclosure may be customized and/or optimized for various applications. For example, a plurality of footbed membranes 34 and frames 36 may be formed, with different respective footbed membranes 34 having different properties form each other, and/or different respective frames 36 having different properties from each other. A respective footbed membrane 34 may be selected from among the plurality of different membranes for a given application (e.g., shoe size, or activity), and combined with a selected frame 36 to create a selectively customizable sole assembly 30 for a given size of wearer, and/or for a given activity. In some examples, sole assemblies 30 may be selectively optimized for different sports. In one example, a first footbed membrane of the plurality of footbed membranes is customized for a first shoe size, and a second footbed membrane of the plurality of footbed membranes is customized for a second shoe size. The first footbed membrane differs from the second footbed membrane in at least one of durometer, thickness, elongation, and tensile strength. For example, the first footbed membrane may be configured for a heavier wearer or corresponding larger shoe size, and thus may have a footbed membrane with a greater overall thickness and/or durometer than the second footbed membrane configured for a lighter wearer or corresponding smaller shoe size. In other words, disclosed footbed membranes 34 may be configured to selectively suspend heavier or lighter wearers by selectively altering the material properties of the footbed membrane as disclosed herein.

Figure 5:
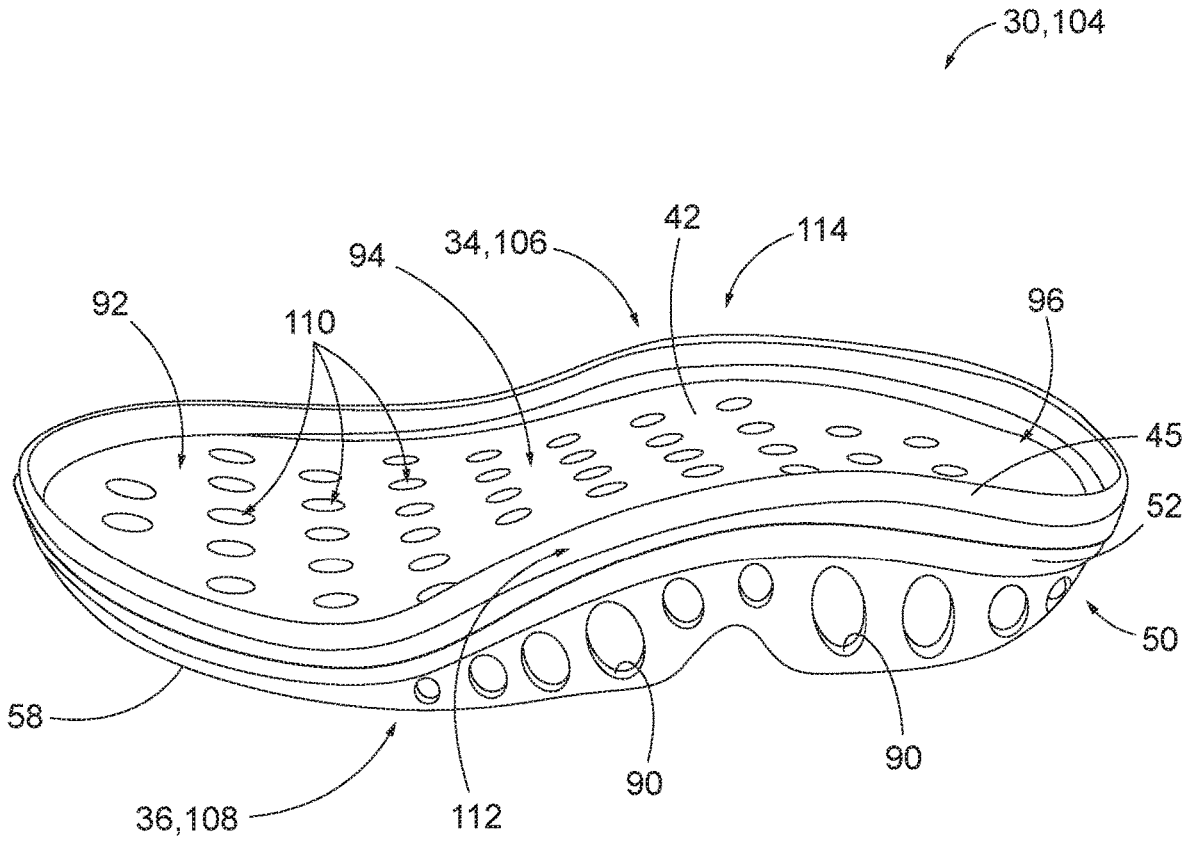
FIG. 5 is a perspective view of one example of an assembled sole assembly according to the present disclosure.
Figure 6:
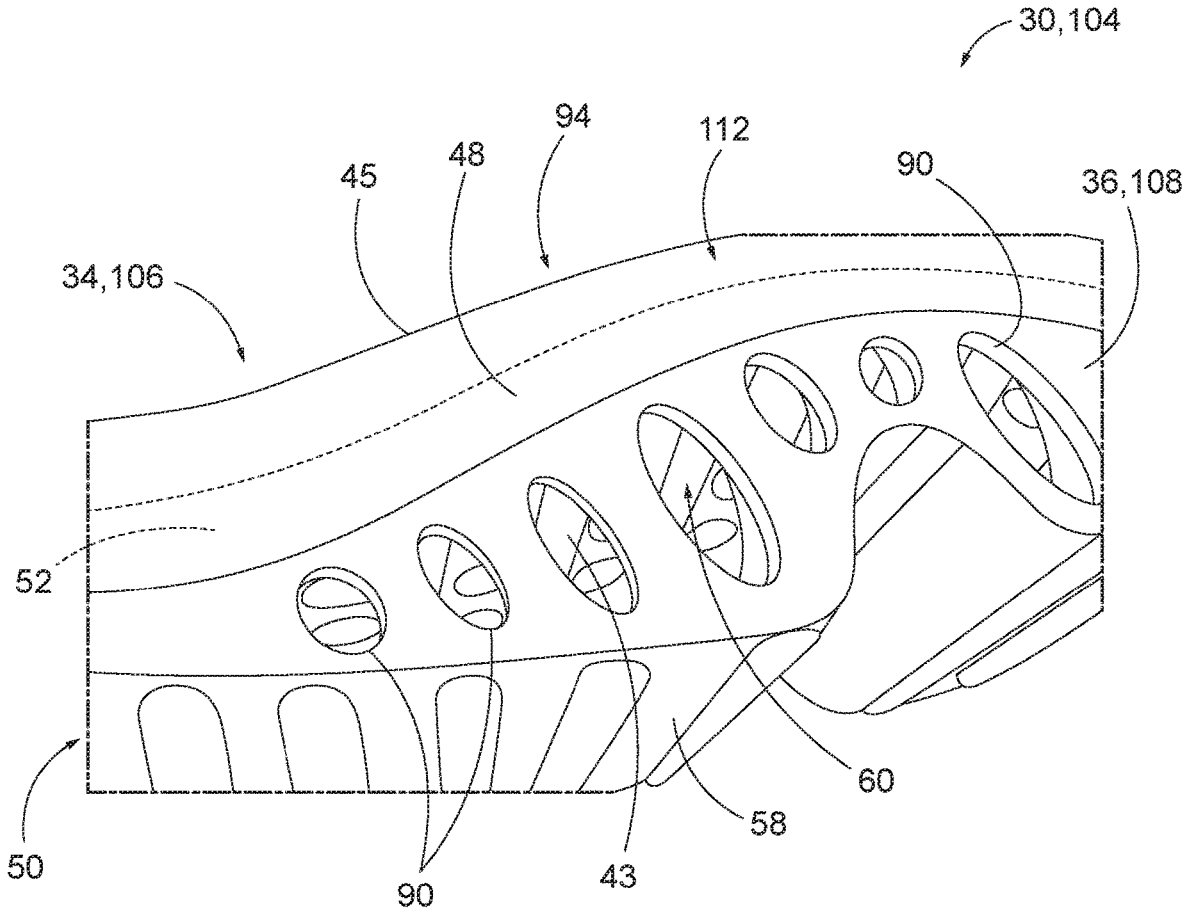
FIG. 6 is a perspective view of a portion of the sole assembly shown in FIG. 5, viewed from the bottom side.

Turning now to some specific examples, FIGS. 5-6 illustrate another example of sole assembly 30, in the form of sole assembly 104, having a footbed membrane 106 (which is an example of footbed membrane 34), and a frame 108 (which is an example of frame 36). Frame 108 includes rocker bottom 50 and annular frame wall 52 extending around the frame perimeter of rocker bottom 50, with frame cavity 60 being defined by an inner wall of annular frame wall 52 and an upper frame side of rocker bottom 50. Frame cavity 60 is best viewed in FIG. 6, which shows an angle looking into frame cavity 60 (through wall holes 90 formed in annular frame wall 52), viewed from the bottom of sole assembly 104 (e.g., from lower frame side 58 of rocker bottom 50). Frame cavity 60 is positioned between lower membrane surface 43 of footbed membrane 106 and rocker bottom 50 when sole assembly 104 is assembled, as shown in FIGS. 5-6.

In the example of FIGS. 5-6 (though as best seen in FIG. 5), footbed membrane 106 includes a plurality of membrane apertures 110 extending from upper membrane surface 42 to lower membrane surface 43 (e.g., all the way through footbed membrane 106). In other examples of footbed membrane 34, membrane apertures 110 may extend through only a portion of footbed membrane 34. Membrane apertures 110 may be spaced apart from one another. In some examples, membrane apertures 110 may be arranged in rows extending from a medial region 112 of footbed membrane 106 to a lateral region 114 of footbed membrane 106. Membrane apertures 110 may be arranged in any pattern on footbed membrane 34, or may be arranged randomly. In some examples, membrane apertures 110 may be of a substantially uniform size, while in other examples, some of membrane apertures 110 may be of a different size and/or shape than other of membrane apertures 110. In some examples, membrane apertures 110 may be formed within all regions of footbed membrane 34 (as is the case with respect to footbed membrane 106), such as within heel region 96 of footbed membrane 34, within midfoot region 94 of footbed membrane 34, and within forefoot region 92 of footbed membrane 34, as shown in FIG. 5. In other examples, footbed membrane 34 may include membrane apertures 110 in only one or two of these regions 92, 94, 96. In other words, in various examples of footbed membrane 34 including a plurality of membrane apertures 110, a first subset of the plurality of membrane apertures 110 may be formed in forefoot region 92 of footbed membrane 34, a second subset of the plurality of membrane apertures 110 may be formed in midfoot region 94 of footbed membrane 34, and/or a third subset of the plurality of membrane apertures 110 may be formed in heel region 96 of footbed membrane 34.

Membrane apertures 110 may be configured to increase air flow into frame cavity 60 (e.g., under footbed membrane 34) and/or air flow from frame cavity 60 into an interior cavity of the article of footwear (e.g., between footbed membrane 34 and an upper of the article of footwear in which footbed membrane 34 is incorporated). In some examples, membrane apertures 110 may advantageously increase dryness for a wearer's foot supported by footbed membrane 34. Additionally or alternatively, such airflow into or out of frame cavity 60 may advantageously reduce the amount of moisture absorbed by the article of footwear containing sole assembly 30, thereby potentially reducing the risk of infection-causing microbes to build up within the article of footwear. Membrane apertures 110 may be strategically placed, such as by not being placed in areas of footbed membrane 34 providing the most support to the wearer's foot (e.g., in the arch area), and/or by being placed in areas where it is desired to provide more cushioning, such as in the forefoot area. Additionally or alternatively, membrane apertures 110 may be strategically placed for moisture drainage, to limit the amount of moisture near the wearer's foot, and/or to prevent moisture from being absorbed by the article of footwear in which footbed membrane 34 is incorporated. Additionally or alternatively, membrane apertures 110 may be placed and oriented such that they are configured to increase air flow and ventilation throughout the frame and/or article of footwear.

FIG. 7 illustrates another example of sole assembly 30, in the form of sole assembly 116, viewed from the side, and positioned on a ground surface 118 on which a wearer of an article of footwear incorporating sole assembly 116 may be standing or striding. Sole assembly 116 includes a footbed membrane 120 (which is an example of footbed membrane 34) and a frame 122 (which is an example of frame 36), as well as an outsole 124 (which is an example of outsole 38). Lower wall 48 of footbed membrane 120 is engaged with annular frame wall 52 of frame 122, thereby obscuring upper portion 73 of annular frame wall 52. In other words, the outer surface of upper portion 73 (which corresponds to a portion of outer wall side 64, as shown in FIGS. 2 and 4) of annular frame wall 52 is engaged with the inner surface of lower wall 48 (e.g., inner surface 102 best seen in FIGS. 4 and 4*c*). An upper outsole side 123 of outsole 124 is secured to lower frame side 58 of frame 122 by any suitable means, and a portion of a lower, or outer, outsole side 125 of outsole 124 is in contact with and supported by ground surface 118. In the example shown in FIG. 7, frame 122 includes three wall holes 90 formed in medial arch region 74 of annular frame wall 52.

Sole assembly 116 is illustrated in a static condition, with a midfoot region 126 of outsole 124 contacting ground surface 118. Midfoot region 126 of outsole 124 corresponds to midfoot region 88 of frame 122 and midfoot region 94 of footbed membrane 120. Frame 122 may be configured to substantially and effectively control the shape and contours of footbed membrane 120 and outsole 124, as both footbed membrane 120 and outsole 124 generally are flexible to conform to rigid frame 122. Thus, as both forefoot region 86 and heel region 84 of frame 122 "ramp up," or curve away, from ground surface 118, outsole 124 follows these contours, and thus both a forefoot region 128 of outsole 124 (corresponding to forefoot region 86 of frame 122) and a heel region 130 of outsole 124 curve away from ground surface 118 and do not contact ground surface 118 in this static position. This curvature of rocker bottom 50 of frame 122 creates a heel gap 132 between ground surface 118 and outsole 124 corresponding to heel region 84 of frame 122, and further creates a forefoot gap 134 between ground surface 118 and outsole 124 corresponding to forefoot region 86 of frame 122.

Figure 8:
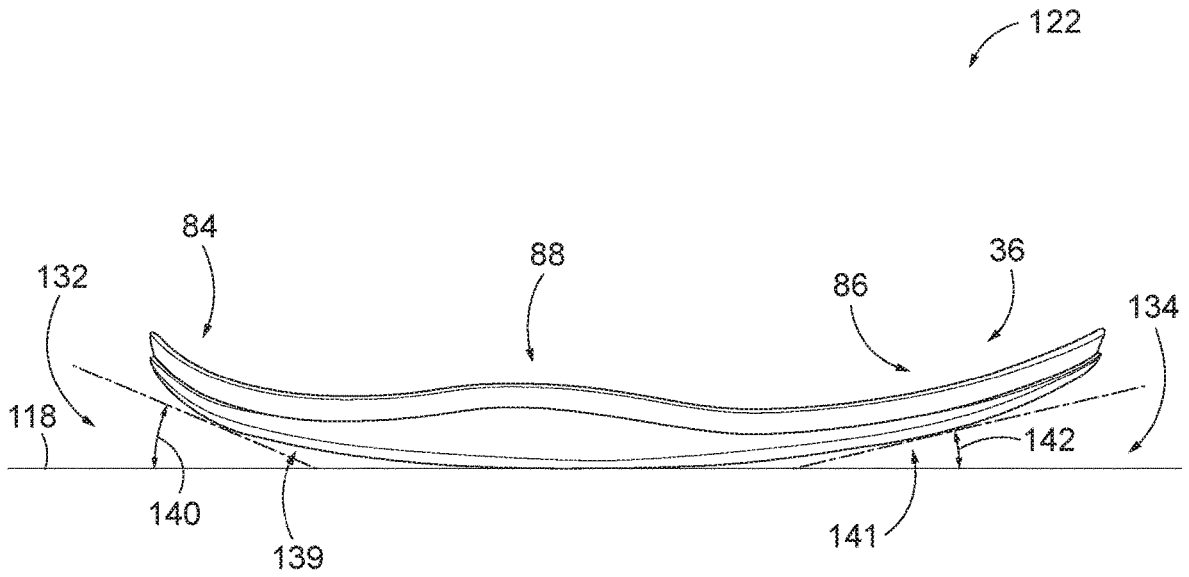
FIG. 8 is a schematic representation of examples of a frame for an article of footwear according to the present disclosure.

Such gaps 132, 134 may be described in terms of the angles formed between ground surface 118 and sole assembly 116. For example, FIG. 8 schematically illustrates frame 122 (without footbed membrane 120) positioned on ground surface 118. As shown in FIG. 8, heel gap 132 may be defined by a heel angle 140 defined as a maximum angle formed between heel region 84 and ground surface 118 when frame 122 is at rest on ground surface 118. In some examples, heel angle 140 is at least 5 degrees, at least 10 degrees, at least 15 degrees, at least 20 degrees, at least 25 degrees, at least 30 degrees, at least 35 degrees, at least 40 degrees, and/or at least 45 degrees. In a specific example, heel angle 140 may curve up at a substantially constant gradient to a point about three quarters of the way along the wearer's heel towards the midfoot region. Similarly, forefoot gap 134 may be defined by a forefoot angle 142 defined as a maximum angle formed between forefoot region 86 and ground surface 118 when frame 122 is at rest on ground surface 118. In some examples, forefoot angle 142 is at least 5 degrees, at least 10 degrees, at least 15 degrees, at least 20 degrees, at least 25 degrees, at least 30 degrees, at least 35 degrees, at least 40 degrees, and/or at least 45 degrees. In a specific example, forefoot angle 142 may be around 20 degrees under the wearer's metatarsal heads, and may increase to as much as around 40 degrees under the wearer's metatarsophalangeal joint.

Heel angle 140 and/or forefoot angle 142 may be variable (e.g., non-linear, or non-constant) along heel region 84 and forefoot region 86, respectively. Heel angle 140 and/or forefoot angle 142 may be the maximum angles formed between ground surface 118 and lines tangent to heel region 84 and forefoot region 86, such as in the case of footwear 32 having a curved heel region 84 and/or a curved forefoot region 86 (e.g., examples of which are illustrated in FIGS. 7-8). In some examples, heel angle 140 and/or forefoot angle 142 take on organic shapes.

Heel angle 140 may be configured to prevent heel slip, in some examples. For example, frame 36 may be geometrically configured to conform to the wearer's heel, especially in the later phases of the gait cycle. Heel angle 140 may be sufficient to cause the heel region to rise along with the wearer's foot, as the article of footwear rolls forward. To facilitate such movement, heel angle 140 may extend farther towards the midfoot than would be expected by one of ordinary skill in the art. For example, heel angle 140 may extend to the distal portion of the wearer's calcaneus.

In some examples, heel angle 140 is greater than forefoot angle 142. In other examples, heel angle 140 may be substantially equal to forefoot angle 142, or forefoot angle 142 may be greater than heel angle 140. Heel angle 140 and forefoot angle 142 may be configured to create a rocking motion (e.g., may function as a see-saw, or lever) as a wearer progresses through the gait cycle, rocking back from a heel ramp 139 to a midfoot ramp 141. In some examples, heel angle 140 may effectively rapidly unload the wearer's heel during the initial phase of the gait cycle. The transition between heel region 84 and midfoot region 88 of rocker bottom 50 (corresponding to heel angle 140) may form heel ramp 139 (which may also be referred to as a "rise") that is configured to support an anterior, or front, anatomical aspect of the wearer's heel that curves abruptly up in some cases. In some examples, heel ramp 139 is positioned just forward (anterior) of the wearer's heel, and may rise in both the longitudinal and transverse planes such that it may be configured to support internal fascia and soft tissues of the wearer's foot, with an aim to support these internal structures and reduce injuries. Similarly, the transition between midfoot region 88 and forefoot region 86 or rocker bottom 50 (corresponding to forefoot angle 142) may form midfoot ramp 141 that is configured to support the wearer's metatarsals and forefoot. Midfoot ramp 131 and heel ramp 139 may be 'dynamic' ramps, in the sense that they may naturally support and facilitate motion of the wearer's foot through the gait cycle. For example, midfoot ramp 141 may propel the wearer forward as the metatarsals rock over midfoot ramp 141.

Returning to FIG. 7, the curved, or angled, nature of forefoot region 86 of frame 122, combined with the rigid nature of frame 122, allows rocker bottom 50 of frame 122 to "rock," or roll along lower frame side 58 as the wearer strides, which negates any need for a flexible forefoot, in some examples. In other words, rocker bottom 50 may be configured to facilitate continuity in movement of the wearer's foot during the gait cycle. Heel ramp 139 and midfoot ramp 141, in conjunction with other features of frame 122 and footbed membrane 120, may be configured to off-load pressure from the wearer's heel, shorten the time of the load on the wearer's heel and metatarsal heads, cushion the wearer's foot, provide support to all arches of the wearer's foot, and/or propel the wearer's foot forward. An apex 137 of midfoot ramp 141 of rocker bottom 50 may be positioned just posterior to the metatarsal heads of the wearer's foot, so as to create substantially unimpeded forward movement of rocker bottom 50 and unload pressure from the metatarsal heads. In some examples, apex 137 may function as the initiator of the last phase of the gait cycle (i.e., toe off). Frames 36 that are configured for this "rocking" motion (e.g., frame 122) may be medically useful, such as for wearers with fused metatarsals or joints, who sometimes lose some or all flexibility in their forefoot. In some examples, frame 36 may be useful for aiding in recovery and/or protection for wearers suffering from foot pain or injuries. In some examples, frame 36 may be incorporated into a "surgical boot" for pathological foot conditions, such as plantar fasciitis.

Due to the rigid or semi-rigid nature of frame 122 (and frames 36, generally) and the flexible nature of footbed membrane 120 (and footbed membranes 34, generally), the topography of footbed membrane 120 is largely controlled by frame 122. For example, medial arch region 78 of footbed membrane 120 rises, corresponding to medial arch region 74 of frame 122 similarly rising. In other words, medial arch region 78 of footbed membrane 120 curves upward (e.g., away from ground surface 118) from heel region 96 of footbed membrane 120 and from forefoot region 92 of footbed membrane 120. It may be said that medial arch region 74 of frame 122 "pulls up" on medial arch region 78 of footbed membrane 120, which may be configured to support a wearer's foot by "pulling up" on the arch region of the wearer's foot. So arranged, presently disclosed footbed membranes 120 may advantageously reduce irritation to soft tissues of the wearer's foot as compared to conventional arch support structures. In some examples, footbed membranes 120 may provide support to a wearer's foot for a longer period of time than typical compression arch supports may be able to provide before losing effectiveness.

Sole assembly 30 may be configured such that frame 36 and footbed membrane 34 work together (e.g., are interactive) to support a wearer's foot during the gait cycle, which will now be described in the context of a wearer progressing in a forward direction over ground surface 118, with respect to the example of frame 122 and footbed membrane 120. In the typical gait cycle, it is assumed that heel region 84 of rocker bottom 50 (via associated heel region 130 of outsole 124) impacts (e.g., contacts via the intermediary outsole 124) ground surface 118 first, followed by midfoot region 88 of rocker bottom 50 (via associated midfoot region 126 of outsole 124) impacting ground surface 118 during the mid-stance phase of the gait cycle, and finally forefoot region 86 of rocker bottom 50 (via forefoot region 128 of outsole 124) impacts ground surface 118 during the toe-off phase of the gait cycle. During the gait cycle, as heel region 84 of rocker bottom 50 impacts ground surface 118, the wearer's heel (e.g., heel region 12 of foot 10 of FIG. 1) loads, or depresses, footbed membrane 120, which supports and/or cushions the wearer's heel region during impact, while frame 122 may be configured to provide stability. A rising contour 136 formed as rocker bottom 50 transitions from heel region 84 to midfoot region 88, in combination with a corresponding contour resulting in footbed membrane 120, may be configured to pull the arches of the wearer's foot (e.g., anterior transverse arch 22, lateral longitudinal arch 24, and/or medial longitudinal arch 26 shown in FIG. 1) into position via engagement between the wearer's foot and footbed membrane 120. Footbed membrane 120 may be resistant to compression set, thereby preventing and/or resisting permanent deformation over time due to compressive forces applied to it by the wearer's foot.

As described herein, footbed membrane 120 may be configured to conform to the wearer's foot to provide support throughout the gait cycle. In some examples, frame 122 may have a longer and/or higher medial arch region 74 than in a typical shoe. For example, the medial arch region of frame 122 may be at least 5% longer, at least 10% longer, at least 15% longer, and/or at least 20% longer than in a typical shoe. Additionally or alternatively, the medial arch region of frame 122 may be at least 5% higher, at least 10% higher, at least 15% higher, at least 20% higher, at least 25% higher, at least 30% higher, and/or at least 35% higher than in a typical shoe. Such frames 122 may be used to treat and/or prevent foot pathology, such as plantar fasciitis, such as by rising closer to heel region 84 than is typical and/or rising higher in medial arch region 74 such as to support the wearer's plantar soft tissue. For example, frame 122 may rise just proximal to heel region 84 in a longitudinal direction and/or just proximal to heel region 84 in a medial direction (e.g., under the wearer's navicular).

As the wearer's foot "rolls over" midfoot region 88 of rocker bottom 50 (e.g., medial arch regions 74, 78 of frame 122 and footbed membrane 120, respectively), midfoot region 88 "activates" to support the wearer's foot and may provide biomechanical efficiency. Footbed membrane 120 is configured to store potential energy during the mid-stance phase of the gait cycle, in some examples, such as by stretching or elongating in response to loading by the wearer's foot. A falling contour 138 formed as rocker bottom 50 transitions from midfoot region 88 to forefoot region 86, in combination with a corresponding contour resulting in footbed membrane 120 may be configured to release such stored energy as the wearer progresses through the gait cycle. Such release of the stored energy from footbed membrane 120 may, in some examples, help to propel the wearer forward. The curved nature of forefoot region 86 of rocker bottom 50 may be configured to support the wearer's toes and forefoot region (e.g., forefoot region 16 in FIG. 1) during the toe-off phase of the gait cycle. Such support may reduce the incidence of injuries or pain in the wearer's forefoot, as compared to conventional footwear. For example, presently disclosed sole assemblies 30 may be configured to reduce the incidence of sesamoiditis, neuromas of the forefoot, migration of the natural fat pad under the foot, inflammation, and/or bruising of the wearer's toes.

Figure 9:
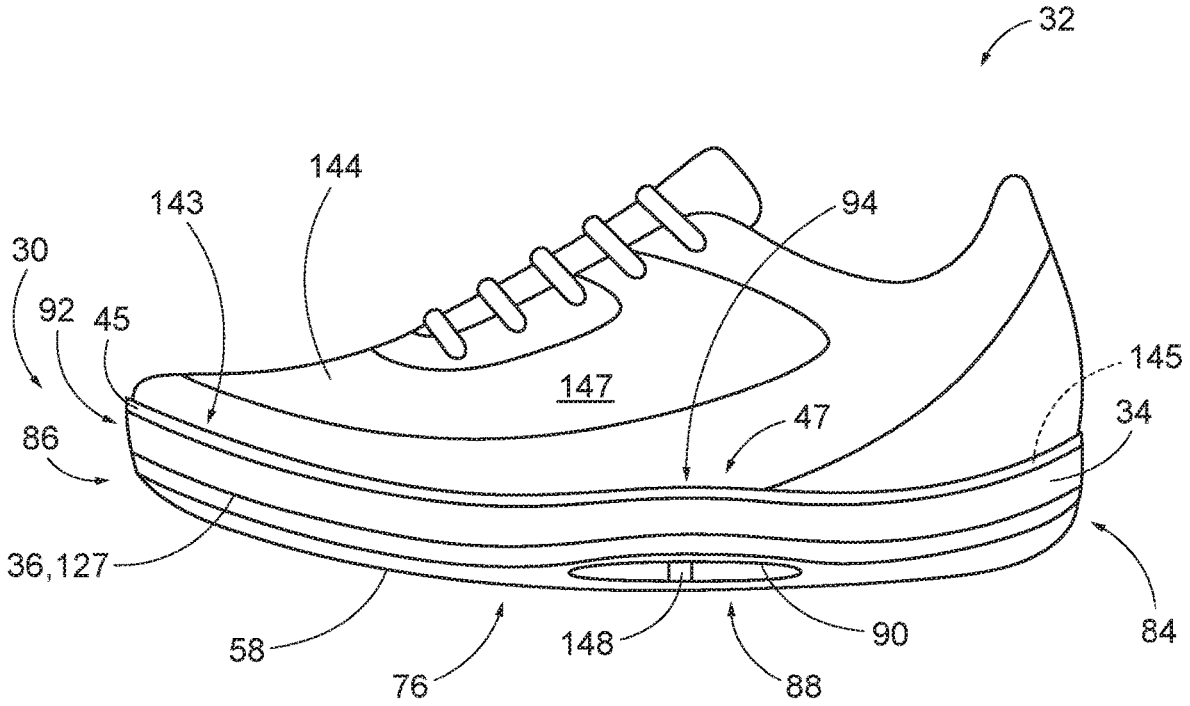
FIG. 9 illustrates a side elevation view of one example of an article of footwear according to the present disclosure.
Figure 10:
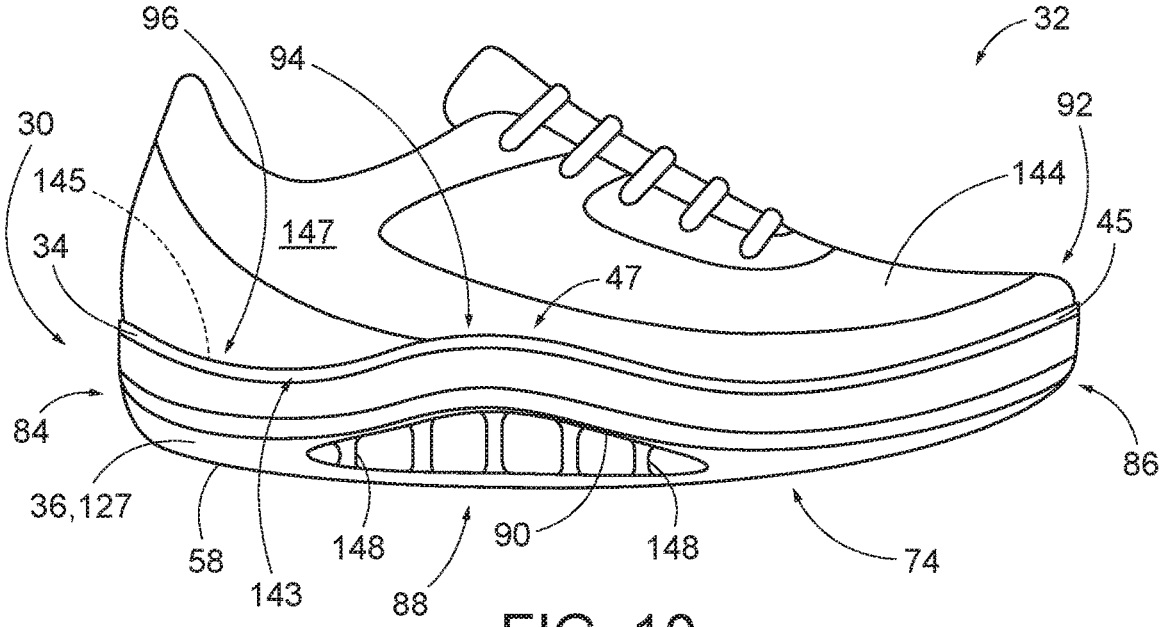
FIG. 10 illustrates a side elevation view of another example of an article of footwear according to the present disclosure.
Figure 11:
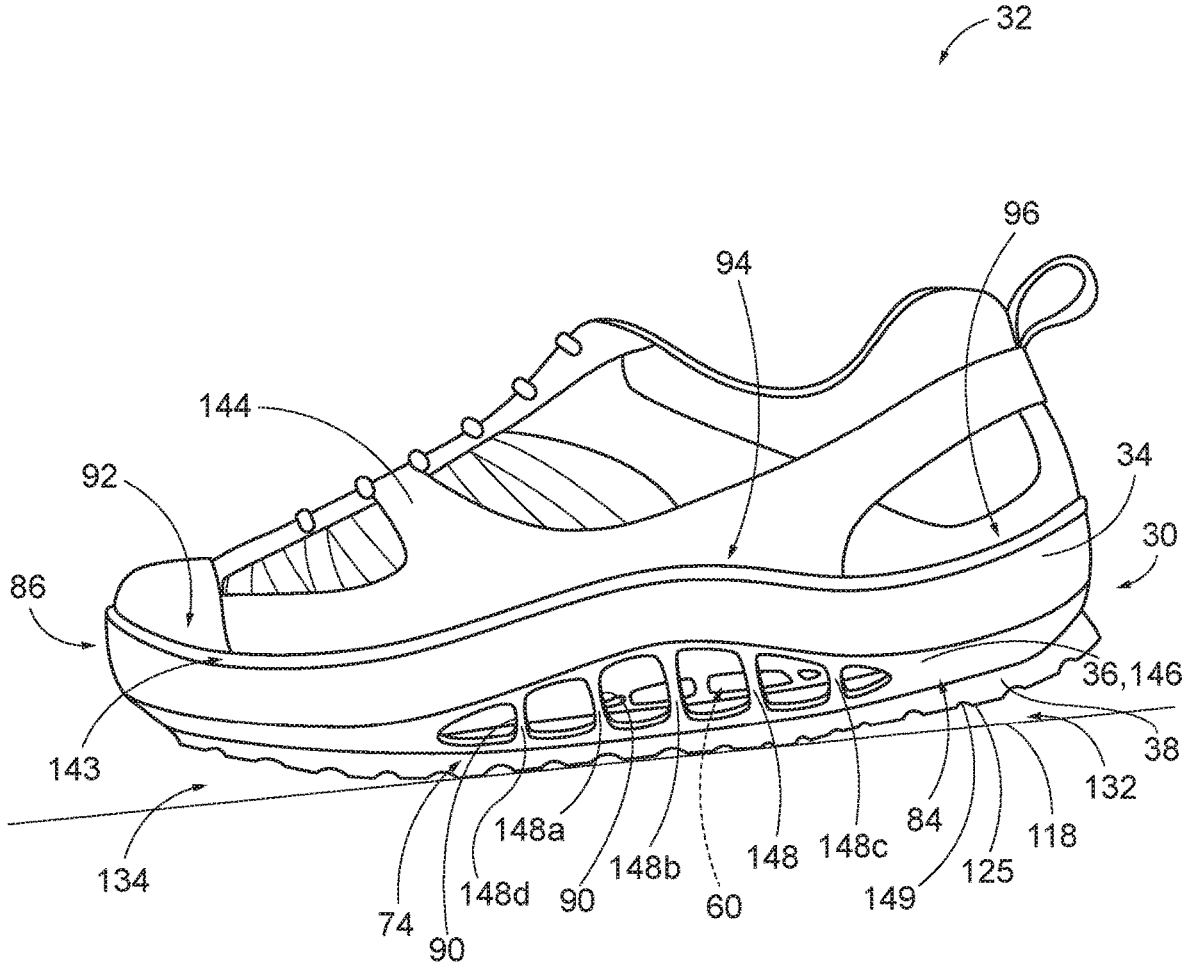
FIG. 11 is a side elevation view of one example of an article of footwear according to the present disclosure.

FIGS. 9-11 illustrate examples of articles of footwear 32 that incorporate sole assembly 30 (e.g., footbed membrane 34, frame 36, and/or outsole 38) according to the present disclosure. As illustrated, footbed membrane 34 is positioned above frame 36, with an upper 144 positioned above footbed membrane 34. In some examples, sole assembly 30 may include one or more additional layers, such as an insole positioned above footbed membrane 34, within upper 144. As used herein, the terms "upper," "above," "top," "lower," "bottom," and similar terms as used to describe spatial relationships between components of footwear and/or between a component of footwear and a ground, surface, or other object, are considered from the perspective of footwear positioned in an upright orientation on a level ground surface. Accordingly, an upper surface, or upper side, (e.g., upper outsole side 123 of outsole 38) refers to a surface or a side of a component that generally faces away from the ground surface, while a lower surface, or lower side, (e.g., lower outsole side 125 of outsole 38) refers to a surface or side that generally faces toward the ground surface.

Upper 144 is secured to sole assembly 30 around membrane perimeter 47 of footbed membrane 34 in some examples. For example, upper 144 may engage and/or extend around forefoot regions 86, 92, midfoot regions 88, 94, and/or heel regions 84, 96 of frame 36 and footbed membrane 34, respectively, thereby enclosing, the heel region, midfoot region, and/or forefoot region of the wearer's foot. Thus, upper 144 and sole assembly 30 may be described as defining a footwear cavity, or foot compartment, into which a wearer's foot is inserted and supported when the article of footwear is donned and worn. In other words, upper 144 is configured to engage with a wearer's foot when article of footwear 32 is worn by the wearer. As discussed herein, components of footwear 32 may be described in terms of relative positions with respect to the wearer's foot upon which the article of footwear is worn.

References herein to the wearer's foot contacting or being contacted by portions of sole assembly 30 and/or upper 144 do not require direct physical contact, as a wearer often will include a sock. Alternatively, references herein to the wearer's foot additionally or alternatively may refer to the wearer's foot and any sock, stocking, athletic wrap, or other layer that extends around the wearer's foot prior to insertion of the wearer's foot into the footwear's foot compartment.

Upper 144 may be described as including and/or being a shell of the footwear, and in the case of footwear in the form of boots, also may be described as including a shaft that extends along the wearer's leg, such as above an Achilles region of the wearer's leg. It is within the scope of the present disclosure that upper 144 may include, or alternatively be free from, one or more adjustable mechanical fasteners to selectively constrain or otherwise reduce the size of the footwear's upper. Examples of such mechanical fasteners include laces, snaps, buckles, and hook-and-loop fasteners. Footwear 32 according to the present disclosure may include shoes and boots, such as dress shoes, high heels, casual shoes, athletic footwear, work boots, hiking boots, military footwear, construction industry footwear, dance shoes (e.g., ballet pointe shoes), recreational shoes, clogs, sandals, lightweight boots, and/or outdoor boots/ shoes. In some examples, suspension may be provided in only a portion of the footwear, as opposed to suspending the entire foot. For example, high-heeled shoes according to the present disclosure may include suspension in just the forefoot, or in just the forefoot and heel regions of the shoe. Suitable materials for upper 144 include materials such as leather, canvas, microfiber, woven fabrics, and the like.

To secure upper 144 to sole assembly 30, sew wall 45 may be configured to be attached to upper 144 of the article of footwear and allow for flexion of upper 144 at an interface where upper 144 is attached to sew wall 45. Upper 144 may be coupled to sole assembly 30 such that upper 144 is configured to limit elongation of footbed membrane 34. For example, upper 144 may be formed from fibers or materials with little to no elongation (e.g., non-elastic materials or materials with less elasticity than footbed membrane 34). Additionally or alternatively, at least a portion of upper 144 may extend under footbed membrane 34 (e.g., adjacent lower membrane surface 43), which may serve to limit elongation of footbed membrane 34 and/or help prevent bottoming out of footbed membrane 34. Upper 144 is generally sewn to footbed membrane 34 by sewing upper 144 to sew wall 45 of footbed membrane 34. In other words, sew wall 45 is configured to have a height sufficient for secure attachment to upper 144, and is formed of a material that resists tearing when sewn through, and yet is not too thick or stiff to be sewn through. Upper 144 may be sewn to sew wall 45 via a standard shoe sewing machine, a specialized sewing machine configured for sewing through multiple layers, and/or a robotic sewing machine. In some examples, upper 144 is not cemented or adhered to footbed membrane 34, but is only secured to footbed membrane 34 via sewing to sew wall 45. In other examples, upper 144 may be cemented or adhered to footbed membrane 34 in addition to or instead of sewing upper 144 to sew wall 45. Sew wall 45 is generally configured to allow for flexion of upper 144 at an interface 143 where upper 144 is attached to sew wall 45 of footbed membrane 34, which may be at least partly due to the flexibility of sew wall 45. Attachment of upper 144 to sew wall 45 may be configured to further limit elongation of footbed membrane 34, due to attachment to upper 144.

In some examples, article of footwear 32 includes an annular ring 145, which may be positioned around an outer upper surface 147 of upper 144, and/or may be positioned between sew wall 45 of footbed membrane 34 and upper 144. Annular ring 145 may be configured to enhance attachment of upper 144 to sole assembly 30, footbed membrane 34, and/or frame 36. For example, annular ring 145 may be cemented or adhered to article of footwear 32, such as to upper 144. In some examples, annular ring 145 may be positioned around the perimeter of upper 144 after footbed membrane 34 is secured to frame 36. One or more of the disclosed attachment methods for securing upper 144 to sole assembly 30 may be employed in given examples of disclosed articles of footwear 32.

While FIGS. 9-10 are not illustrated with an outsole 38 (and said outsoles 38 are optional to examples of sole assemblies 30 and articles of footwear 32 described herein), it is to be understood that any suitable outsole, including outsoles 38 disclosed herein, generally may be included in such articles of footwear 32, such as by securing (e.g., cementing or bonding) the outsole to lower frame side 58 of frame 36. Articles of footwear 32 are typically configured such that outsole 38 (e.g., lower outsole side 125 of outsole 38) engages the ground surface or other surface on which the wearer is standing, striding, walking, running, jumping, or otherwise wearing article of footwear 32.

FIG. 9 illustrates an example of article of footwear 32 with lateral arch region 76 of a frame 127 (which is an example of frame 36) visible, while FIG. 10 illustrates the same article of footwear 32 with medial arch region 74 of frame 127 visible. As evident from comparing FIG. 9 and FIG. 10, medial arch region 74 may have a greater rise (e.g., may be higher) than lateral arch region 76, with respect to surrounding areas of frame 127 (e.g., forefoot region 86 and heel region 84 of frame 127). Frame 127 includes a plurality of support pillars 148 extending across wall holes 90 formed in frame 127. For example, lateral arch region 76 of frame 127 (FIG. 9) includes a single wall hole 90 having a single support pillar 148 extending across the wall hole. Medial arch region 74 of frame 127 (FIG. 10) includes five support pillars 148 extending across a respective wall hole 90. In other examples, more or fewer wall holes 90 may be included on the lateral and/or medial sides of frame 127, and/or more or fewer support pillars 148 may be positioned to extend across a given wall hole 90. In some examples, and as indicated in FIGS. 9-10, a respective wall hole 90 positioned within medial arch region 74 may include a greater number of support pillars 148 than does a respective wall hole 90 positioned within lateral arch region 76. In some examples, frame 127 may include one or more respective wall holes 90 without any support pillars 148 extending across it. Additionally or alternatively, frame 127 may include one or more respective wall holes 90 with support pillars 148 arranged differently than shown. For example, support pillars 148 are illustrated as being substantially vertical (e.g., substantially normal to the ground surface when article of footwear 32 is at rest in a static condition on the ground surface), though support pillars 148 additionally or alternatively may be oriented at different angles within the scope of the present disclosure.

FIG. 11 illustrates an example of an article of footwear 32, with sole assembly 30 incorporated into the shoe (e.g., with upper 144 secured to sole assembly 30). Article of footwear 32 in FIG. 11 includes outsole 38 with a distinct tread structure 149, such as including a non-smooth surface, and in some examples including tread projections, tread channels and/or cavities, and the like. In other examples, lower outsole side 125 of outsole 38 may be substantially smooth, or have areas including tread structure 149 and areas of smoothness. Examples of suitable materials for construction of lower outsole side 125 of outsole 38, including tread structure 149, of article of footwear 32 according to the present disclosure include (but are not limited to) one or more of polymers, elastomers, polyurethanes, leathers, synthetic rubbers, and such injection-moldable polymers as thermo polyurethanes, thermo poly rubbers, and thermo rubbers.

The article of footwear 32 shown in FIG. 11 includes an example of frame 36 in the form of frame 146. Frame 146 includes a plurality of support pillars 148 (e.g., support pillars 148*a*, 148*b*, 148*c*, 148*d*) positioned within medial arch region 74. Adjacent respective support pillars 148 may be spaced apart from each other, positioned on either side of respective wall holes 90 that open into frame cavity 60. Different respective support pillars 148 may have different heights, shape, and/or widths than other respective support pillars 148. For example, centrally located support pillars 148*a* and 148*b* may have a greater height than support pillar 148*c* positioned closest to heel region 84 of frame 146 and/or may have a greater height than support pillar 148*d* positioned closest to forefoot region 86 of frame 146. The different heights of respective support pillars 148 may correspond to changes in frame 146, such as the contours (e.g., convexity) of medial arch region 74. In other words, the heights of support pillars 148 may vary to match the variation in height of frame 146. While support pillars 148 are shown in medial arch region 74 and lateral arch region 76, in other examples, support pillars 148 may be positioned in additional or alternative locations with respect to frame 146. Support pillars 148 may be configured to provide structural integrity, or support, to frame 146. Support pillars 148 may be cemented, adhered, or otherwise coupled to frame 146, or may be formed integrally with frame 146.

Figure 37:
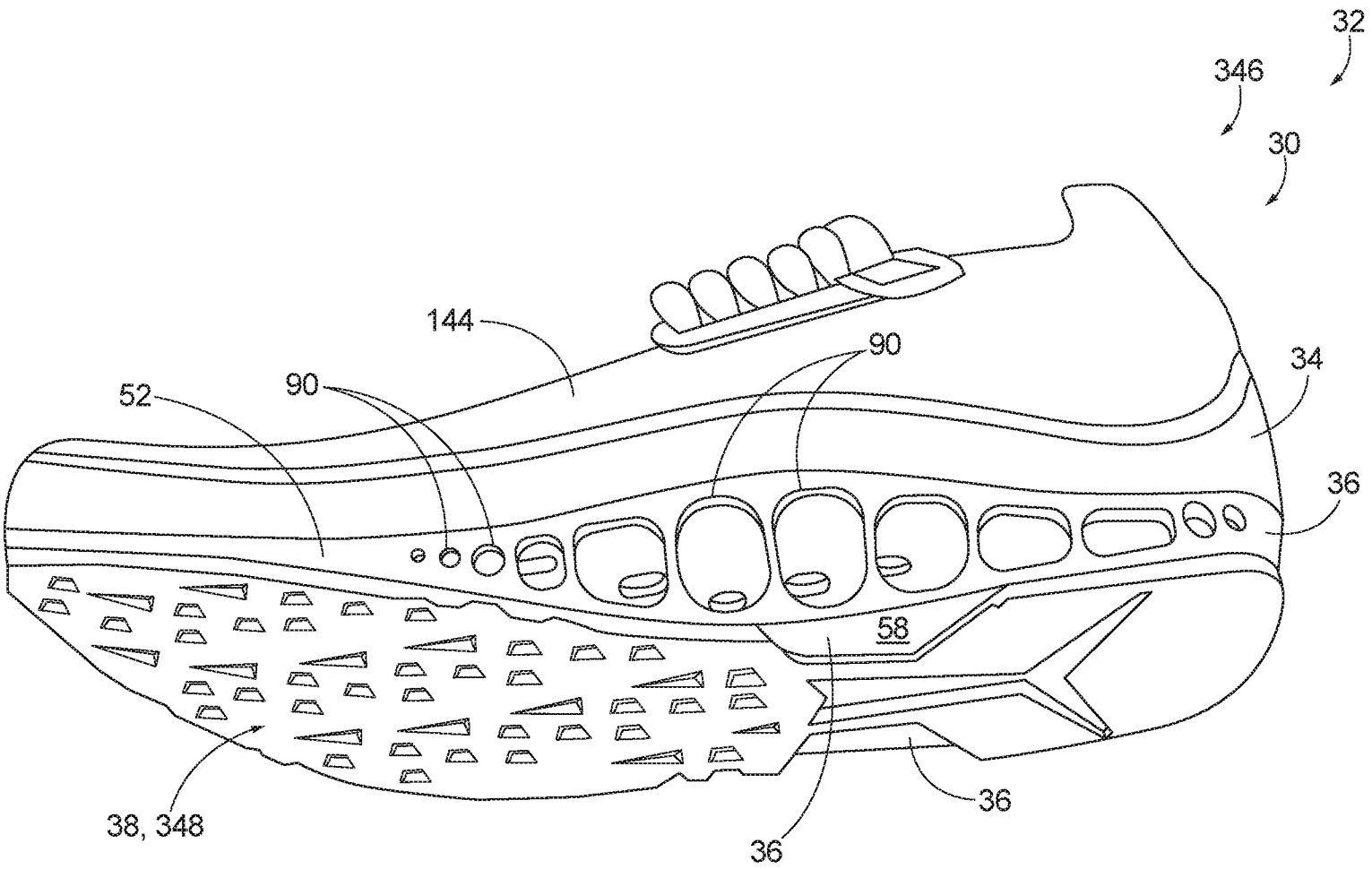
FIG. 37 illustrates an article of footwear according to the present disclosure.

FIG. 37 illustrates an article of footwear 346 (which is another example of article of footwear 32) that includes sole assembly 30 (e.g., frame 36 and footbed membrane 34). An outsole 348 (which is an example of outsole 38) is secured to frame 36. As shown in article of footwear 346, in some examples of article of footwear 32, outsole 38 (e.g., outsole 348) may be arranged such that the outsole covers only a portion of frame 36, thereby leaving a portion of lower frame side 58 exposed, as shown.

Figure 12:
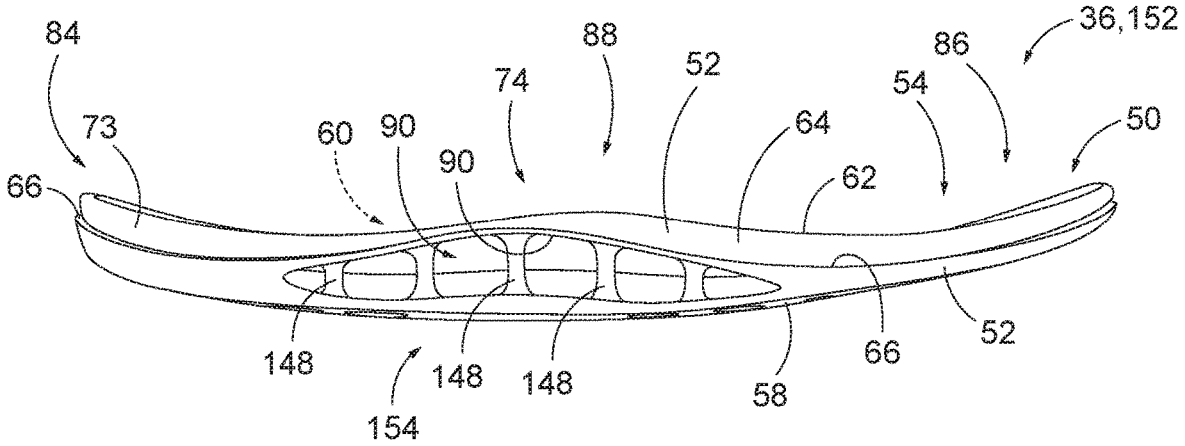
FIG. 12 is a side elevation view of one example of a frame for an article of footwear according to the present disclosure.
Figure 13:
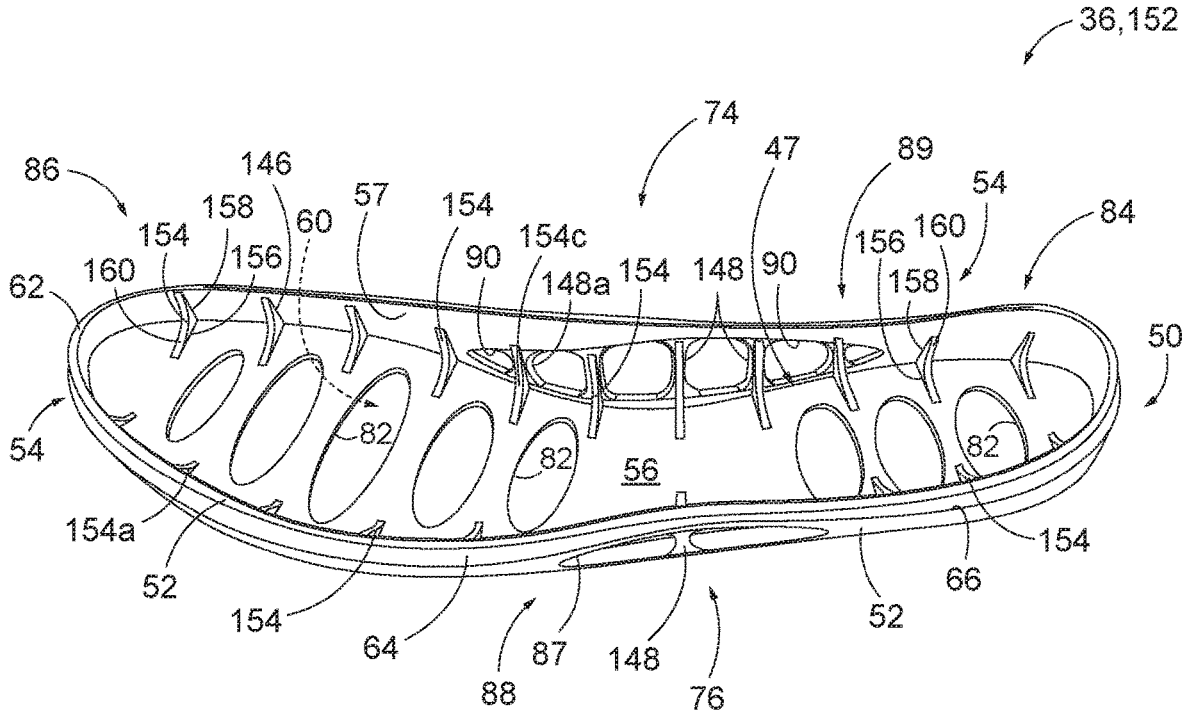
FIG. 13 is a top perspective view of the frame of FIG. 12.

FIGS. 12-13 illustrate a frame 152 (which is an example of frame 36) that may be used with various disclosed footbed membranes 34, viewed from the side (FIG. 12) and from a perspective view (FIG. 13). Frame 152 includes many similar features as previously described examples of frame 36, such as annular frame wall 52, lip 66, apertures 82 formed in rocker bottom 50, wall holes 90 formed in annular frame wall 52, and support pillars 148 extending across respective wall holes 90. For example, frame 152 includes five substantially oval-shaped apertures 82 of varying sizes positioned within forefoot region 86 and midfoot region 88 of rocker bottom 50, along with three substantially oval-shaped apertures 82 of substantially the same size positioned within heel region 84 of rocker bottom 50. Of course other distributions, positions, orientations, sizes, and/or shapes of apertures 82 are within the scope of the present disclosure.

As seen in FIGS. 12-13, examples of frame 36 (e.g., frame 152) may include support pillars 148 on both lateral portion 87 and medial portion 89 of the frame. In the example of frame 152, lateral portion 87 includes one support pillar 148 and medial portion 89 includes five support pillars 148, but of course other examples of frame 36 may include more or fewer support pillars 148 in lateral portion 87 and/or more or fewer support pillars in medial portion 89. In various examples of frame 36, support pillars 148 may be adjusted or optimized for desired performance. For example, the durometer of one or more respective support pillars 148 may be varied between different examples of frame 36 to create different aggregate properties in frame 36, such as for treatment of specific orthopedic issues and/or to enhance performance in specific activities. Additionally or alternatively, the height and/or other dimensions of one or more support pillars 148 may be adjusted (e.g., increased or decreased) to change the overall characteristics of frame 36. Additionally or alternatively, the stiffness or strength of one or more support pillars 148 may be increased or decreased to adjust the performance of frame 36. For example, a stiffer material may be cemented to, co-cured with, or otherwise coupled to one or more respective support pillars 148 to manipulate the flex or modulus of elasticity of that support pillar 148.

Frame 152 also includes a plurality of support braces 154 (viewable in FIG. 13). Support braces 154 are positioned within forefoot region 86, midfoot region 88, and heel region 84 of rocker bottom 50 in this example, but in other examples, support braces 154 may be positioned within just one or two of these regions. Similarly, support braces 154 are positioned along medial portion 89 and lateral portion 87 of frame 152, though in other examples support braces 154 may be positioned exclusively on one portion or the other, or may be positioned on one portion within one region and on the other portion within a different region. In some examples, one or more respective support braces 154 positioned on medial portion 89 may have a corresponding respective support brace 154 positioned on lateral portion 87 of rocker bottom 50. For example, support brace **154*a* is positioned on lateral portion 87, while corresponding support brace 154*b* is positioned essentially directly across from support brace 154*a* on medial portion 89. In some examples, respective support braces 154 may be staggered with respect to each other on opposite sides of rocker bottom 50 (e.g., the respective support braces 154 positioned on medial portion 89 may be staggered with respect to the respective support braces 154 positioned on lateral portion 87). In some examples, respective support braces 154 positioned across from each other may be connected across upper frame side 56 of rocker bottom 50. For example, a first brace surface 156 of support brace 154*a* may extend across upper frame side 56 to connect with (or may be integrally formed with) first brace surface 156 of support brace 154*b*. Support braces 154 may be cemented, adhered, or otherwise coupled to frame 152, or may be formed integrally with frame 152**.

Support braces 154 may be positioned adjacent upper frame side 56 of rocker bottom 50 and inner wall side 57 of annular frame wall 52 such that support braces 154 support annular frame wall 52 with respect to rocker bottom 50. For example, as shown in FIG. 13, support braces 154 may have first brace surface 156 coupled to upper frame side 56, and a second brace surface 158 coupled to inner wall side 57 (and/or coupled to a respective support pillar 148, as described below). A curved wall 160 may extend between first brace surface 156 and second brace surface 158 in some examples, thereby forming a substantially triangular support brace 154. Support braces 154 may also be referred to as perimeter buttresses, and may function as buttresses. In other examples, support braces 154 may be thicker, thinner, taller, longer, and/or have a different shape than shown in FIG. 13. In some examples, support braces 154 are configured to support annular frame wall 52 with respect to rocker bottom 50, such as to prevent buckling or bending of annular frame wall 52 when footbed membrane 34 is loaded by a wearer. Support braces 154 are spaced apart from each other and positioned around at least a portion of membrane perimeter 47 of upper frame side 56, in some examples, and in some examples are positioned around the entire membrane perimeter 47.

In examples including support pillars 148, one or more respective support braces 154 may be positioned to align with one or more respective support pillars 148. For example, in FIG. 13, each respective support pillar 148 is positioned in alignment with a respective support brace 154 (e.g., support pillar **148*a* is positioned with respect to support brace 154*c* such that the two are in alignment). For example, second brace surface 158 of those support braces 154 in alignment with a respective support pillar 148 may be coupled to the respective support pillar 148, in addition to or instead of being coupled to inner wall side 57 of annular frame wall 52. In other examples, just a portion of the support pillars 148 may include a respective support brace 154 positioned in alignment therewith. Additionally or alternatively, support braces 154 may be staggered with respect to support pillars 148** in some examples.

Figure 14:
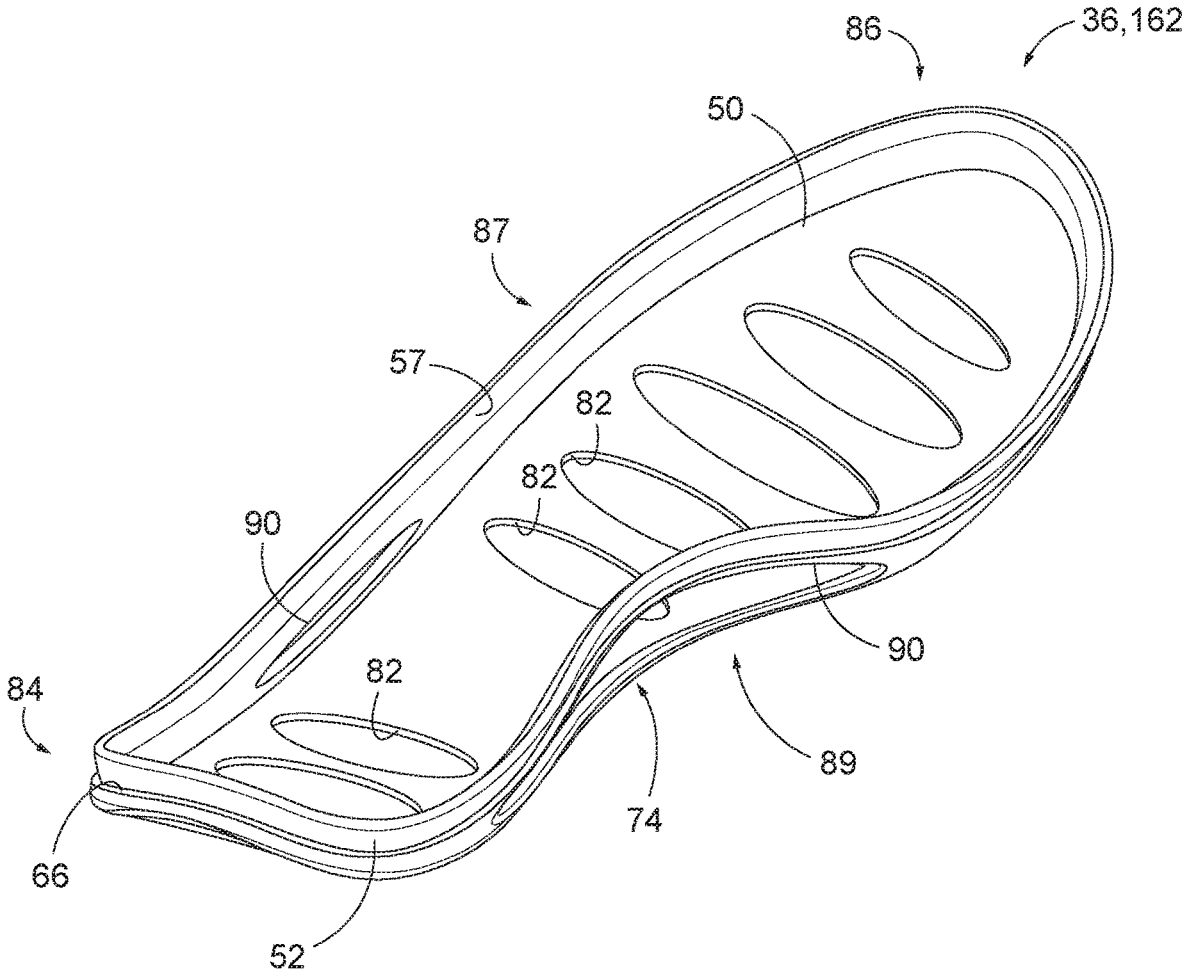
FIG. 14 is a perspective view of another example of a frame for an article of footwear according to the present disclosure.
Figure 15:
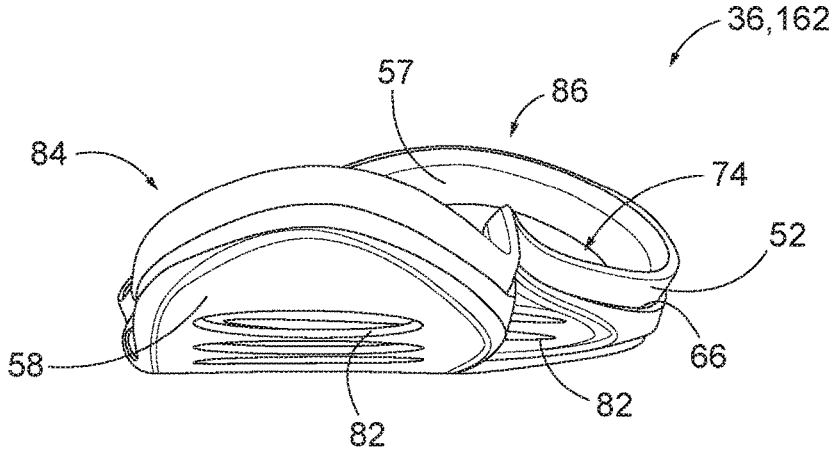
FIG. 15 is a different perspective view of the frame of FIG. 14, viewed from behind the frame.

FIGS. 14-15 illustrate a frame 162, which is another example of frame 36 that may be used with various disclosed footbed membranes 34, and is shown from a perspective view in FIG. 14, and viewed from the back in FIG. 15. Frame 162 includes a plurality of apertures 82 formed in forefoot region 86 and heel region 84 of rocker bottom 50. Frame 162 also includes a respective wall hole 90 formed in medial portion 89 of annular frame wall 52 (corresponding to medial arch region 74) and a respective wall hole 90 formed in lateral portion 87 of annular frame wall 52. The example of FIGS. 14-15 does not include support braces or support pillars, as shown, but the same may be included in variations of frame 162 without departing from the scope of the present disclosure. FIG. 15 shows frame 162 as if it were placed on a ground surface, and thus showing portions of lower frame side 58, indicating the locations where frame 162 would not contact the ground surface when placed thereupon and at rest (e.g., in a static condition). For example, heel region 84 curves up off the ground surface, as does forefoot region 86. In some examples, a portion of midfoot region 88 may also arch away from the ground surface.

Figure 29:
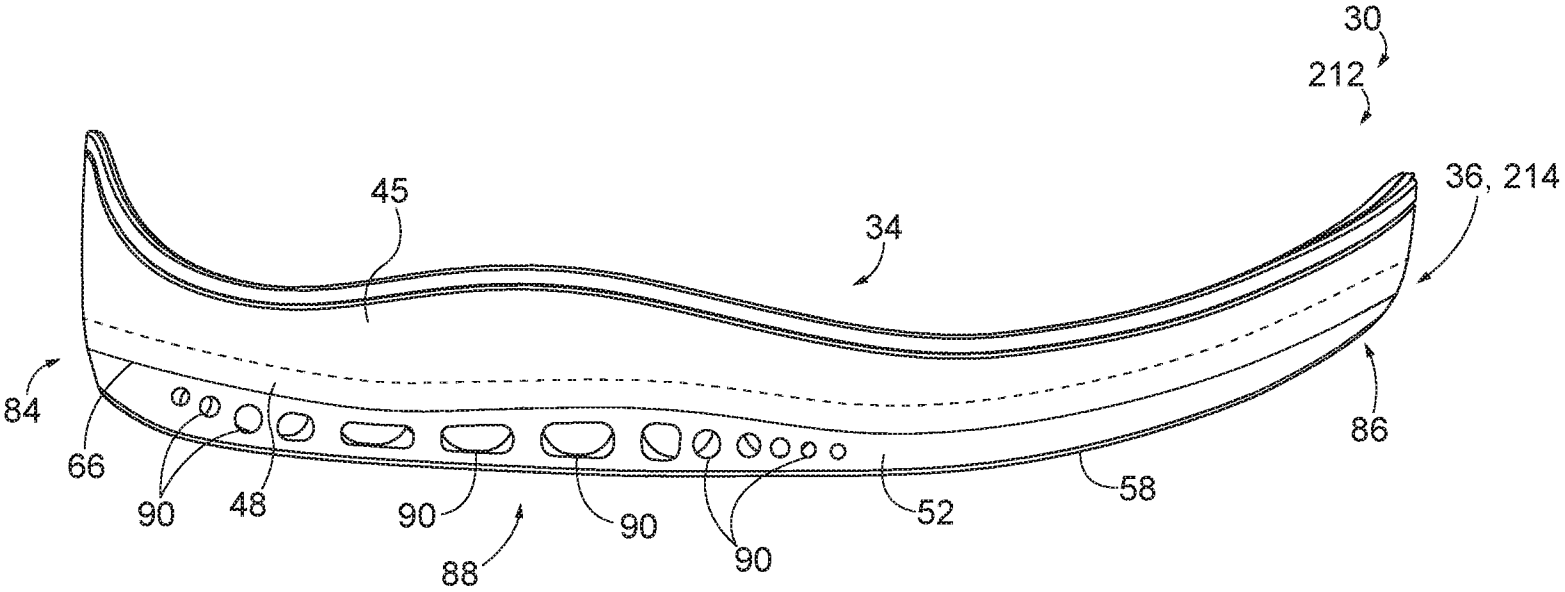
FIG. 29 is a side elevation view of another non-exclusive example of a sole assembly according to the present disclosure, shown from the lateral side of the sole assembly.
Figure 30:
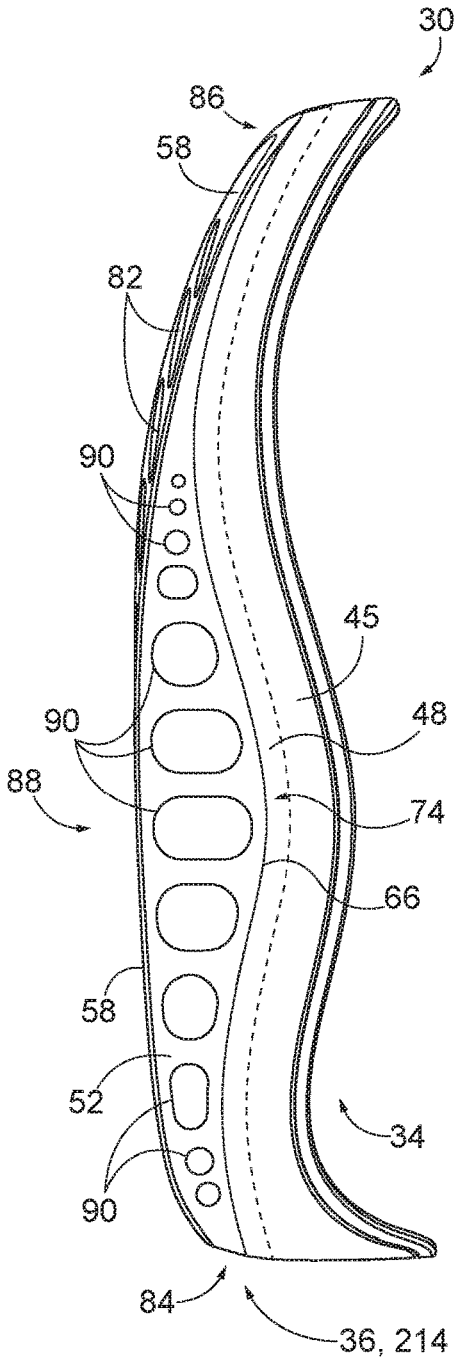
FIG. 30 is a side elevation view of the sole assembly of FIG. 29, shown from the medial side of the sole assembly.

FIGS. 29-32 illustrate additional examples of frame 36 and/or sole assemblies 30. FIGS. 29-30 illustrate another example of sole assembly 30, in the form of sole assembly 212, which is shown from the lateral side in FIG. 29 and from the medial side in FIG. 30. Sole assembly 212 includes an example of footbed membrane 34 coupled to a frame 214, which is an example of frame 36. Frame 214 includes a plurality of wall holes 90 formed through annular frame wall 52 on both the medial and lateral sides. As shown in FIGS. 29-30, wall holes 90 may vary in size and shape within a given frame 36. For example, in FIG. 29, wall holes 90 may include a plurality of smaller circular wall holes 90 within heel region 84, a plurality of smaller circular wall holes 90 in midfoot region 88, and a plurality of larger wall holes 90 in between. As shown, some wall holes 90 may be circular, while others may be differently shaped, such as substantially polygonal with rounded corners. FIG. 30 shows a similar arrangement on the medial side, with a plurality of smaller circular wall holes 90 positioned in heel region 84, a plurality of smaller circular wall holes 90 anterior to medial arch region 74, and a plurality of larger wall holes 90 positioned there between. The particular number, arrangement, orientation, sizes, and shapes of wall holes 90 of frame 214 are illustrative, and non-exclusive, with other examples of frame 36 including wall holes 90 in different numbers, arrangements, orientations, sizes, and/or shapes. Wall holes 90 may be configured to provide desired functional effects. For example, smaller wall holes 90 may be utilized in the forefoot region for control of loading of the wearer's forefoot, while larger wall holes 90 may be positioned under the wearer's arch to support the arch. The shape of respective wall holes 90 may be optimized and/or configured to provide ventilation, flexion, and/or weight reduction in the frame 36, as desired.

Figure 31:
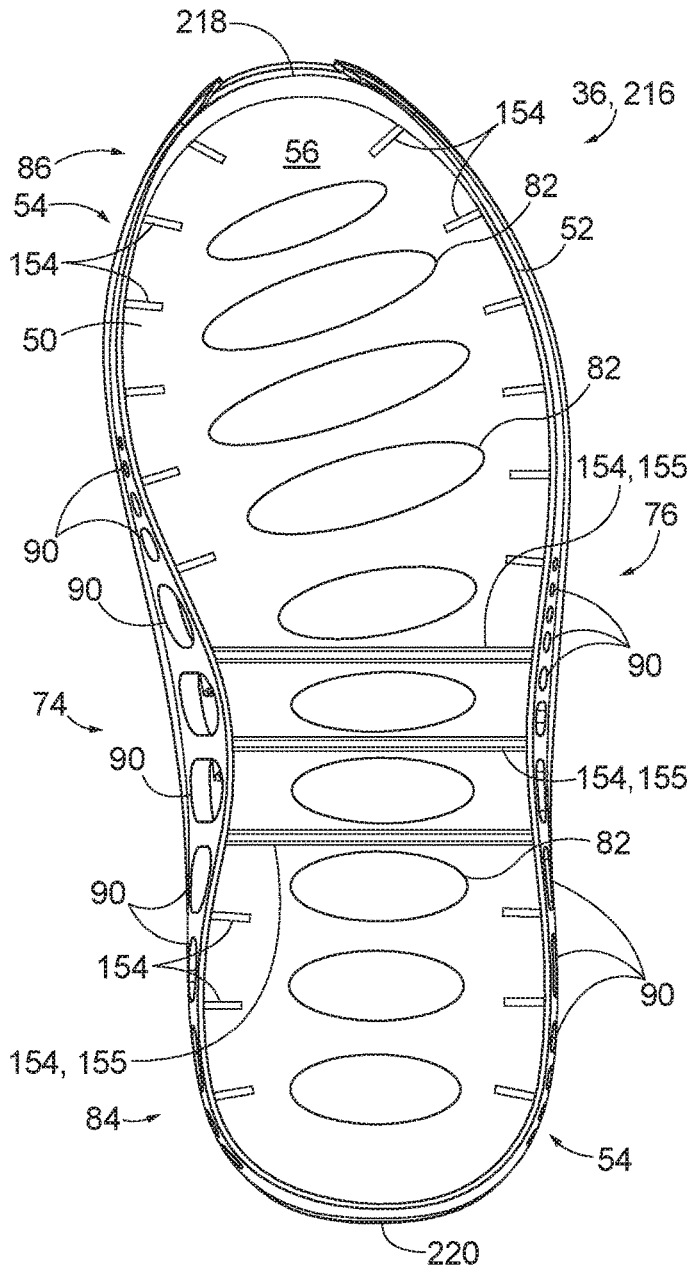
FIG. 31 is a top perspective view of one example of a frame for use with a sole assembly, according to the present disclosure.

FIG. 31 shows a top plan view of a frame 216, which is an example of frame 36. The configuration in FIG. 31 includes a plurality of apertures 82 formed in rocker bottom 50, a plurality of wall holes 90 formed in annular frame wall 52, and a plurality of support braces 154 spaced apart around frame perimeter 54. In this example, apertures 82 are all substantially oval in shape, but vary in size and orientation. Said apertures 82 are spaced apart substantially along the entire length of frame 216. Similarly, support braces 154 are positioned substantially around the entire frame perimeter 54, except for immediately adjacent an anterior end 218 and a posterior end 220 of frame 216, as shown. In other examples, support braces 154 may be spaced apart and positioned all the way around frame perimeter 54. In this example, support braces 154 include a plurality of support braces 154 that extend from annular frame wall 52 less than a majority of the width of frame 216. Frame 216 also includes a plurality of support braces 155 (which are an example of support braces 154) that extend across at least a majority of the width of frame 216, such as across the entire width of frame 216, from lateral arch region 76 to medial arch region 74. Said support braces 155 are positioned in the arch region of frame 216, and spaced between adjacent respective apertures 82. In other examples of frame 36, apertures 82 may be absent in the area where support braces 155 are positioned. Additionally or alternatively, such support braces 155 may be positioned in forefoot region 86 and/or heel region 84, in various examples of frame 36.

Figure 32:
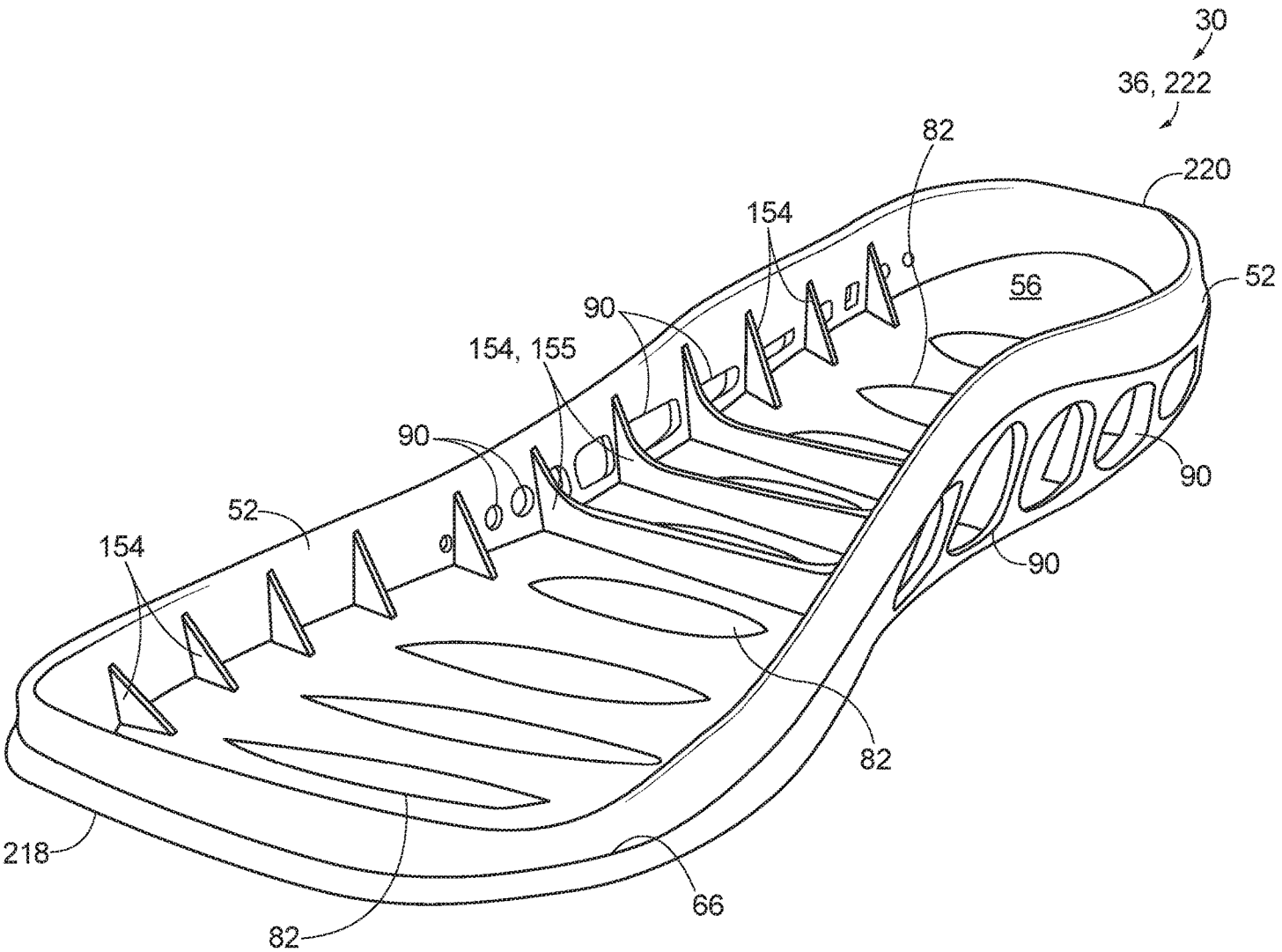
FIG. 32 is a front perspective view of one example of a frame for use with a sole assembly, according to the present disclosure.

FIG. 32 illustrates a similar frame 222 (another example of frame 36), which also includes apertures 82, wall holes 90, and support braces 154, 155. Said support braces 154, 155, such as those examples shown in FIGS. 31-32 may be curvilinear, may be configured to provide structural integrity in midfoot region 88, may serve as buttresses for frame perimeter 54, and/or may be configured to limit or prevent annular frame wall 52 from flexing inward toward upper frame side 56 when sole assembly 30 is loaded by a wearer. In other words, while a downward load applied to footbed membrane 34 may transmit such forces to annular frame wall 52 by virtue of footbed membrane 34 being engaged with frame 36, annular frame wall 52 (as supported by support braces 154, 155, or not) may be strong enough to resist such forces and thereby resist bending inward into frame cavity 60 and toward upper frame side 56. In some examples, support braces 155 may be curvilinear bars that extend transversely and are high enough (e.g., project upwards away from upper frame side 56) to provide enhanced support in the middle of the article of footwear to support annular frame wall 52.

FIGS. 16-20 and 33-36 illustrate variations and illustrative, non-exclusive examples of footbed membrane 34 that may be incorporated with any of various described examples of sole assemblies 30, articles of footwear 32, footbed membranes 34, and/or frames 36.

Figure 16:
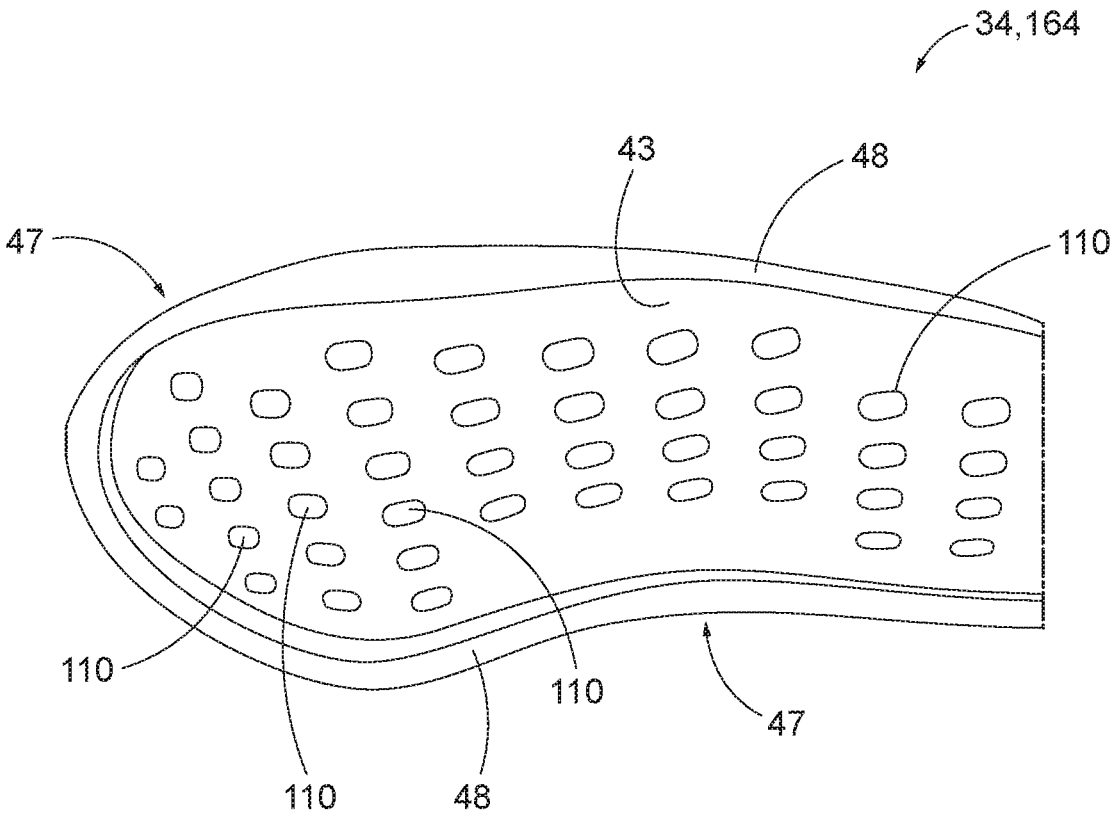
FIG. 16 is a bottom view of an example of a footbed membrane according to the present disclosure.
Figure 17:
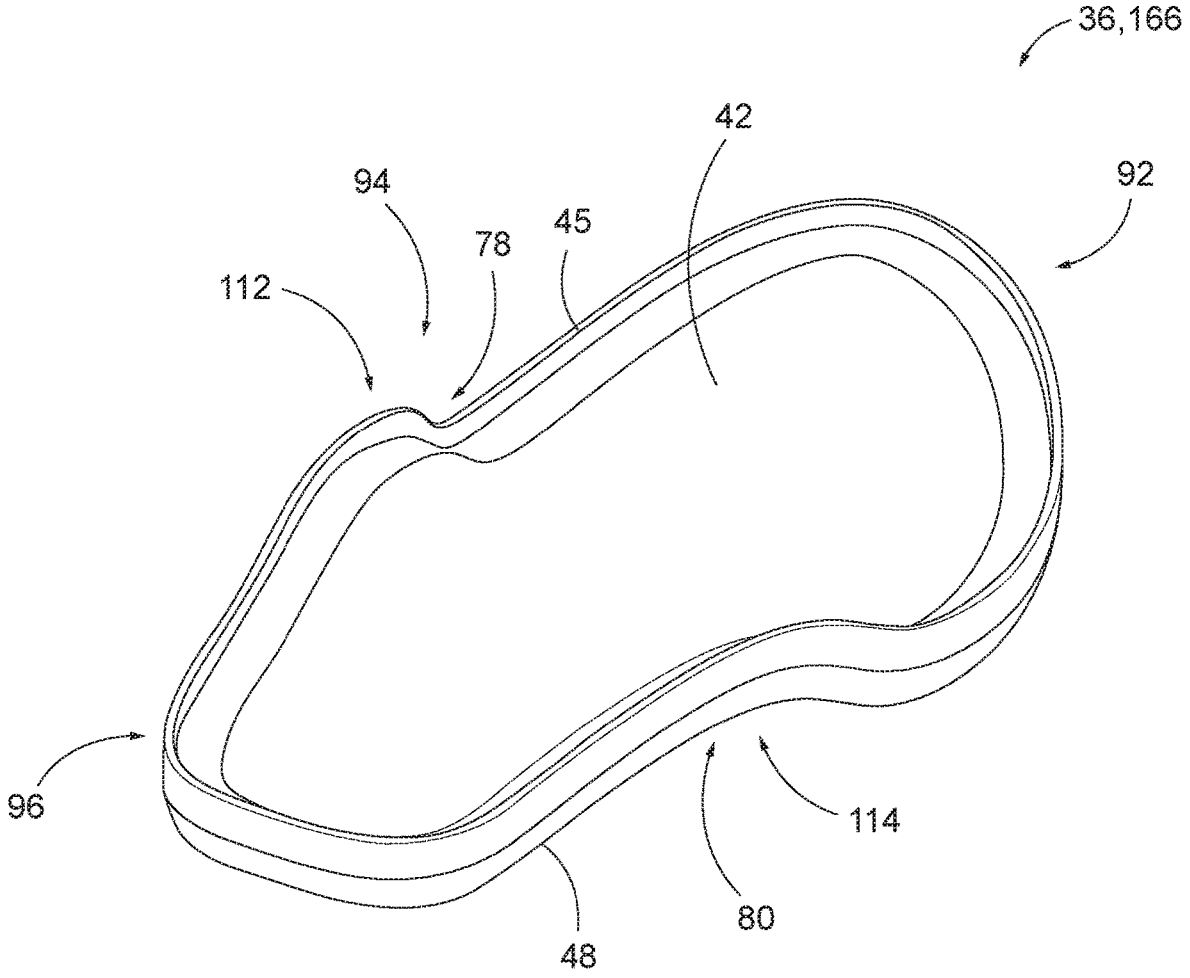
FIG. 17 is a perspective view of another example of a footbed membrane according to the present disclosure.

FIG. 16 shows a footbed membrane 164, which is an example of footbed membrane 34. Lower membrane surface 43 is primarily visible, surrounded by lower wall 48 around membrane perimeter 47. Footbed membrane 164 includes a plurality of membrane apertures 110, spaced apart through much of the surface area of footbed membrane 164. By contrast, FIG. 17 shows a footbed membrane 166 (also an example of footbed membrane 34) without any membrane apertures formed through the membrane. Footbed membrane 166 is formed of a solid layer of an elastomer (e.g., polyurethane), though footbed membrane 166 may include one or more additional layers, one or more internal members, and/or be impregnated with one or more additional materials, as described herein. Footbed membrane 166 is generally contoured to support the wearer's foot throughout the gait cycle.

Figure 18:
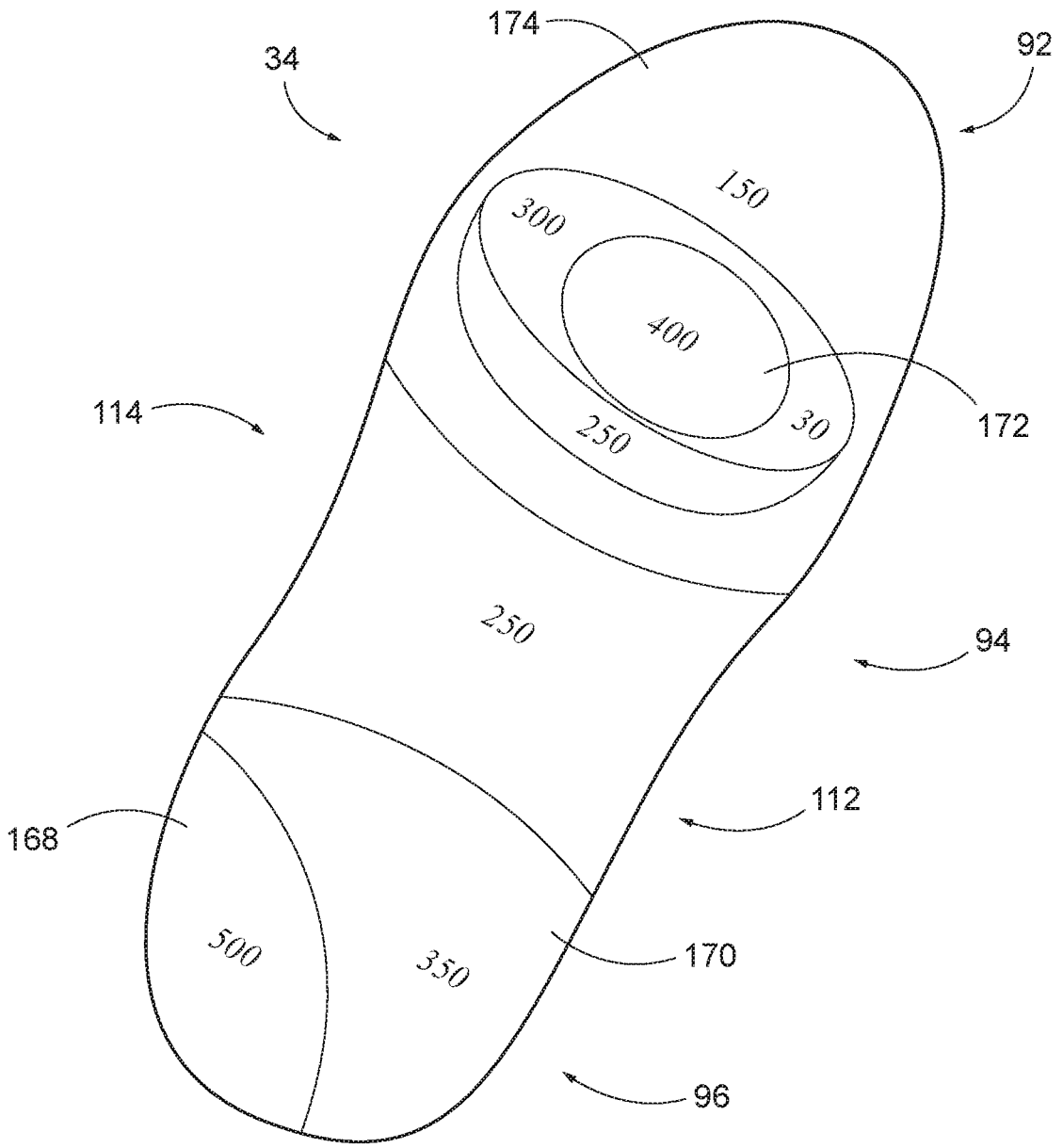
FIG. 18 is a schematic representation of relative forces that may be experienced in various regions of footbed membranes according to the present disclosure.
Figure 19:
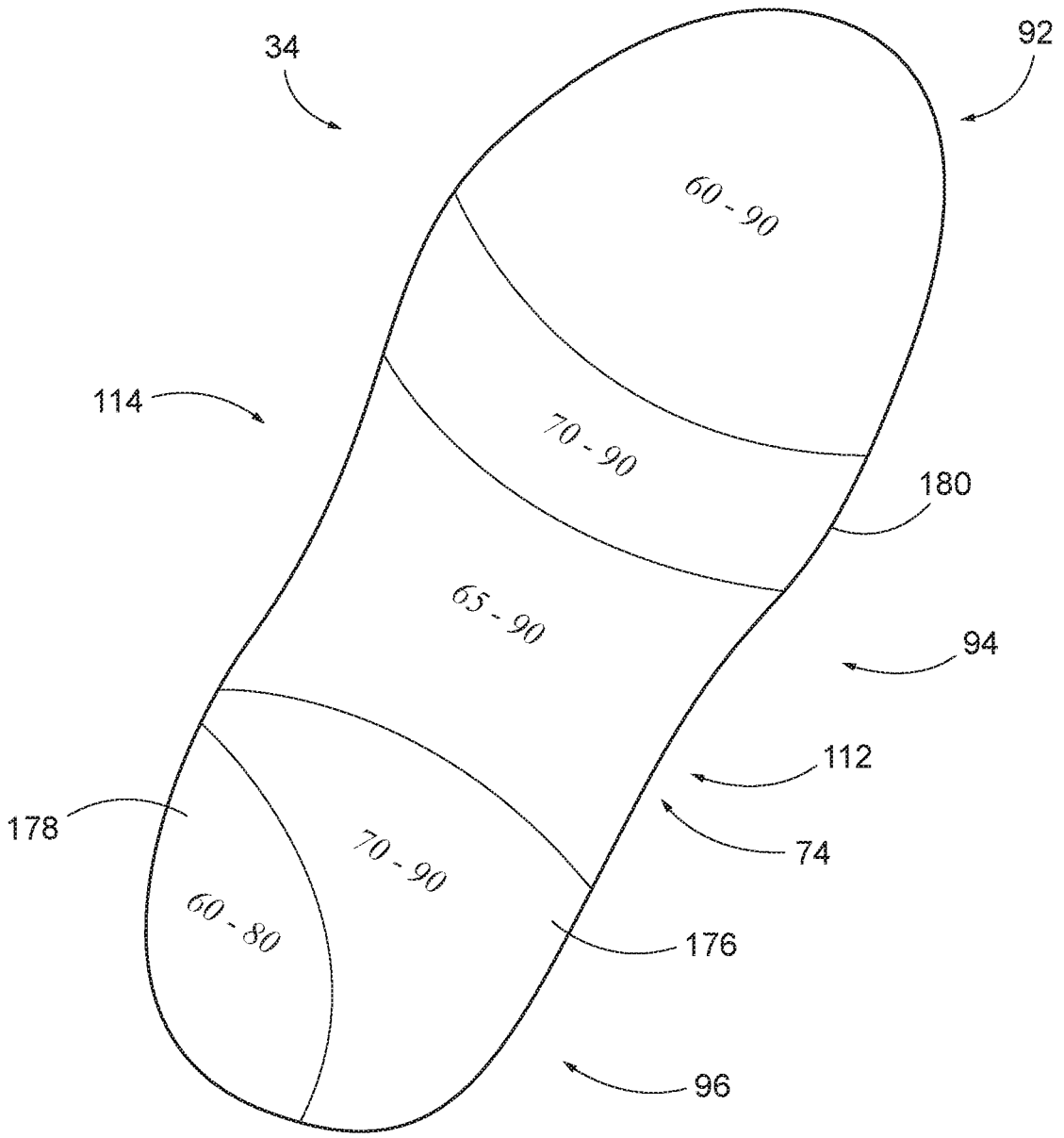
FIG. 19 is a schematic representation of relative locations of varying durometer in footbed membranes according to the present disclosure.
Figure 20:
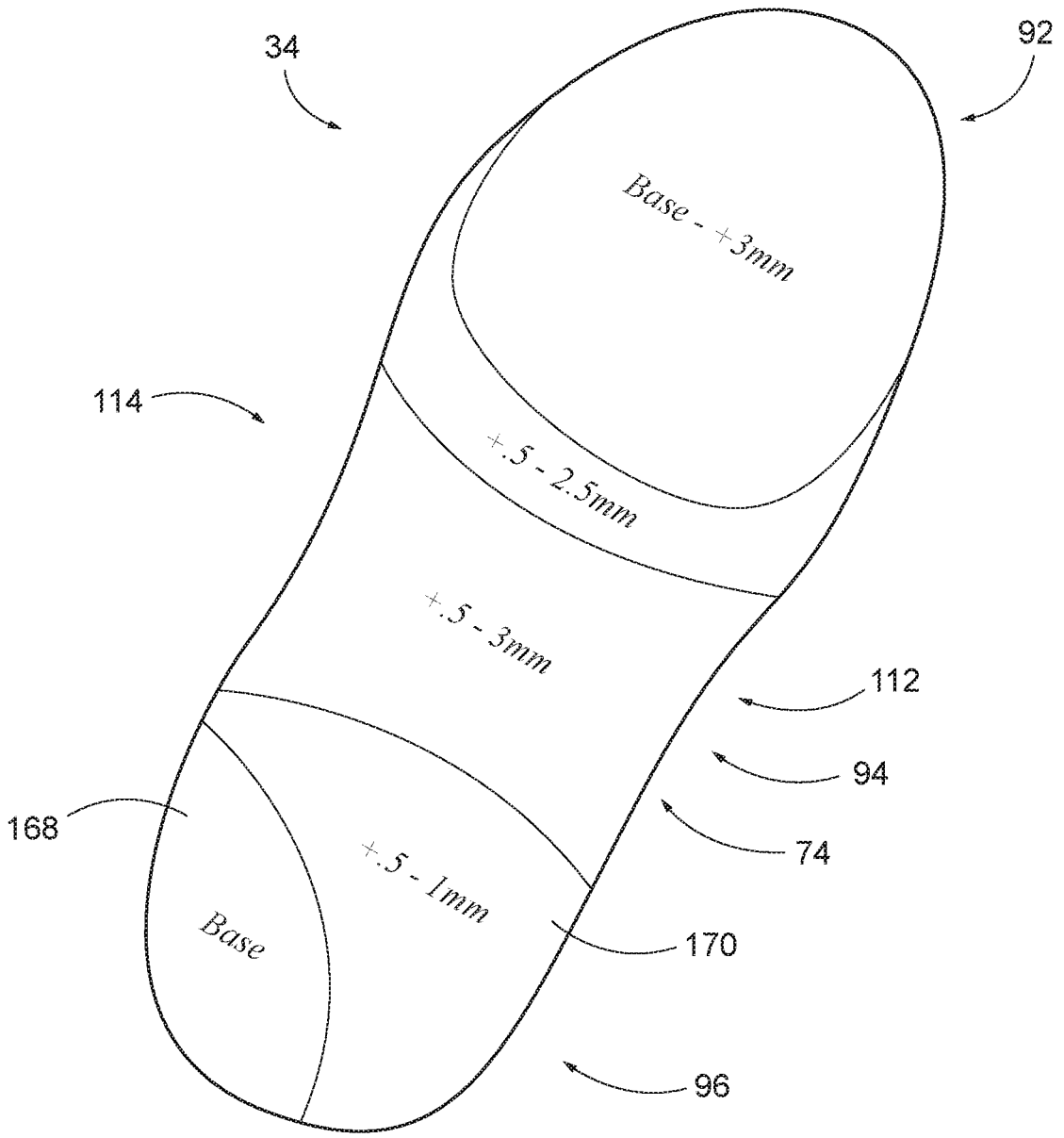
FIG. 20 is a schematic representation of relative locations of varying thickness in footbed membranes according to the present disclosure.

FIGS. 18-20 schematically illustrate examples of footbed membranes 34 having different spatial distributions of forces experienced by the membrane (FIG. 18), different distributions of durometer of materials used to form footbed membrane 34 (FIG. 19), and different distributions of thickness of materials used to form footbed membrane 34 (FIG. 20). In FIG. 18, general (approximate) areas of different ranges of the pounds of force per square inch typically experienced in that respective area are indicated. While FIG. 18 includes numerical figures, these figures are intended to represent ranges of values, rather than a single value. It is to be understood that the regions indicated in FIG. 18 are merely to facilitate discussion of loading of the footbed membrane, and are not intended to represent maximums, minimums, or any absolute characteristics of disclosed footbed membranes 34. For example, FIG. 18 shows that in some uses of some footbed membranes 34, higher loading (e.g., greater forces) may be experienced in midfoot region 94 than in forefoot region 92 and/or heel region 96. In some examples, a lateral heel portion 168 within heel region 96 may experience greater forces as a result of being weighted by a wearer of footwear than does a medial heel portion 170 within heel region 96. In some examples, a first portion 172 within forefoot region 92 may experience greater forces than surrounding areas of forefoot region, such as a second portion 174 within forefoot region 92. First portion 172 may, for example, approximately underlie the ball of the wearer's foot, while second portion 174 may, for example, underlie the wearer's toes.

FIG. 19 schematically illustrates that different areas of footbed membrane 34 may have different Shore A durometers. In some examples, the Shore A durometer of the material used to form footbed membrane 34 may be varied to accommodate varying forces expected in different respective areas of footbed membrane 34 when weighted by the wearer (e.g., to accommodate different support needs). For example, a third portion 176 within heel region 96 may have a higher Shore A durometer than does a fourth portion 178 within heel region 96. A transition portion 180 between forefoot region 92 and midfoot region 94 may have a higher Shore A durometer than immediately surrounding areas of forefoot region 92 and midfoot region 94. Medial arch region 74 may have a higher Shore A durometer than other areas within midfoot region 94 or heel region 96, which configuration may provide greater support for a wearer's arch.

Similarly, FIG. 20 schematically illustrates that different areas of footbed membrane 34 may have different thicknesses (e.g., the distance between the upper and lower membrane surfaces) of the material used to form footbed membrane 34. Footbed membrane 34 may be described as having a baseline thickness, with one or more regions of footbed membrane 34 having a thickness greater than the baseline thickness, and/or one or more regions of footbed membrane 34 having a thickness that is less than the baseline thickness. Footbed membrane 34 may include, for example, ridges or protrusions having thicknesses greater than the baseline thickness, and/or valleys or score lines having thicknesses less than the baseline thickness. Such ridges or valleys may be formed on upper membrane surface 42 and/or lower membrane surface 43. Additionally or alternatively, the thickness of footbed membrane 34 may vary on a gradient from one region to another, such as to support various different expected loads in different regions of footbed membrane 34. For example, footbed membrane 34 may have a baseline thickness of between about 1.5 mm and about 3 mm, with some regions of footbed membrane 34 having the baseline thickness (indicated in FIG. 20 by "Base"), and some regions of footbed membrane 34 being thicker than the baseline thickness, such as midfoot region 94 being between 0.5 mm and 3 mm thicker than the baseline thickness, and/or forefoot region 92 being up to 3 mm thicker than the baseline thickness in some examples. In some specific examples, lateral heel portion 168 may be the baseline thickness, whereas medial heel portion 170 may be slightly thicker, such as 0.5 mm to 1 mm thicker than the baseline thickness. In some examples, the thickness of footbed membrane 34 within midfoot region 94 is at least 0.5 mm thicker, at least 1 mm thicker, at least 2 mm thicker, and/or at least 3 mm thicker than in heel region 96 of footbed membrane 34.

Figure 33:
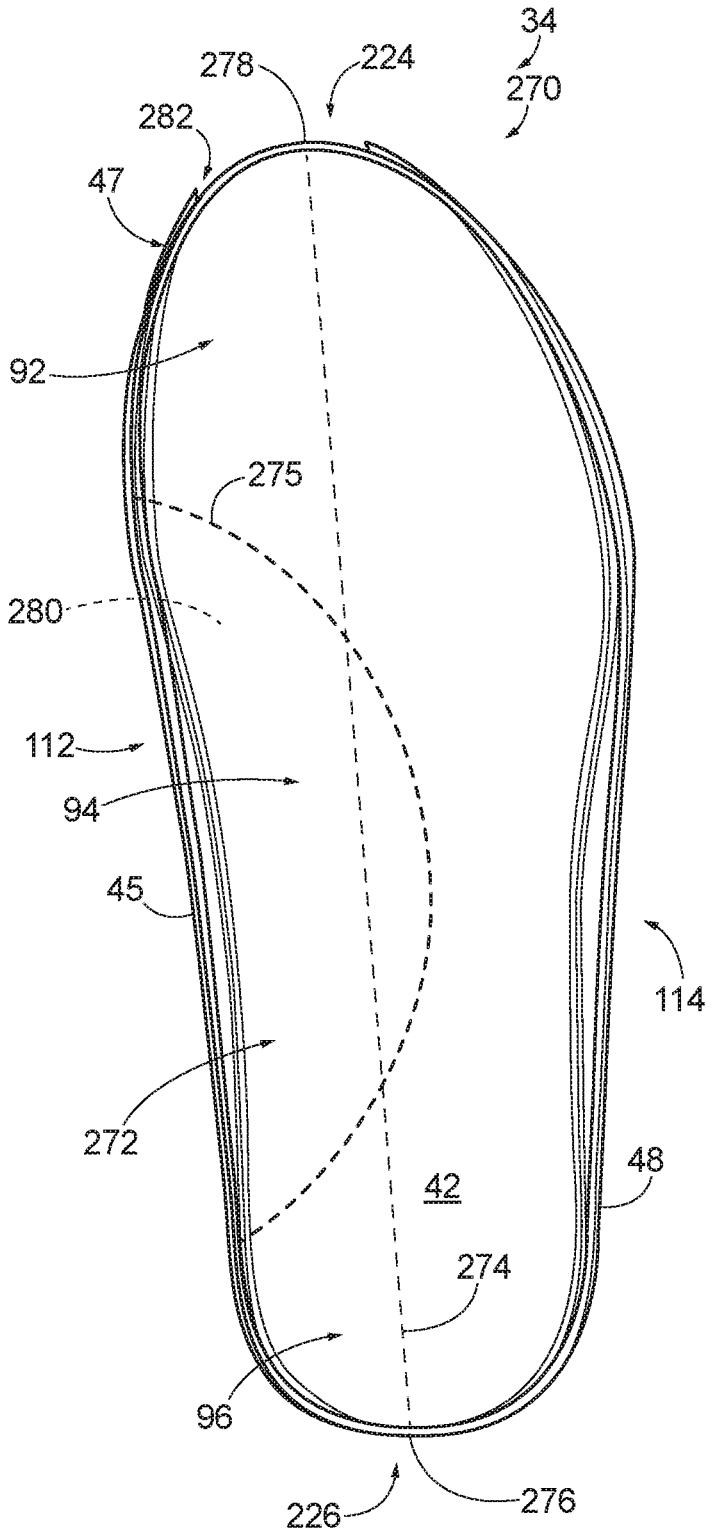
FIG. 33 illustrates a top plan view of an example of a footbed membrane according to the present disclosure.

FIG. 33 shows a top plan view of a footbed membrane 270, which is another example of footbed membrane 34. In FIG. 33, upper membrane surface 42 is shown with sew wall 45 extending around membrane perimeter 47. Footbed membrane 270 includes an enlarged arch region 272 positioned adjacent medial region 112 of footbed membrane 34. Arch region 272 may be configured to extend longitudinally towards an anterior portion 224 of footbed membrane 270 and/or towards a posterior portion 226 of footbed membrane 270, to a greater extent than would be expected by one of ordinary skill in the art. For example arch region 272 (as bounded by dashed line 275 and the lateral portion of membrane perimeter 47) may extend towards anterior portion 224 of footbed membrane 34 such that arch region 272 extends to forefoot region 92 and/or is positioned under one or more metatarsal heads of a wearer's foot (e.g., under the wearer's first metatarsal head). Additionally or alternatively, arch region 272 may extend posteriorly (i.e., towards posterior portion 226) such that arch region 272 extends into heel region 96 of footbed membrane 270 and/or underlies a portion of the wearer's heel. In some examples, arch region 272 may extend laterally (e.g., towards lateral region 114) such that a portion of arch region 272 crosses a longitudinal centerline 274 of footbed membrane 270, with longitudinal centerline 274 being defined as the line extending from a first point 276 that is most posterior on membrane perimeter 47 to a second point 278 that is most anterior on membrane perimeter 47.

Arch region 272 may be configured to support a wearer's arch, such as by being stiffer, of a higher durometer, thicker, and/or configured to elongate less when loaded by a wearer's foot than one or more other regions of footbed membrane 270. For example, arch region 272 may include an additional layer of material 280 adhered to, bonded to, co-cured with, and/or otherwise coupled to upper membrane surface 42. In some examples, arch region 272 is integrally formed with the rest of footbed membrane 270 and molded to be thicker than other portions of footbed membrane 270. In one specific example, arch region 272 may include a layer of graphene coupled to the remainder of upper membrane surface 42.

As shown in FIG. 33, footbed membrane 270 may include a notch 282 formed in sew wall 45 and/or in lower wall 48. Such notch 282 may correspond to an area of sew wall 45 having a smaller sew wall height (see FIG. 2), which may be configured to facilitate and/or improve adherence of an upper to sole assembly 30.

While some examples of footbed membrane 34 include perforations or membrane holes (also referred to herein as membrane apertures) formed therethrough, some examples of footbed membrane 34 (e.g., the example shown in FIG. 33) do not include any perforations, apertures, or holes. However, versions of footbed membrane 270 that include one or more membrane holes or perforations (e.g., membrane apertures 110) are within the scope of the present disclosure, and/or features of footbed membrane 270 may be included with or incorporated into other examples of footbed membrane 34 that include such perforations or membrane apertures. Additionally or alternatively, examples of footbed membrane 34 (e.g., footbed membrane 270) may include perforations or membrane apertures in some areas but not others. In a specific example, arch region 272 may be devoid of perforations or membrane apertures, while other areas of footbed membrane 270 may include one or more such perforations or apertures.

Figure 34:
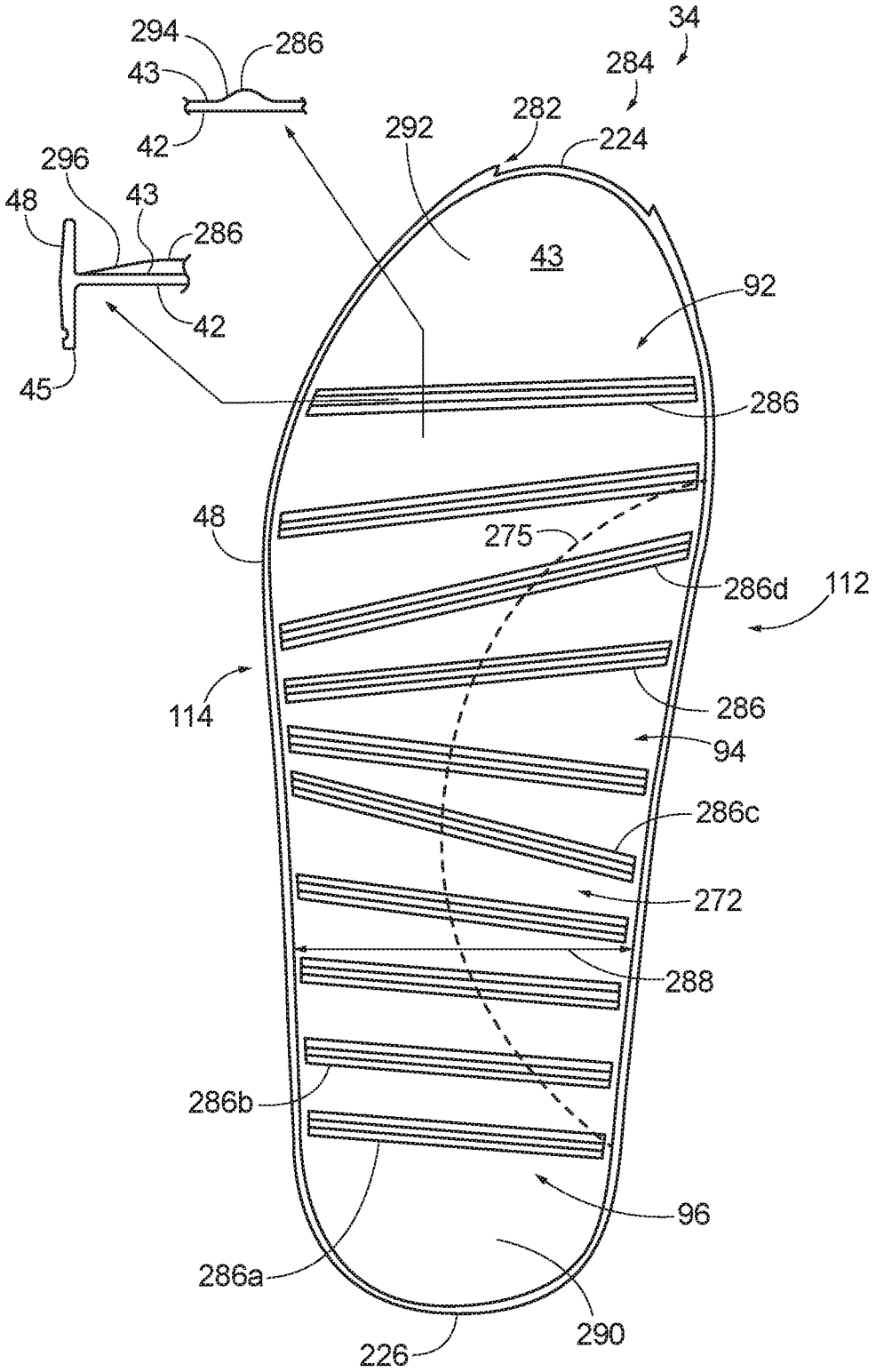
FIG. 34 illustrates a bottom plan view of an example of a footbed membrane according to the present disclosure.

FIG. 34 shows a bottom plan view of a footbed membrane 284, which is an example of footbed membrane 34. Footbed membrane 284 includes a plurality of ribs 286 extending at least partially across a width 288 of footbed membrane 284, wherein ribs 286 project away from lower membrane surface 43. Ribs 286 may be integrally formed with lower membrane surface 43 (e.g., molded with the rest of footbed membrane 284), or may be adhered to or otherwise coupled to lower membrane surface 43. When footbed membrane 284 is incorporated into a sole assembly (e.g., sole assembly 30), said sole assembly may be configured to prevent contact between ribs 286 and the upper frame side of the frame of the sole assembly (e.g., upper frame side 56). Certain examples of ribs 286 may be between 4-12 mm in height, and/or between 1-3 mm thick. In other examples, ribs 286 may be thinner or thicker, and/or project away from lower membrane surface 43 to a greater or lesser extent.

Ribs 286 may be included in heel region 96 of footbed membrane 284, in midfoot region 94 of footbed membrane 284, and/or in forefoot region 92 of footbed membrane 284. In some examples, ribs 286 may be present in one or more regions of footbed membrane 284 and absent in one or more other regions of footbed membrane 284. For example, footbed membrane 284 may include ribs 286 in midfoot region 94 but not in forefoot region 92 or heel region 96. In another example, footbed membrane 284 may include ribs 286 in heel region 96 and midfoot region 94, but not forefoot region 92. In the example shown in FIG. 34, ribs 286 are present in all of heel region 96, midfoot region 94, and forefoot region 92, though are absent in a portion 290 of heel region 96 adjacent posterior portion 226 and absent in a portion 292 of forefoot region 92 adjacent anterior portion 224.

One or more ribs 286 may extend at least substantially across the entire width 288 of footbed membrane 284 (e.g., from a point at or near lateral side 114 (also referred to herein as lateral region 114 or lateral portion 114) to a point at or near medial side 112 (also referred to herein as medial region 112 or medial portion 112) of footbed membrane 284). Additionally or alternatively, one or more ribs 286 may extend only partially across width 288 of footbed membrane 284. One or more respective ribs 286 may be at least substantially parallel to one or more respective other ribs 286. Additionally or alternatively, one or more respective ribs 286 may be arranged at a non-parallel angle with respect to one or more other respective ribs 286. For example, in the specific illustrative example shown in FIG. 34, rib 286*a* is parallel to rib 286*b*, while ribs 286*c* and 286*d* are non-parallel to each other and non-parallel to ribs 286*a* and 286*b*. In some examples, a greater number of ribs 286 may be included in arch region 272 than in other regions of footbed membrane 284.

Ribs 286 may be configured to increase tensional strength of footbed membrane 284, to help limit elongation of footbed membrane 284. Callouts in FIG. 34 illustrate examples of cross-sectional profiles for ribs 286. For example, ribs 286 may have a curved profile 294 when viewed from a longitudinal cross-section. Additionally or alternatively, ribs 286 may have a tapered profile 296 when viewed from a transverse cross-section, in the areas where ribs 286 terminate (e.g., adjacent lower wall 48).

Figure 35:
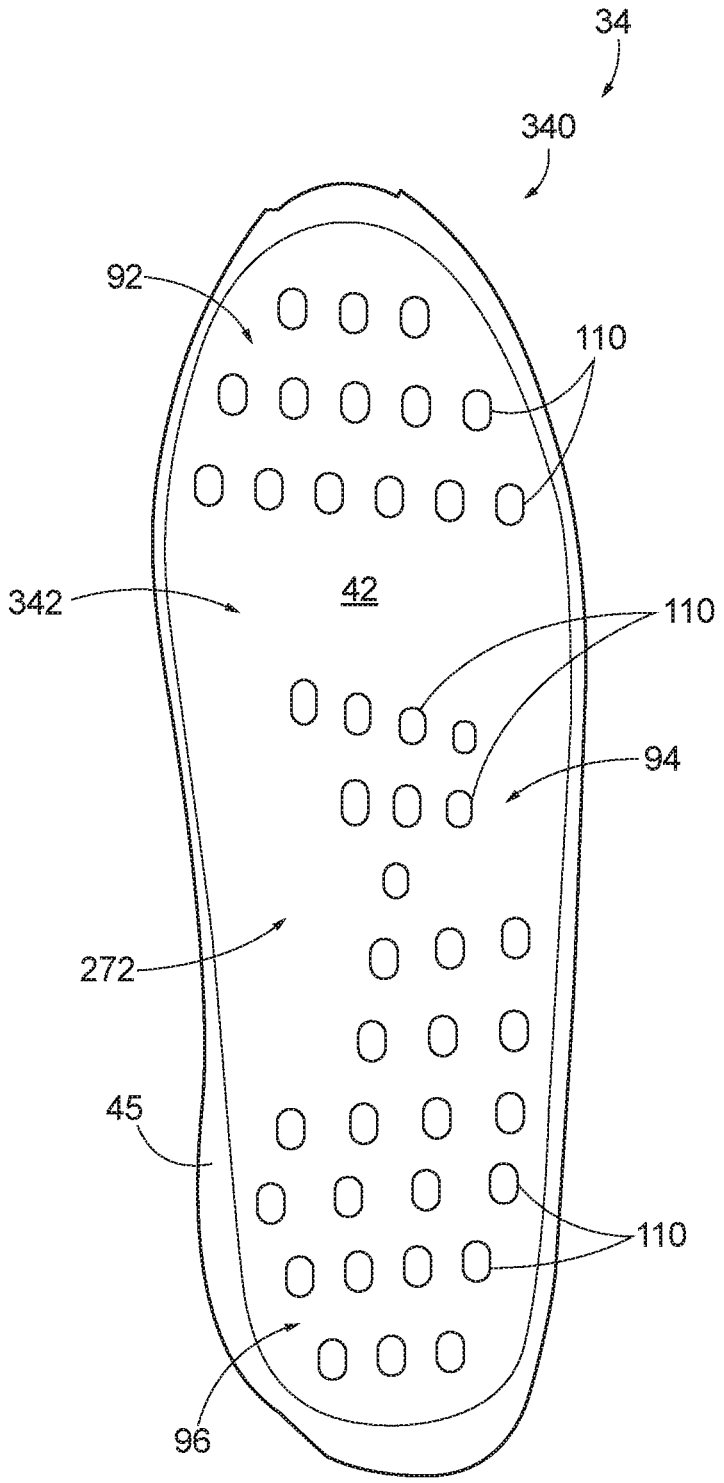
FIG. 35 illustrates a top perspective view of an example of a footbed membrane according to the present disclosure.
Figure 36:
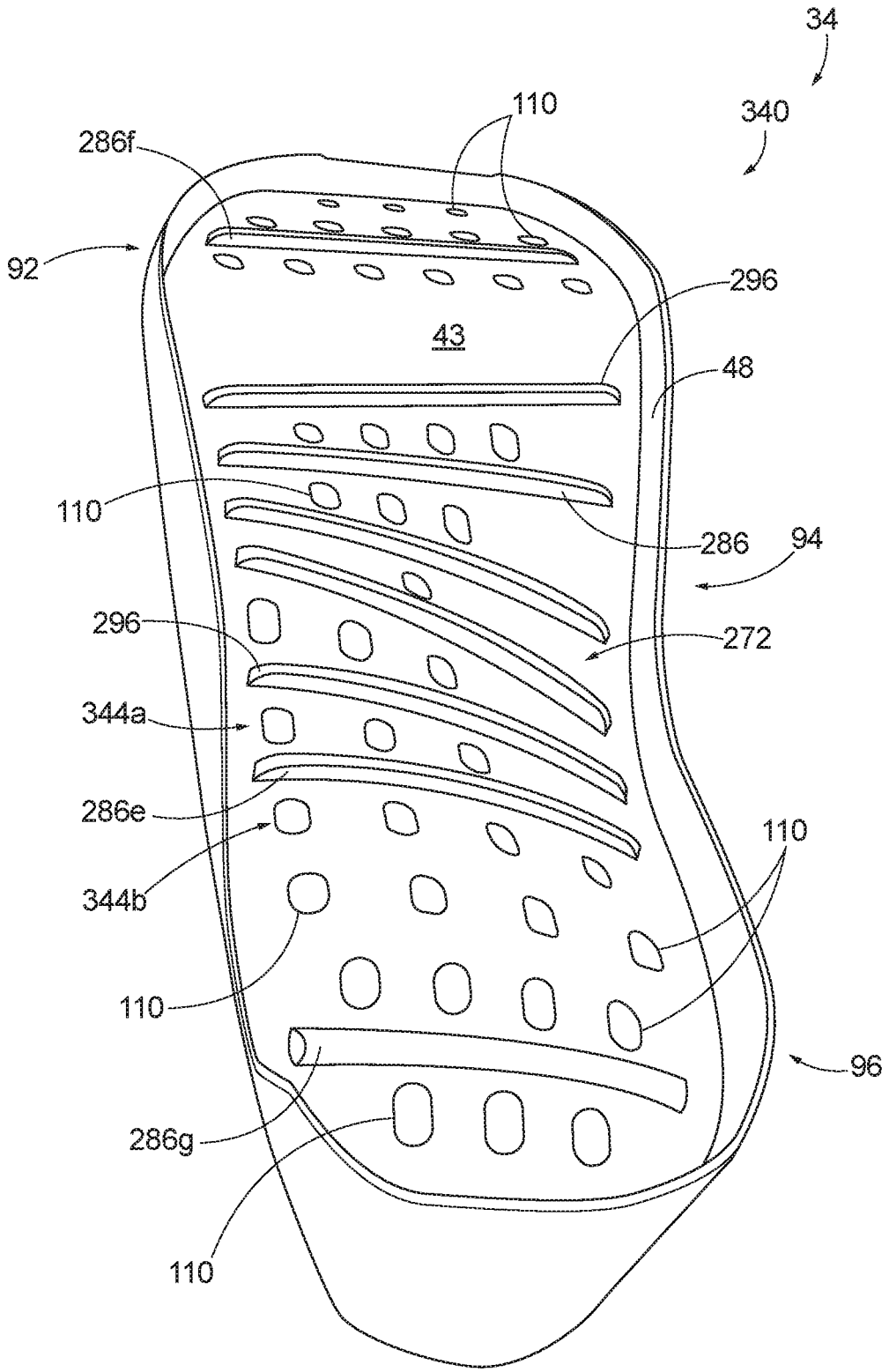
FIG. 36 illustrates a bottom perspective view of an example of a footbed membrane according to the present disclosure.

FIGS. 35 and 36 illustrate a footbed membrane 340, which is an example of footbed membrane 34. FIG. 35 illustrates a top plan view of footbed membrane 340 (showing upper membrane surface 42), and FIG. 36 illustrates a bottom view of footbed membrane (showing lower membrane surface 43). Footbed membrane 340 includes a plurality of membrane apertures 110 extending from upper membrane surface 42 to lower membrane surface 43. In this example, footbed membrane 340 includes membrane apertures 110 in forefoot region 92, midfoot region 94, and heel region 96. There are areas of footbed membrane 340 devoid of membrane apertures 110, such as arch region 272 and an area 342 in the general vicinity of the transition between forefoot region 92 and midfoot region 94.

FIG. 36 also illustrates ribs 286 projecting from lower membrane surface 43. As shown in FIG. 36, ribs 286 may be positioned with respect to membrane apertures 110 such that ribs 286 do not intersect membrane apertures 110. For example, respective ribs 286 may be positioned between respective rows of membrane apertures 110 (e.g., rib 286*e* is positioned between a first row 344*a* of membrane apertures 110 and a second row 344*b* of membrane apertures 110). Also as shown in FIG. 36, ribs 286 may extend into and/or be positioned within areas of footbed membrane 340 where membrane apertures 110 are absent. For example, ribs 286 may be positioned within arch region 272 where there are no membrane apertures 110. In other examples, footbed membrane 340 may include ribs 286 only in areas with membrane apertures 110, or only in areas without membrane apertures 110. Of course, examples of footbed membrane 34 may include ribs 286 in membranes without any membrane apertures 110, as illustrated in the example shown in FIG. 34. The example of FIG. 36 includes one rib 286*f* in forefoot region 92, one rib 286*g* in heel region 96, and a plurality of ribs 286 in midfoot region 94, though other arrangements are possible. For example, forefoot region 92 may include additional ribs 286 or no ribs 286, midfoot region 94 may include fewer or no ribs 286, and/or heel region 96 may include additional or no ribs 286 in various examples. The respective placement of membrane apertures 110 and ribs 286 in FIGS. 35-36 is meant to be illustrative, and respective placements are not limited to the specific example shown.

Figure 21:
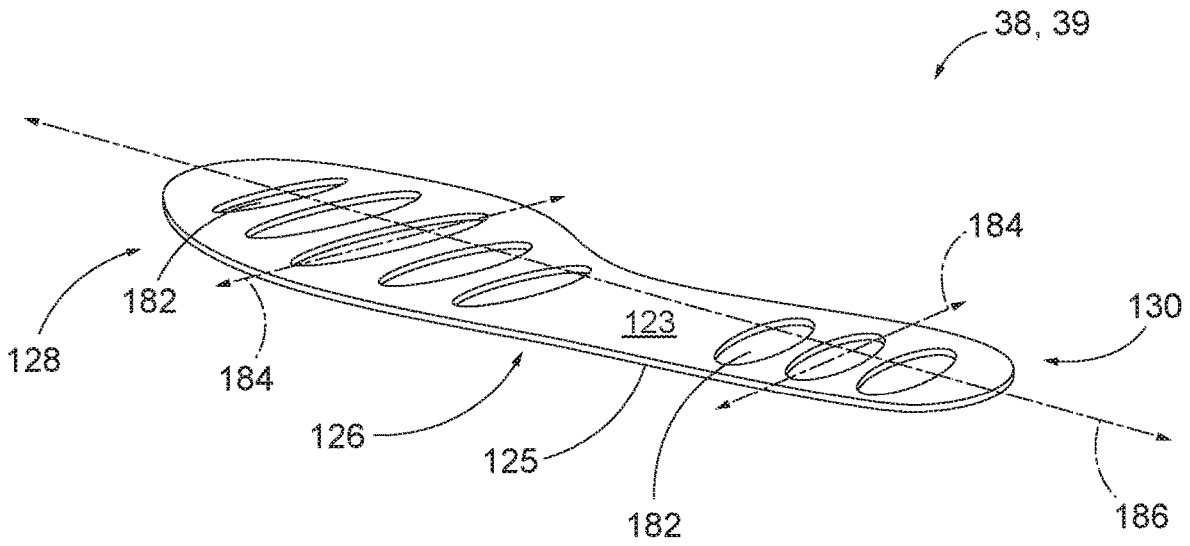
FIG. 21 illustrates one example of an outsole according to the present disclosure.
Figure 22:
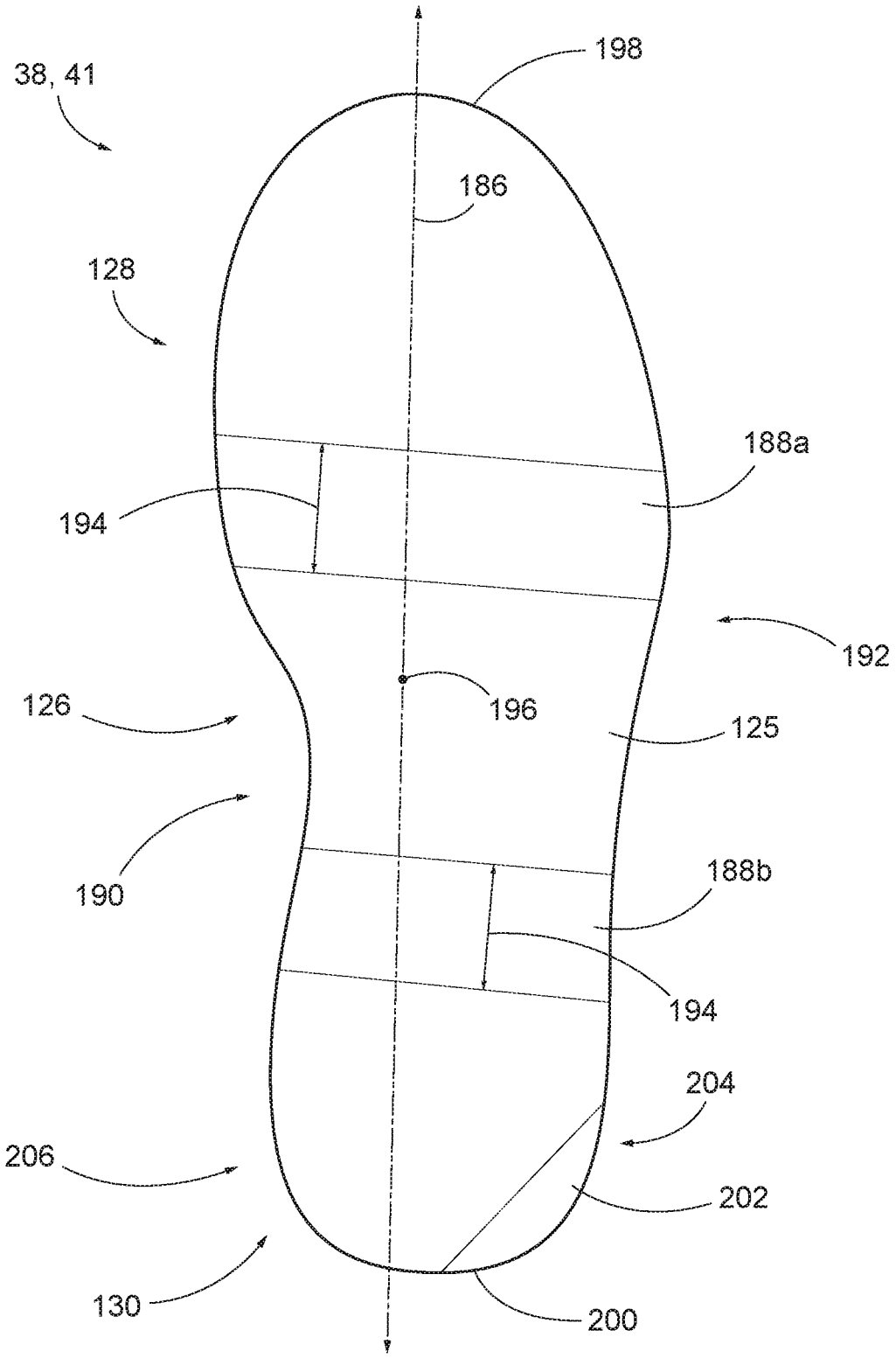
FIG. 22 is a schematic representation of a lower plan view of examples of outsoles according to the present disclosure.
Figure 23:
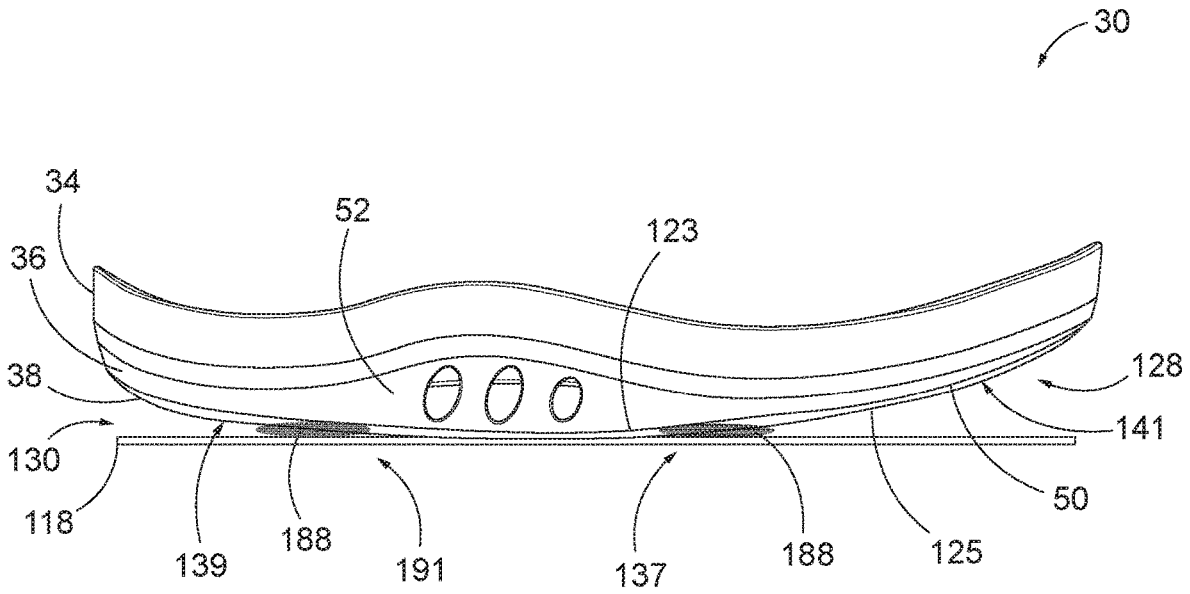
FIG. 23 is a side elevation schematic representation of an example of a sole assembly according to the present disclosure, with a plurality of stabilizing prominences included on the outsole.

FIGS. 21-24*b* illustrate examples of outsoles 38 that may be incorporated with disclosed articles of footwear 32, sole assemblies 30, footbed membranes 34, and/or frames 36. Lower outsole side 125 (which may also be referred to as outer outsole side 125) is configured to engage with a surface on which a wearer of an article of footwear including outsole 38 is striding, such as ground surface 118 (FIG. 23). Upper outsole side 123 (which may also be referred to as inner outsole side 123) is configured to engage with rocker bottom 50 of disclosed frames 36 (see, e.g., FIG. 2). For example, upper outsole side 123 may be cemented or otherwise adhered to the lower frame side 58 of rocker bottom 50, and generally conforms to the contours of the frame to which it is coupled. Outsole 38 is thus generally formed of a flexible, resilient material.

As shown in FIG. 21, some examples of outsole 38 include one or more outsole apertures 182 formed between upper outsole side 123 and lower outsole side 125 of outsole 38. For example, FIG. 21 illustrates an outsole 39 (which is an example of outsole 38) having three outsole apertures 182 within heel region 130 of outsole 38, and five outsole apertures 182 formed within forefoot region 128 and midfoot region 126 of outsole 38. Outsole apertures 182 are illustrated as being substantially oval-shaped, though other shapes are also within the scope of the present disclosure. More or fewer outsole apertures 182 may be included in any given region of outsole 38 in various examples. A given outsole aperture 182 may be a different size, shape, and/or orientation than one or more other respective outsole apertures 182 in a given outsole 38. Outsole apertures 182 of outsole 39 are oriented such that respective longitudinal axes 184 of respective outsole apertures 182 are substantially perpendicular to a longitudinal axis 186 of outsole 39, though other orientations are also within the scope of the present disclosure. In some examples, all outsole apertures 182 formed in a given outsole 38 may be arranged in the same or similar orientations, while in other examples, one or more outsole apertures 182 may be arranged in a different orientation than one or more other outsole apertures 182. Outsole apertures 182 may correspond in shape, size, alignment, orientation, and/or position with one or more apertures formed in the frame to which outsole 38 is coupled, in some examples (e.g., apertures 82 of FIG. 4). In some examples, outsole apertures 182 may facilitate airflow into the frame cavity formed above outsole 38 (e.g., frame cavity 60 of FIG. 4*b*), such as via aligned outsole apertures 182 and apertures 82 formed in frame 36, thereby allowing air to flow into the frame cavity through the aligned apertures 82, 182.

FIGS. 22-24*b* illustrate various examples of outsoles 38 that include one or more prominences 188 formed on the outsole (e.g., coupled thereto, or integrally formed therewith). Such prominences 188 will be described herein in relation to examples of outsole 38 (and therefore referred to as outsole prominences 188), though presently disclosed frames 36 may include such prominences on lower frame side 58, with the following discussion of outsole prominences 188 being equally applicable to the use of prominences 188 on frame 36, in examples that include such prominences on frame 36. Outsole prominences 188 generally project away from (e.g., extend from) lower outsole side 125 of outsole 38, towards ground surface 118, and are configured to provide stability for standing and static use of the footwear in which outsole 38 is incorporated. Outsole prominences 188 may be soft enough so as to not interfere with a wearer's normal gait movements, but yet still provide enough stability to reduce the tendency of unwanted rocking motion while the wearer is standing still. In some exemplary outsoles 38, outsole prominences 188 have a Shore A durometer of between 20 and 80 (or between 50 and 95 on the 00 foam scale). Outsole prominences 188 may be non-rigid, and are generally less rigid than, for example, disclosed frames 36.

In some examples, and as shown in FIG. 22, one or more outsole prominences 188 (e.g., outsole prominence 188*a* and outsole prominence 188*b*) may extend substantially from a medial edge region 190 of an outsole 41 (which is an example of outsole 38) to a lateral edge region 192 of outsole 41. For example, outsole prominence 188*a* is positioned within forefoot region 128 of outsole 41 and extends from medial edge region 190 to lateral edge region 192. While FIG. 22 illustrates one such outsole prominence in forefoot region 128, other examples of outsole 38 may include one or more outsole prominences 188 in forefoot region 128, which may extend at least substantially from medial edge region 190 to lateral edge region 192, or may extend only partially there between. Outsole prominence 188*b* is positioned between midfoot region 126 and heel region 130, though examples of outsole 38 may include one or more such outsole prominences 188 within heel region 130, and/or within midfoot region 126 of outsole 38. In some examples, and as shown in FIG. 23, one or more prominences 188 may be positioned adjacent apex 137 of rocker bottom 50 (e.g. at the initiation of midfoot ramp 141), and/or one or more prominences 188 may be positioned adjacent an anterior region 191 of heel ramp 139 of rocker bottom 50. As best seen in FIG. 22, at least one outsole prominence 188 (e.g., outsole prominence 188*a*) may be positioned between a longitudinal midpoint 196 and an anterior end 198 of outsole 38. Additionally or alternatively, at least one outsole prominence 188 (e.g., outsole prominence 188*b*) may be positioned between longitudinal midpoint 196 and a posterior end 200 of outsole 38. Longitudinal midpoint 196 is defined as the halfway point between anterior end 198 and posterior end 200, along longitudinal axis 186. Outsole 41 includes two outsole prominences 188 spaced apart from one another. Other examples of outsole 38 may include additional or fewer outsole prominences 188.

One or more outsole prominences 188 may be oriented substantially perpendicularly to longitudinal axis 186 of outsole 38, as shown in FIG. 22. Additionally or alternatively, one or more outsole prominences 188 may be oriented at a non-parallel and non-perpendicular angle with respect to longitudinal axis 186 of outsole 38. A width 194 of one or more of outsole prominences 188 may be between 10 mm and 2 centimeters (cm), in some examples.

FIG. 23 illustrates one example of positioning of outsole prominences 188 with respect to ground surface 118 when a wearer is standing on ground surface 118. As shown, both outsole prominences 188 in FIG. 23 are positioned with respect to one another such that they both contact ground surface 118 under outsole 38 when in a static use condition (e.g., when the wearer of the article of footwear incorporating sole assembly 30 is standing on ground surface 118). Outsole prominences 188 may have any suitable cross-sectional shape, though in some examples, outsole prominences 188 have a substantially hemispheric cross-sectional shape.

Figure 24:
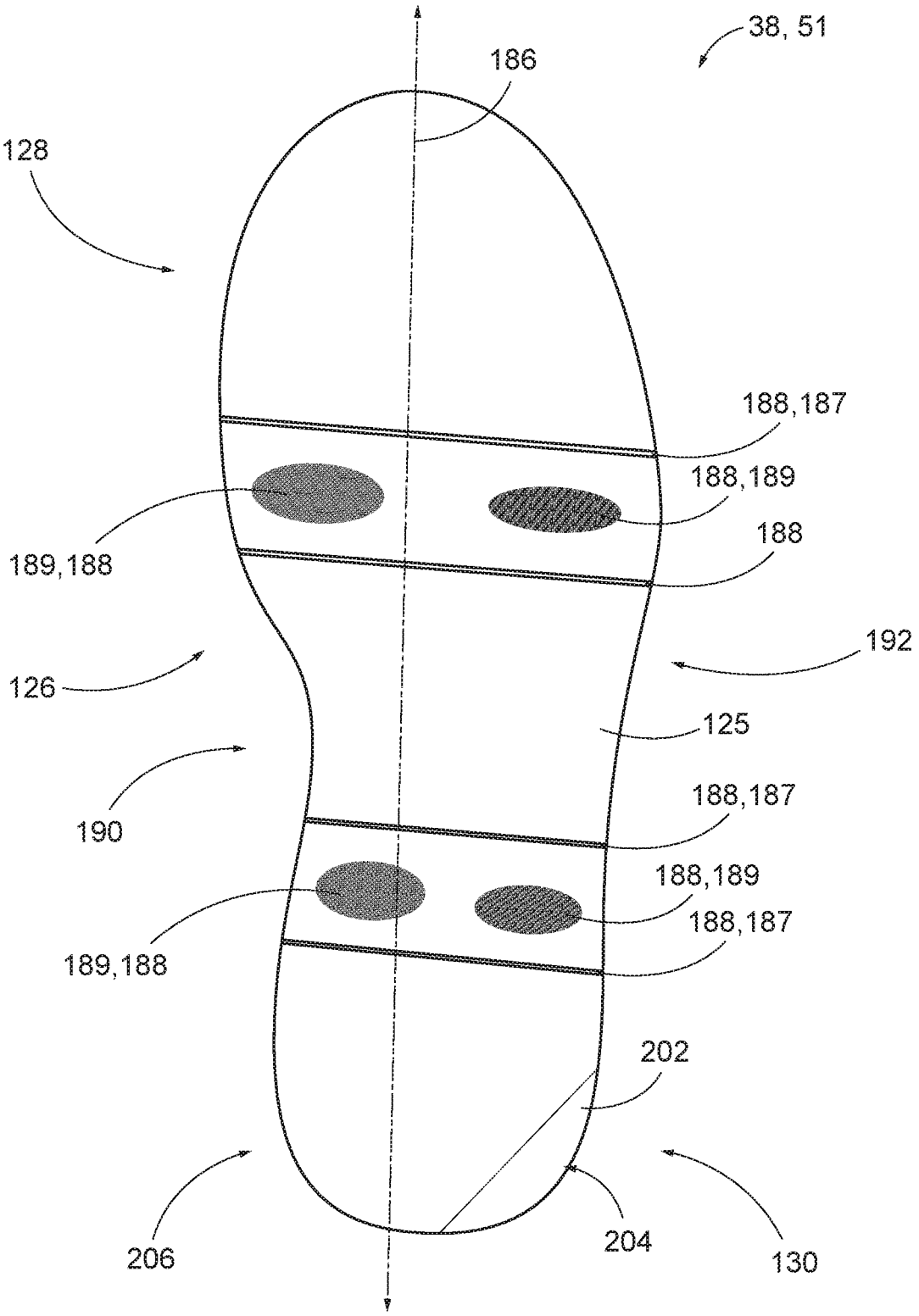
FIG. 24 is a schematic representation of a lower plan view of examples of outsoles according to the present disclosure.
Figure 24B:
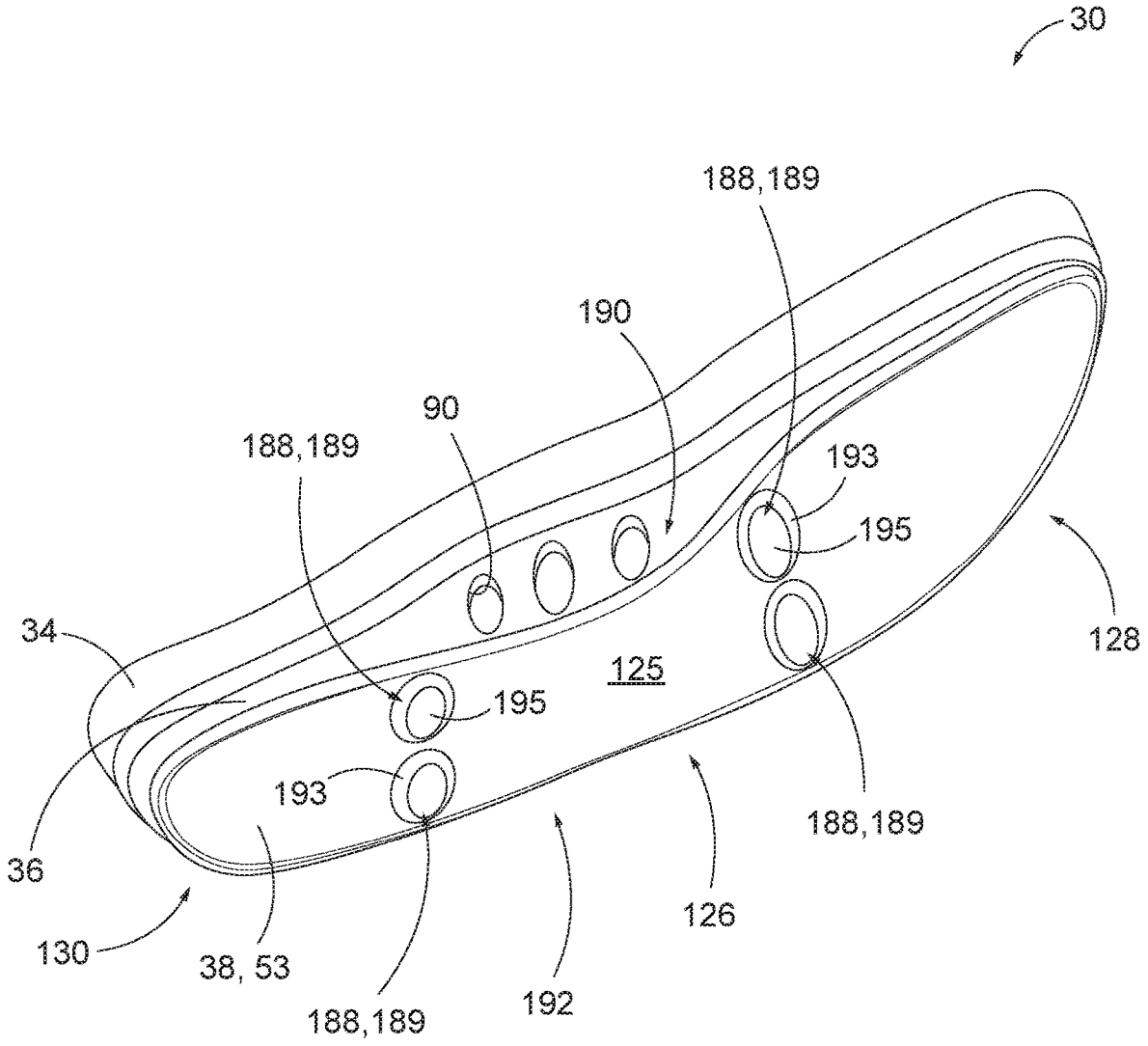
FIG. 24*b* is a simplified perspective view of an example of a sole assembly having an outsole according to the present disclosure.

FIG. 24 illustrates an outsole 51, which is another example of outsole 38 having a plurality of outsole prominences 188. In the example of FIG. 24, outsole prominences 188 include both transversely extending prominences 187 extending substantially perpendicularly to longitudinal axis 186 of outsole 38, as well as spot prominences 189, which may have a substantially oval or elliptical footprint, as shown. Spot prominences 189 may be positioned between adjacent respective pairs of transversely extending prominences 187, in some examples. Additionally or alternatively, spot prominences 189 may be positioned in other areas or locations of outsole 38. In various examples, outsole 38 may include fewer, more, or zero transversely extending prominences 187, and/or fewer, more or zero spot prominences 189 than shown in the figures. FIG. 24*b* shows an outsole 53, which is yet another example of outsole 38, with a plurality of spot prominences 189 projecting away from lower outsole side 125 of outsole 53. Spot prominences 189 may have rounded edges/contours 193 and/or substantially flat surfaces 195, which may be configured to facilitate a natural walking or striding motion for the wearer of the article of footwear, while still providing stability in static conditions.

With reference to FIGS. 22 and 24, outsole 38 includes a lateral heel plug 202 in some examples. Lateral heel plug 202, as shown, may be positioned within a lateral heel region 204 corresponding to a portion within heel region 130 adjacent lateral edge region 192 of outsole 41 (FIG. 22) and outsole 51 (FIG. 24). Of course, lateral heel plug 202 may be included in other examples of outsole 38. Lateral heel plug 202 may be configured to prevent or reduce premature wear in lateral heel region 204 of outsole 38. In some examples, lateral heel plug 202 may be formed of a first plug layer and a second plug layer, with one layer (e.g., the first plug layer) being configured to contact the ground surface and the other (e.g., the second plug layer) being positioned above, or cranial to, the plug layer adjacent the ground surface. In some examples, one or more additional layers may be included between the first and second plug layers, and/or lateral heel plug 202 may be formed of a single layer of material. In examples including a multi-layer lateral heel plug 202, one or more layers may have different material characteristics than one or more other layers. For example, the first plug layer (e.g., the lower plug layer) is formed of a material having a higher Shore A durometer, in some examples. In some specific examples, the first plug layer may have a Shore A durometer of between 35 and 95, while the second plug layer (e.g., the higher plug layer) may be softer and have a lower durometer, such as a Shore A durometer between 20 and 70. In one specific example, lateral heel plug 202 may include a high-wear rubber material on the bottom and a softer memory foam material above it (e.g., between the lower plug layer and the frame). In specific examples, each layer of lateral heel plug 202 may be between about 0.0625 inches and 0.125 inches thick.

In some examples, lateral heel plug 202 and/or one or more layers of lateral heel plug 202 is substantially non-compressible. Lateral heel plug 202 may be formed of any suitable materials, though in one specific example lateral heel plug 202 is formed of polyurethane. Lateral heel plug 202 may be any shape, but in some examples is substantially triangular. Lateral heel plug 202 may be selectively removable from outsole 38 in some examples. For example, lateral heel plug 202 may be configured to be removed from outsole 38 via a hook-and-loop fastener (e.g., Velcro®) or removable adhesive or cement, such as when lateral heel plug 202 is worn down. After removal of lateral heel plug 202, a new lateral heel plug 202 may be secured to outsole 38 in its place. In some examples, just a portion of lateral heel plug 202 is selectively removable, such as one plug layer being selectively removable from another plug layer in order to replace the selectively removable plug layer with a new plug layer. Lateral heel plug 202 may be, for example, between 2 mm and 20 mm thick.

Heel region 130 of outsole 38 is asymmetrical in some examples. For example, lateral heel region 204 may "roll up" from a ground surface under outsole 38 more than a medial heel region 206. In other words, an angle formed between outsole 38 and an underlying ground surface (e.g., heel angle 140 shown in FIG. 8) may be greater if measured with respect to lateral heel region 204 than if measured with respect to medial heel region 206. In a specific example, lateral heel region 204 forms a heel angle of between 5 and 35 degrees when outsole 38 is in use on a ground surface, at rest. Such configurations may result in lateral heel region 204 contacting the ground surface at a later point in time than does medial heel region 206, when a wearer of an article of footwear including outsole 38 is walking or striding on a ground surface. In other words, when a wearer is walking, outsole 38 may be contoured according to a frame to which it is coupled such that medial heel region 206 contacts the ground surface before lateral heel region 204.

Presently disclosed sole assemblies and articles of footwear may be configured to accommodate many different foot morphologies, including low arch, high arch, and average arch morphologies. Presently disclosed sole assemblies may be configured to allow for customization and design adjustments for individual need. For example, disclosed sole assemblies may be designed to accommodate wearers with low arch morphologies by lengthening the arch region of the footbed membrane and raising the arch region approximately 4-18 mm. Additionally or alternatively, disclosed footbed membranes may be widened, such as by adding about 2-6 mm under the fifth metatarsal head to accommodate the wearer rolling off the lateral forefoot area of the foot during the gait cycle. Additionally or alternatively, low arch morphology may be accommodated by moving the arch region of the footbed membrane towards the posterior end of the footwear by about 4-8 mm, such that at least some of the arch region is positioned under the navicular bone. Additionally or alternatively, the width of the footbed membrane and frame may be increased by about 4-8 mm on the medial side of the forefoot, adjacent and/or under the first metatarsal, such as to accommodate high arch morphology. Such adjustments may also be varied depending on the shoe size of the article of footwear, as will be appreciated by one of ordinary skill in the art. Additionally or alternatively, disclosed footbed membranes and frames may be customized to reduce over-pronation, to increase stability, to enhance performance, to prevent and/or treat metatarsalgia, sesamoiditis, and/or other pathologies, and/or to reduce ground reaction forces experienced by wearers of disclosed articles of footwear as they move. Advantageously, a wearer's foot may match the geometry of the footbed membrane and frame, both statically and dynamically.

Presently disclosed sole assemblies are specifically designed to achieve suspension of the wearer's foot and to provide comfort while accounting for the rigidity of the frame. For example, disclosed sole assemblies are configured to maintain a minimum distance between the edges of the wearer's foot and the perimeter of the frame, such as to prevent the wearer's foot from contacting the frame. In some examples, the width of the sole assembly may be increased more than would be expected. In a specific example, the width may be increased by about 3-4 mm on the inside (medial side of the sole assembly) and increased by about 4-5 mm on the outside (lateral side of the sole assembly). Additionally or alternatively, disclosed sole assemblies may be widened in the heel region to prevent the wearer's heel from contacting the frame. Such changes may be useful to accomplish total suspension and due to the use of a rigid frame, but would not be obvious design choices in a typical shoe. Disclosed articles of footwear may completely eliminate the use of foam or other compression materials. For example, disclosed sole assemblies may be provided without any foam within the frame cavity between the footbed membrane and the frame.

Figure 25:
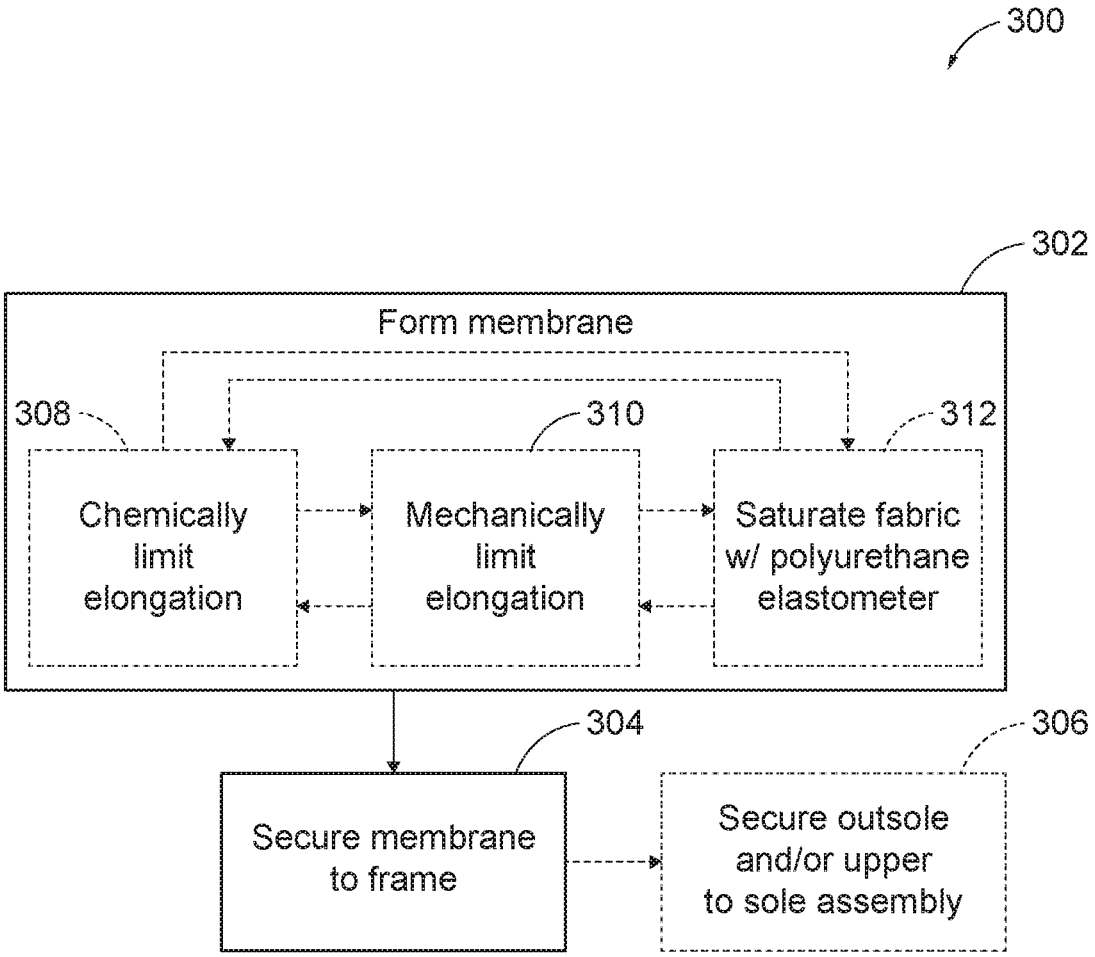
FIG. 25 is a schematic flowchart diagram illustrating methods of making sole assemblies according to the present disclosure.
Figure 27:
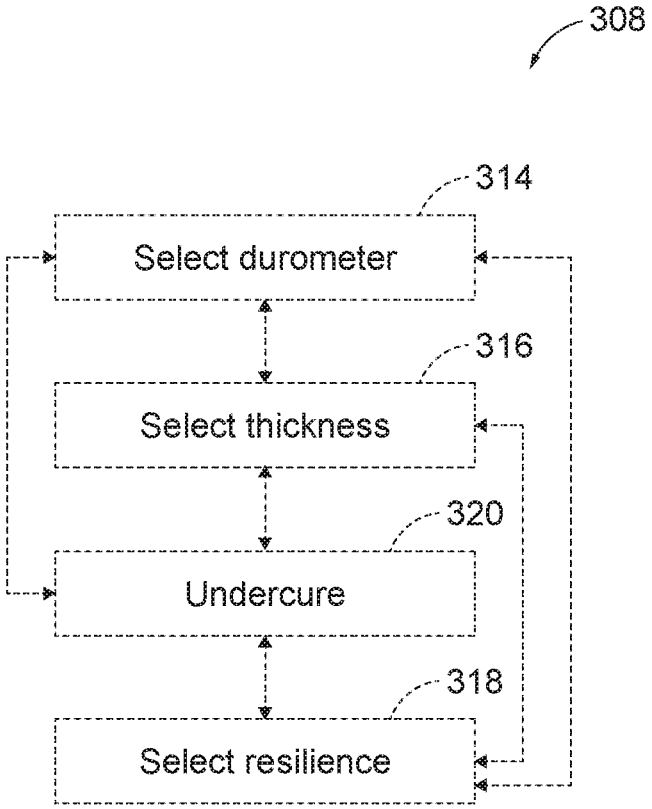
FIG. 27 is a schematic flowchart diagram illustrating methods of chemically limiting elongation in suspension membranes according to the present disclosure.
Figure 28:
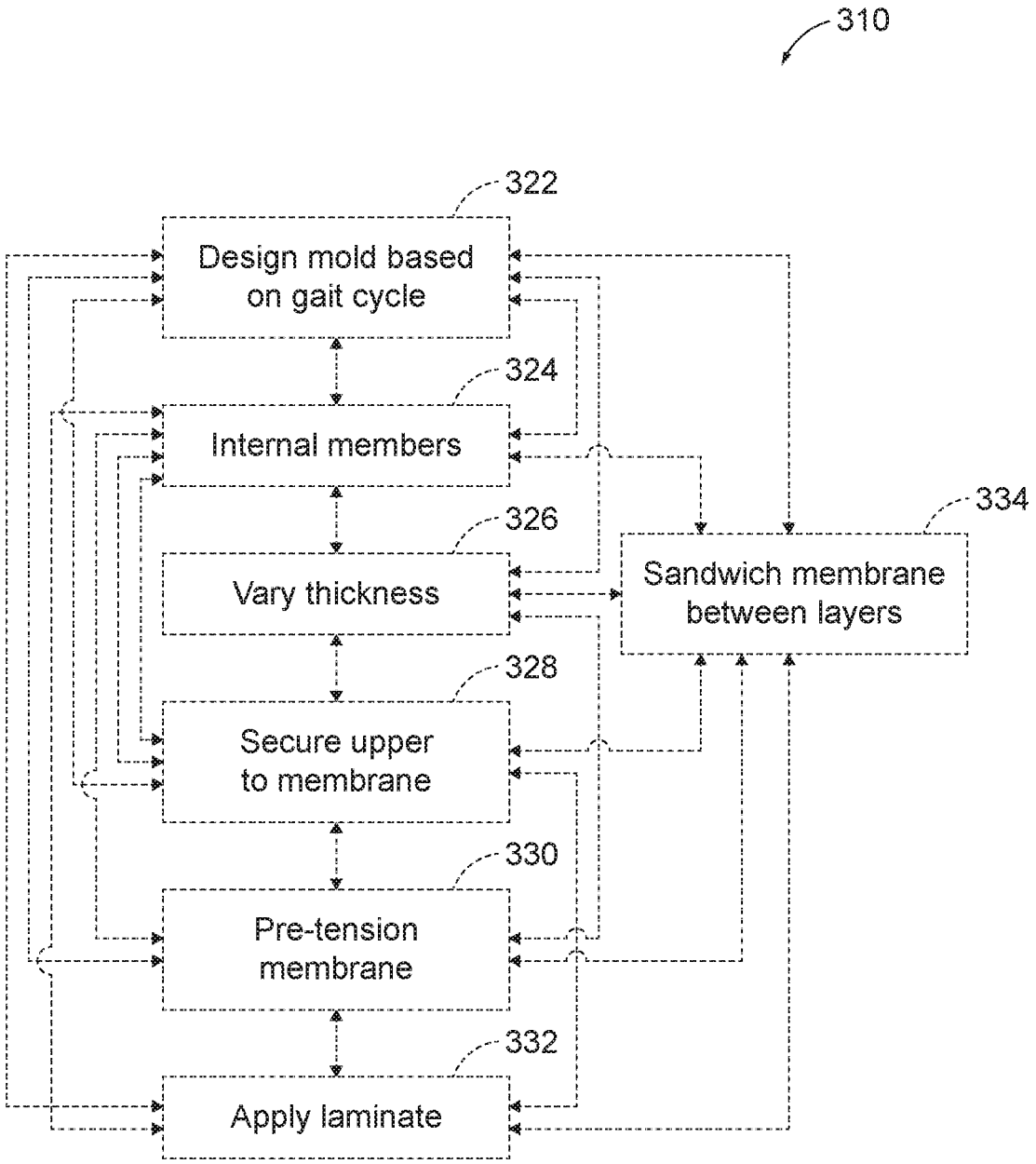
FIG. 28 is a schematic flowchart diagram illustrating methods of mechanically limiting elongation in suspension membranes according to the present disclosure.

Turning now to FIGS. 25, 27, and 28, schematic flowchart diagrams are provided that represent illustrative, non-exclusive examples of methods of forming footbed membranes 34, sole assemblies 30, and/or articles of footwear 32 according to the present disclosure. Some steps are illustrated in dashed boxes indicating that such steps may be optional or may correspond to an optional version of a method according to the present disclosure. That said, not all methods according to the present disclosure are required to include the steps illustrated in solid boxes. The methods and steps illustrated are not limiting and other methods and steps are within the scope of the present disclosure, including methods having greater than or fewer than the number of steps illustrated, as understood from the discussions herein.

FIG. 25 illustrates methods 300 of making an article that suspends a portion of a wearer's or user's body, such as an article of footwear (e.g., article of footwear 32). Such methods 300 of making an article generally include forming a suspension membrane (e.g., footbed membrane 34) at 302 and securing the suspension membrane to a rigid or semi-rigid frame (e.g., frame 36) to form an assembly (e.g., sole assembly 30) at 304. In examples of methods 300 where forming and securing the suspension membrane at 302, 304 relates to forming and securing a footbed membrane for an article of footwear, the method may include securing an upper (e.g., upper 144) and/or outsole (e.g., outsole 38) to the assembly at 306. While methods 300 may be performed to form other articles including suspension membranes in general, examples described herein are generally described in the context of forming footbed membranes, though it is to be understood that disclosed methods and steps described in this context are also applicable in forming other suspension membranes.

In some methods, the footbed membrane, frame, and/or outsole may be manufactured and/or sold separately from one another for individual incorporation into an article of footwear. In some examples, the sole assembly (e.g., a disclosed footbed membrane coupled to a disclosed frame) may be manufactured and/or sold separately (such as for use or insertion into an existing article of footwear, akin to an insole or orthotic device), while in some methods, the sole assembly may be sold already incorporated into an article of footwear (e.g., with an upper and/or outsole secured to the sole assembly).

Forming the suspension membrane at 302, which will hereafter be referred to as forming the footbed membrane at 302, may include molding the footbed membrane to conform to contours of a wearer's foot. Forming the footbed membrane at 302 generally includes configuring the footbed membrane to suspend the wearer's foot, such as by selecting materials and characteristics such that the footbed membrane has a limited elongation or stretch when loaded by a wearer (e.g., when the wearer is standing in an article of footwear including the footbed membrane, with the wearer's body weight being supported by the footbed membrane). In other words, forming the footbed membrane at 302 generally includes designing and forming the footbed membrane to interact with the frame such that the resulting sole assembly is configured to prevent contact between a lower membrane surface (e.g., lower membrane surface 43) of the footbed membrane and an upper frame side of the frame (e.g., upper frame side 56) when the footbed membrane is secured to the frame and weighted by a wearer's foot. Forming and/or designing the footbed membrane at 302 includes determining a desired thickness for one or more portions of the footbed membrane, in some examples. Forming the footbed membrane at 302 may include chemically limiting elongation in the footbed membrane at 308 and/or mechanically limiting elongation in the footbed membrane at 310. Details of chemically limiting elongation at 308 are discussed below in connection with FIG. 27, and details of mechanically limiting elongation at 310 are discussed below in connection with FIG. 28.

By controlling characteristics of the footbed membrane (or other suspension membrane) such as durometer, thickness, and/or material properties, chemically limiting elongation at 308, and/or mechanically limiting elongation at 310, the footbed membrane may be designed to have a maximum percentage of elongation in a given weighted configuration. In some examples, this maximum percentage of elongation is less than 15%, less than 10%, and/or less than 5%. Forming and/or designing the footbed membrane at 302 includes mapping a plurality of different portions of the footbed membrane having different thicknesses and/or durometers, in some examples.

Forming the footbed membrane at 302 includes injecting or pouring an elastomeric material into a mold and curing the elastomeric material, in some examples. Some methods include injecting or pouring two or more materials (e.g., different materials, and/or materials having different material properties) into a mold, such as into different areas of a mold, and/or to form different layers of the footbed membrane. For example, a first elastomeric material having a first durometer may be poured or injected into a first area of a mold, and a second elastomeric material having a second durometer may be poured or injected into a second area of the mold, thereby forming a footbed membrane having different durometers in different areas. Additionally or alternatively, forming the footbed membrane at 302 includes saturating a fabric material with a polyurethane elastomer at 312 in some specific examples.

In some examples, forming the footbed membrane at 302 includes coupling two or more layers together to form the footbed membrane. In some examples, layers may be coupled together such that one of the layers forms the upper membrane surface of the footbed membrane, and another of the layers forms the lower membrane surface of the footbed membrane. For example, a first layer having a first maximum percentage of elongation may be coupled to a second layer having a second maximum percentage of elongation. In specific examples, a layer having a lower maximum percentage of elongation may be positioned below (e.g., closer to a frame to which the footbed membrane is intended to be coupled) a layer having a higher maximum percentage of elongation. In some examples, two different layers of material may be coupled together to form the footbed membrane at 302. For example, a fabric layer may be coupled to an elastomeric polyurethane layer to form the footbed membrane at 302. In some examples, forming the footbed membrane at 302 includes laminating a layer to another layer, such as laminating a polyurethane elastomer to a layer of silicone. In some examples, layers or materials may be cemented to the primary structure of the footbed membrane in order to add or adjust desired properties.

Securing the footbed membrane to the frame at 304 generally includes coupling (e.g., bonding or adhering) a lower wall (e.g., lower wall 48) of the footbed membrane to an annular frame wall (e.g., annular frame wall 52) of the frame. In some examples, securing the footbed membrane to the frame at 304 includes engaging the lower wall of the footbed membrane with a lip formed on the annular frame wall (e.g., lip 66). The footbed membrane and frame may be secured together at 304 as best illustrated in FIGS. 4*b* and 4*c*, though other arrangements are also possible.

Securing the footbed membrane to the upper at 306 generally includes sewing the upper to the footbed membrane via the sew wall (e.g., sew wall 45) of the footbed membrane, such as by sewing through both the sew wall and the upper to secure the upper to the footbed membrane. In some examples, securing the footbed membrane to the upper at 306 includes cementing or adhering the upper to the footbed membrane, while in other examples, the upper is only attached via sewing to the sew wall, without any cementing or adhering. In examples where the footbed membrane is secured to the frame at 304 before the upper is secured to the footbed membrane at 306, securing the upper to the footbed membrane at 306 thus may be said to also be securing the upper to the frame, by virtue of the frame being secured to the footbed membrane to which the upper is secured.

Figure 26:
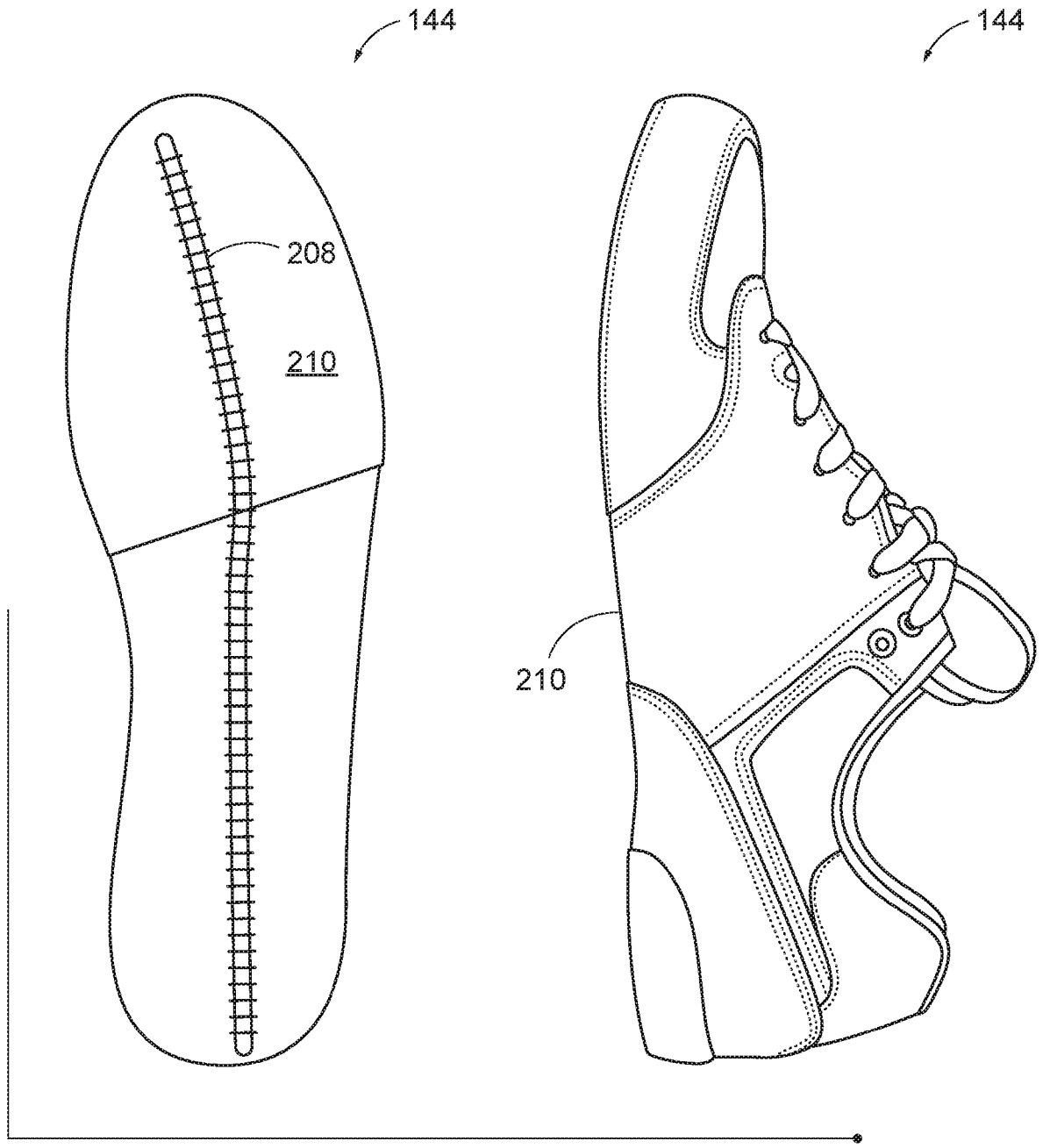
FIG. 26 is a schematic representation of an article of footwear made according to disclosed methods.

In some examples, securing the upper at 306 includes wrapping the upper around a last board, sewing the upper along a longitudinal seam on an underside of the upper, and removing the last board. For example, FIG. 26 schematically illustrates such a longitudinal seam 208 on an underside 210 of upper 144. In some examples, underside 210 of upper 144 may be wrapped around footbed membrane 34 such that underside 210 is adjacent the lower membrane surface of the footbed membrane. In these examples, at least part of the upper (e.g., underside 210) may be secured to, or with respect to, the lower membrane surface of the footbed membrane such that the underside of the upper is configured to resist elongation of the footbed membrane and provide further support to the wearer's foot.

FIG. 27 illustrates methods 308 of chemically limiting elongation in a suspension membrane such as presently disclosed footbed membranes, with said methods 308 being described in the context of footbed membranes. In other words, an elastomeric material may be selected and/or engineered at 308 to have one or more desired characteristics, to have a limited percentage of elongation, and/or to suspend a wearer's foot when the elastomeric material supports the wearer's foot. For example, the footbed membrane material(s) may be engineered and/or selected at 308 to limit elongation of the footbed membrane to less than 3%, less than 4%, less than 5%, less than 6%, less than 7%, less than 8%, less than 9%, less than 10%, less than 11%, less than 12%, less than 13%, less than 14%, less than 15%, and/or less than 20%. In some cases, elongation of the footbed membrane may be defined by an amount of stretch per area of footbed membrane per force experienced, at a given temperature. Methods 308 generally include controlling elongation of the footbed membrane and/or energy return rates of the footbed membrane by varying a chemistry of the footbed membrane through pre-polymers, curatives, stoichiometry, additives, and/or processing. In some examples, the chemistry of the footbed membrane may be varied by varying the ratio of A side to B side (e.g., varying the ratio of resin to pre-polymer, or varying the ratio of resin to polymer), using different resins, using different pre-polymers having different properties and/or polymeric lengths, changing reaction speeds via catalytic agents and/or curative agents, producing different durometer materials, co-curing various layers of the footbed membrane with different durometers for chemical bonding, changing cure time of the footbed membrane, changing cure temperatures of the footbed membrane, and/or co-curing one or more layers with pre-cured matrices that are configured to control or limit elongation of the footbed membrane.

Methods 308 may include selecting the durometer of the material or materials used to form the footbed membrane, at 314. Selecting the durometer at 314 may include forming a footbed membrane with different durometers in different areas or regions of the footbed membrane. Additionally or alternatively, methods 308 may include selecting the thickness of the material or materials used to form the footbed membrane, at 316. Selecting the thickness at 316 may include forming a footbed membrane with different thicknesses in different areas or regions of the footbed membrane. Additionally or alternatively, methods 308 may include selecting the resilience and/or rebound rate of the material or materials used to form the footbed membrane, at 318. Selecting the resilience and/or rebound rate at 318 may include forming a footbed membrane with different resilience and/or rebound rates in different areas or regions of the footbed membrane. In some examples, methods 308 include undercuring an elastomeric material at 320, such as to increase cross-reactions between polymeric chains in the material(s) forming the footbed membrane. As used herein, a material is said to be "undercured" if it is prevented from fully hardening or reacting. For example, one layer may be secured to another layer before one or both of the layers has fully cured, thereby allowing the layers to co-cure and chemically bond during curing. Additionally or alternatively, one or more layers with desired properties may be applied in a "green" state, in which the layer is partially cured. For example, a layer in its green state may be applied to a primary substrate, and/or a layer may be applied to a primary substrate when the substrate is in a green state, and then the layers may be cured and bonded.

Methods 308 may include altering the chemistry of the elastomeric material used to form the footbed membrane, such as to create different properties for different applications for the elastomeric material. For example, footbed membranes having different properties may be created or configured for different shoe sizes, different weights of users, and/or different activities. Some methods 308 include controlling a load-deformation profile of the footbed membrane, such as by varying material properties in various regions of the footbed membrane.

FIG. 28 illustrates methods 310 of mechanically limiting elongation in a suspension membrane, such as presently disclosed footbed membranes, with said methods 310 being described in the context of footbed membranes. For example, methods 310 may include forming a mold to form the footbed membrane at 322, with the mold being optimized based on a wearer's gait, such that the footbed membrane is configured to support the wearer's foot during the gait cycle. Additionally or alternatively, methods 310 may include positioning, forming, and/or inserting one or more internal members (e.g., internal members 97) within or on the footbed membrane to limit elongation of the footbed membrane, at 324. For example, incorporating internal members at 324 may include incorporating a cable, a thread, a wire, and/or a string at least partially into at least a portion of the footbed membrane. The internal members may be shaped to limit elongation of an elastomeric material into which they are incorporated, and/or the material properties of the internal members may limit elongation of the elastomeric material. In some examples, incorporating internal members at 324 includes at least partially embedding one or more internal members within an elastomeric material used to form the footbed membrane. The internal members incorporated at 324 may form a coil, a helix, a zig-zag, and/or a wavy pattern within or on the elastomeric material of the footbed membrane. Such internal members may be configured to resiliently deform when the footbed membrane is weighted or deformed.

Methods 310 may include varying the thickness of the footbed membrane at 326, such as tapering one or more portions of the footbed membrane to limit elongation of the footbed membrane. A load-deformation profile of the footbed membrane may be controlled, such as by varying the cross-sectional shape in various regions of the footbed membrane at 326. Additionally or alternatively, methods 310 may include securing an upper to the footbed membrane at 328 in such a way that the upper is configured to limit elongation of the footbed membrane. For example, securing an upper to the footbed membrane at 328 may include positioning a portion of the upper underneath the footbed membrane. Additionally or alternatively, methods 310 may include pre-tensioning the footbed membrane at 330, when assembling the footbed membrane together with other components. For example, a footbed membrane may be pre-tensioned when it is secured to a frame, thereby forming a sole assembly according to the present disclosure, with the pre-tensioning being configured to limit elongation of the footbed membrane.

Methods 310 additionally or alternatively include applying a laminate covering to the footbed membrane at 332, with the laminate covering being configured to limit elongation of the footbed membrane. For example, the laminate covering may be formed from a non-elastomeric material, and/or may have a lower percentage of elongation than other materials used in forming the footbed membrane. Some methods 310 include sandwiching a footbed membrane between one, two, or more other layers at 334. For example, a footbed membrane may be sandwiched between two layers having a higher durometer and/or less elongation than does the footbed membrane, at 334.

In addition to being incorporated into articles of footwear 32, presently disclosed frames 36 and footbed membranes 34 may be formed into generalized frames and suspension membranes for other applications. For example, a motorcycle or bicycle seat may be formed from a suspension membrane and a frame, similar to disclosed footbed membranes 34 and frames 36. The suspension membrane generally includes a contoured upper membrane surface configured to support a rider's pelvis, a lower membrane surface opposite the upper membrane surface, wherein the lower membrane surface is contoured to correspond to the upper membrane surface, a sew wall projecting away from the upper membrane surface and extending around a membrane perimeter of the upper membrane surface and a lower wall projecting away from the lower membrane surface and extending around a membrane perimeter of the lower membrane surface. The frame generally includes an annular frame wall that extends around a frame perimeter of an upper frame side of the frame and projects away from the upper frame side. When the bicycle seat is assembled, the annular frame wall is arranged with respect to the upper frame side such that a frame cavity is defined by the upper frame side and an inner wall side of the annular frame wall, wherein the suspension membrane is coupled to the frame by securing the lower wall to the annular frame wall such that the lower membrane surface faces the frame cavity. Similar to disclosed footbed membranes 34 being configured to suspend a wearer's foot above frame cavity 60, the suspension membrane for the bicycle seat may be configured to prevent contact between the lower membrane surface and the upper frame side when the bicycle seat is weighted by a rider, thereby supporting the rider's pelvis while riding the bicycle. Similar to footbed membranes being configured to reduce ground reaction forces experienced by a wearer's feet, suspension membranes positioned in bicycle seats may be configured to reduce tendency to restrict blood flow in the rider's pelvis and compress sensitive and vital nerves. Suspension membranes formed of soft elastomers may also be configured to reduce vibration and separate the rider's body from vibrations as well.

In another example, a suspension membrane and annular frame may be incorporated into a ballet pointe shoe. For example, an elastomer sleeve may be attached to the top or lip of the cup of the pointe shoe, thereby suspending the dancer's toe above the cup, in accordance with concepts presently disclosed. In a conventional ballet pointe shoe, the dancer elevates himself or herself to a completely extended position with the dancer's foot entirely loading the joints and toes—in such a position, the dancer balances on a cup hidden between layers of fabric in the forefoot of the pointe shoe. Such a cup may be slightly narrower than the apex of the first metatarsal head to the fifth metatarsal head, so that the cup potentially unloads the toes of the dancer. However, a lip of the cup often cuts into the joints of the first and fifth metatarsals, thus injuring the dancer. In presently disclosed examples, the cup may be replaced by a frame as disclosed above with an elastomer sleeve attached to the top of the frame. The elastomer sleeve may be slightly smaller than the anatomy of the forefoot of the dancer, and be configured to suspend the dancer off the surface of the floor.

In another example, a high heel shoe may include a footbed membrane 34 and frame 36 as disclosed herein, except that rather than suspending substantially the entire foot of the wearer, only one or more portions of the wearer's foot may be suspended by the footbed membrane. For example, a disclosed high heel shoe may incorporate a suspension membrane within a forefoot region (which may be referred to as a "cassette") of the high heel shoe. Additionally or alternatively, a disclosed high heel shoe may incorporate a suspension membrane within a heel region of the high heel shoe. In some examples, the suspension membrane is absent in the midfoot region of the high heel shoe. Thus, in some examples, just the wearer's forefoot and/or heel may be suspended in the high heel shoe. In other examples, a high heel shoe, such as a platform heel shoe, may include disclosed suspension membranes along substantially the entire length of the shoe. Such footbed membranes 34 and frames 36 as incorporated into a high heel shoe may be configured to minimize ground reaction forces for wearers of the shoe, especially in the area of the forefoot, where wearers of high heel shoes often experience the greatest loads for the greatest period of time.

In examples where disclosed footbed membranes and frames are used to suspend the forefoot region of the wearer's foot (and not the heel), securement of the forefoot portion of the shoe to the remainder of the shoe may be accomplished in a number of ways. In one example, the forefoot portion may overlap with a board (e.g., if the heel and/or midfoot regions are board lasted) by at least 3-6 mm, to provide an adequate surface area for cementing the forefoot portion to the rest of the shoe. In another example, the frame of the forefoot portion may overlap slightly and interlock with the rest of the shoe (e.g., using tabs and slots), to be secured to the remainder of the shoe.

Disclosed high heel shoes may include a forefoot angle (e.g., forefoot angle 142) to facilitate a natural gait cycle for the wearer, in view of the rigid nature of the frame of disclosed sole assemblies. In some examples, the angle of the forefoot angle may be adjusted (e.g., increased or decreased) according to heel height. For example, as the heel height increases, the forefoot angle of the high heeled shoe also may be increased, and as the heel height is decreased, the forefoot angle of the high heeled shoe also may be decreased.

Aesthetic concerns may be taken into account when incorporating disclosed suspension membranes into a high heel shoe. For example, a relatively thin platform may be used in the forefoot region of the shoe to incorporate disclosed suspension membranes and frames, without significantly impacting the outward design or appearance of the shoe, in some cases. Disclosed high heel shoes may be made using slip last, California last, or over-lasting construction. Additionally or alternatively, high heeled shoes including presently disclosed sole assemblies may be constructed using a sew wall (e.g., sew wall 45) for securing the upper to the footbed membrane, as described above in connection with other examples. In some examples, the heel and midfoot regions of a high heeled shoe may be board lasted. As opposed to conventional cushioning elements that may be separated from the wearer's foot through multiple layers and/or by being embedded in foam, disclosed suspension membranes may be incorporated into shoes in such a way that the support is more apparent to the wearer, and/or such that the wearer's foot is in contact with, or only separated by one layer of material from, the suspension membrane, in some examples.

Examples of articles of footwear, sole assemblies, footbed membranes, and frames according to the present disclosure are described in the following enumerated paragraphs:

A1. A frame for an article of footwear, the frame comprising:

a rocker bottom comprising:

a lower frame side; and an upper frame side opposite the lower frame side; and an annular frame wall that extends around a frame perimeter of the upper frame side and projects away from the upper frame side, wherein the annular frame wall is arranged with respect to the rocker bottom such that a frame cavity is defined by the upper frame side and an inner wall side of the annular frame wall.

A1.1. The frame of paragraph A1, wherein the frame is a rigid frame.

A2. The frame of paragraph A1 or A1.1, wherein the annular frame wall is integrally formed with the rocker bottom.

A3. The frame of any of paragraphs A1-A2, wherein the annular frame wall comprises an outer wall side opposite the inner wall side.

A4. The frame of any of paragraphs A1-A3, wherein the frame comprises a lip at an intersection of the rocker bottom and the annular frame wall.

A5. The frame of paragraph A4, wherein the lip is formed adjacent a/the outer wall side of the annular frame wall.

A6. The frame of any of paragraphs A1-A5, wherein the frame is rigid or semi-rigid.

A7. The frame of any of paragraphs A1-A6, wherein the frame is configured to reduce or prevent flexion of the frame during a gait cycle of a wearer of the article of footwear.

A8. The frame of any of paragraphs A1-A7, wherein the frame is configured to propel a/the wearer of the article of footwear forward during a/the gait cycle.

A9. The frame of any of paragraphs A1-A8, wherein the frame is configured to allow normal movement through a gait phase of a/the wearer of the article of footwear.

A10. The frame of any of paragraphs A1-A9, wherein the frame is configured to maximize support of a wearer's foot.

A11. The frame of any of paragraphs A1-A10, wherein the annular frame wall has a wall height defined as the vertical distance between a respective point on an upper wall surface of the annular frame wall and a corresponding respective point on a/the lip of the rocker bottom.

A12. The frame of paragraph A11, wherein the wall height is substantially constant along the entire annular frame wall.

A13. The frame of paragraph A11, wherein the wall height is variable along the annular frame wall.

A14. The frame of paragraph A11 or A13, wherein the wall height results in more or less support in different areas of the frame, as a result of variations in the wall height.

A15. The frame of any of paragraphs A1-A14, wherein the rocker bottom comprises one or more apertures extending from the upper frame side to the lower frame side.

A15.1. The frame of paragraph A15, wherein at least one of the one or more apertures is positioned within a forefoot region of the frame.

A15.2. The frame of any of paragraphs A15-A15.1, wherein at least one of the one or more apertures is positioned within a heel region of the frame.

A15.3. The frame of any of paragraphs A15-A15.2, wherein at least a portion of a midfoot region of the frame is free from any apertures.

A15.4. The frame of any of paragraphs A15-A15.3, wherein the one or more apertures are configured to increase flexibility of the rocker bottom.

A15.5. The frame of any of paragraphs A15-A15.4, wherein the one or more apertures are configured to minimize a weight or mass of the rocker bottom.

A15.6. The frame of any of paragraphs A15-A15.5, wherein the one or more apertures comprise a first plurality of apertures positioned within a/the forefoot region of the frame and a second plurality of apertures positioned within a/the heel region of the frame.

A15.7. The frame of any of paragraphs A15-A15.6, wherein the one or more apertures are arranged such that a respective longitudinal axis of each respective aperture is substantially transverse to a longitudinal axis of the rocker bottom.

A15.8. The frame of any of paragraphs A15-A15.7, wherein the one or more apertures are one or more of oval, elliptical, circular, slot-shaped, and polygonal.

A15.9. The frame of any of paragraphs A15-A15.8, wherein the one or more apertures are formed through the rocker bottom without intersecting the annular frame wall.

A16. The frame of any of paragraphs A1-A15.9, wherein the frame comprises one or more wall holes formed through the annular frame wall, extending from the inner wall side to an/the outer wall side of the annular frame wall.

A16.1. The frame of paragraph A16, wherein at least one of the one or more wall holes is positioned within a/the forefoot region of the frame.

A16.2. The frame of any of paragraphs A16-A16.1, wherein at least one of the one or more wall holes is positioned within a/the heel region of the frame.

A16.3. The frame of any of paragraphs A16-A16.2, wherein at least one of the one or more wall holes is positioned within a/the midfoot region of the frame.

A16.4. The frame of any of paragraphs A16-A16.3, wherein the one or more wall holes are positioned within a/the midfoot region of the frame, while a/the heel region of the frame and a/the forefoot region of the frame are free from wall holes.

A16.5. The frame of any of paragraphs A16-A16.4, wherein the one or more wall holes are one or more of oval, elliptical, circular, slot-shaped, and polygonal.

A16.6. The frame of any of paragraphs A16-A16.5, wherein at least one of the one or more wall holes are formed within a lateral portion of the annular frame wall.

A16.7. The frame of any of paragraphs A16-A16.6, wherein at least one of the one or more wall holes are formed within a medial portion of the annular frame wall.

A17. The frame of any of paragraphs A1-A16.7, wherein the frame comprises one or more support braces.

A18. The frame of paragraph A17, wherein the one or more support braces are positioned adjacent the upper frame side and the inner wall side of the annular frame wall, thereby supporting the annular frame wall with respect to the rocker bottom.

A19. The frame of paragraph A17 or A18, wherein the one or more support braces are spaced apart around at least a portion of the frame perimeter of the upper frame side.

A19.1 The frame of any of paragraphs A17-A19, wherein at least a first support brace of the one or more support braces extends across at least a majority of a width of the rocker bottom.

A19.2. The frame of any of paragraphs A17-A19.1, wherein at least a second support brace of the one or more support braces extends across less than the majority of a/the width of the rocker bottom.

A20. The frame of any of paragraphs A1-A19.2, wherein the frame comprises one or more support pillars.

A21. The frame of paragraph A20, wherein at least one of the one or more support pillars extends across a respective wall hole formed in the annular frame wall.

A22. The frame of paragraph A20 or A21, wherein at least one of the one or more support pillars is positioned within a/the medial portion of the annular frame wall.

A23. The frame of any of paragraphs A20-A22, wherein the frame comprises at least two, at least three, at least four, and/or at least five support pillars extending across a/the wall hole formed within a/the medial portion of the annular frame wall.

A24. The frame of any of paragraphs A20-A23, wherein the frame comprises at least one support pillar extending across a/the wall hole formed within a/the lateral portion of the annular frame wall.

A25. The frame of any of paragraphs A20-A24, wherein a greater number of support pillars are positioned to extend across a respective wall hole formed within a/the medial portion of the annular frame wall than are positioned to extend across a respective wall hole formed within a/the lateral portion of the annular frame wall.

A26. The frame of any of paragraphs A20-A25, wherein at least one of the support pillars includes a corresponding support brace positioned adjacent both the respective support pillar and the upper frame side of the rocker bottom.

A27. The frame of any of paragraphs A1-A26, wherein the frame is configured to extend along substantially an entire length of a/the wearer's foot.

A28. The frame of any of paragraphs A1-A27, wherein the frame comprises a rigid plastic, a ceramic, a composite (e.g., a composite fiber reinforced polymer), an elastomeric polyurethane, a high-glassed polyurethane, a carbon graphite, and/or a graphite.

A29. The frame of any of paragraphs A1-A28, wherein the frame is designed to facilitate a/the gait cycle of a/the wearer of the article of footwear.

A30. The frame of any of paragraphs A1-A29, wherein a/the heel region of the frame ramps up by at least 10 degrees, by at least 15 degrees, by at least 20 degrees, by at least 25 degrees, by at least 30 degrees, by at least 35 degrees, and/or by at least 40 degrees.

A31. The frame of any of paragraphs A1-A30, wherein a/the forefoot region of the frame ramps up by at least 10 degrees, by at least 15 degrees, by at least 20 degrees, by at least 25 degrees, by at least 30 degrees, by at least 35 degrees, and/or by at least 40 degrees.

A32. The frame of any of paragraphs A1-A31, wherein a first ramp-up angle of a/the heel region of the frame is greater than a second ramp-up angle of a/the forefoot region of the frame.

A33. The frame of any of paragraphs A1-A32, wherein the rocker bottom is configured to function as a see-saw or lever in use.

A34. The frame of any of paragraphs A1-A33, wherein the rocker bottom comprises one or more prominences extending from the lower frame side, wherein the one or more prominences are configured to provide stability for standing and static use of the article of footwear.

B1. A footbed membrane for an article of footwear, the footbed membrane comprising:

an upper membrane surface configured to support a wearer's foot;

a lower membrane surface opposite the upper membrane surface; and a lower wall projecting away from the lower membrane surface and extending around a membrane perimeter of the lower membrane surface.

B1.1 The footbed membrane of paragraph B1, further comprising a sew wall projecting away from the upper membrane surface and extending around the membrane perimeter, wherein the membrane perimeter also is a perimeter of the upper membrane surface.

B1.2. The footbed membrane of paragraph B1 or B1.1, wherein the upper membrane surface is contoured to correspond to the shape of the wearer's foot.

B1.3. The footbed membrane of any of paragraphs B1-B.2, wherein the lower membrane surface is contoured to correspond to the upper membrane surface.

B2. The footbed membrane of any of paragraphs B1-B1.3, wherein the upper membrane surface, the lower membrane surface, a/the sew wall, and/or the lower wall are integrally formed with each other.

B3. The footbed membrane of any of paragraphs B1-B2, wherein the upper membrane surface, the lower membrane surface, a/the sew wall, and/or the lower wall are formed of a single material.

B4. The footbed membrane of any of paragraphs B1-B3, wherein a/the sew wall and the lower wall are substantially parallel to one another.

B4.1. The footbed membrane of any of paragraphs B1-B4, wherein a first outer surface of a/the sew wall and a second outer surface of the lower wall are substantially co-planar with one another.

B5. The footbed membrane of any of paragraphs B1-B4.1, wherein the footbed membrane is configured to be operably coupled to a frame and suspend the wearer's foot above the frame.

B5.1. The footbed membrane of any of paragraphs B1-B5, wherein the footbed membrane is configured to be operably coupled to the frame of any of paragraphs A1-A34 and suspend the wearer's foot above the frame.

B5.2. The footbed membrane of any of paragraphs B1-B5.1, wherein the footbed membrane is configured to have a maximum elongation in response to a force applied to the upper membrane surface.

B5.3. The footbed membrane of any of paragraphs B1-B5.2, wherein the footbed membrane is configured to stretch in a controlled manner in response to a/the force applied to the upper membrane surface.

B5.4. The footbed membrane of any of paragraphs B1-B5.3, wherein the footbed membrane has a linear load curve spring rate in response to a/the force applied to the upper membrane surface.

B5.5. The footbed membrane of any of paragraphs B1-B5.4, wherein the footbed membrane has a non-linear load response to a/the force applied to the upper membrane surface.

B5.6. The footbed membrane of any of paragraphs B1-B5.5, wherein the footbed membrane is configured to resiliently deform in response to a load applied to the upper membrane surface of the footbed membrane by the wearer's foot, wherein the footbed membrane is configured to store energy as a result of the resilient deformation, and wherein the footbed membrane is further configured to return the stored energy back to the wearer's foot when the wearer lifts the wearer's foot, thereby removing the load from the footbed membrane.

B5.7. The footbed membrane of any of paragraphs B1-B5.6, wherein the footbed membrane is configured to exhibit a substantially linear modulus of elasticity until elongation of the footbed membrane reaches an elastic limit, at which point elongation of the footbed membrane stops.

B6. The footbed membrane of any of paragraphs B1-B5.7, wherein a/the sew wall is configured to be attached to an upper of the article of footwear and allow for flexion of the upper at an interface where the upper is attached to the sew wall.

B7. The footbed membrane of any of paragraphs B1-B6, wherein a thickness of the footbed membrane is defined by the vertical distance between the upper membrane surface and the lower membrane surface.

B8. The footbed membrane of any of paragraphs B1-B7, wherein the footbed membrane has substantially uniform material properties and/or cross-sectional shape.

B8.1 The footbed membrane of any of paragraphs B1-B8, wherein the footbed membrane has zone-specific material properties and/or cross-sectional shape.

B8.2. The footbed membrane of any of paragraphs B1-B8.1, wherein the footbed membrane has load-specific material properties and/or cross-sectional shape.

B8.3. The footbed membrane of any of paragraphs B1-B8.2, wherein a/the thickness of the footbed membrane varies to accommodate varying support needs at different locations.

B8.4. The footbed membrane of any of paragraphs B1-B8.3, wherein a/the thickness of the footbed membrane within a midfoot region of the footbed membrane is at least 0.5 millimeters (mm) thicker, at least 1 mm thicker, at least 2 mm thicker, and/or at least 3 mm thicker than in a heel region of the footbed membrane.

B9. The footbed membrane of any of paragraphs B1-B8.4, wherein a durometer of the footbed membrane varies to accommodate varying projected forces experienced by the footbed membrane when weighted by the wearer.

B9.1. The footbed membrane of any of paragraphs B1-B9, wherein the footbed membrane has a first durometer within a/the heel region and a second durometer within a/the midfoot region, wherein the first durometer is less than the second durometer.

B10. The footbed membrane of any of paragraphs B1-B9.1, wherein the footbed membrane comprises a first layer forming the upper membrane surface and a second layer forming the lower membrane surface.

B11. The footbed membrane of paragraph B10, wherein the first layer and the second layer are adhered together.

B12. The footbed membrane of paragraph B10 or B11, wherein the first layer and the second layer are cured or laminated together.

B13. The footbed membrane of any of paragraphs B10-B12, wherein the first layer and the second layer are configured to have different material properties in at least one of thickness, elongation, durometer, resilience, UV light resistance, abrasion resistance, and tensile strength.

B13.1. The footbed membrane of any of paragraphs B10-B13, wherein the first layer has a higher percentage of elongation than the second layer.

B13.2. The footbed membrane of any of paragraphs B10-B13.1, wherein a percentage difference in durometer between the first layer and the second layer is at least 10%, at least 20%, at least 30%, at least 40%, and/or at least 50%.

B13.3. The footbed membrane of any of paragraphs B10-1313.2, wherein the first layer has a lower durometer than that of the second layer.

B14. The footbed membrane of any of paragraphs B1-B13.3, wherein the footbed membrane comprises a plurality of layers.

B14.1. The footbed membrane of paragraph B14, wherein the plurality of layers comprises an elastomer of polyurethane sandwiched between a/the first layer and a/the second layer.

B14.2. The footbed membrane of any of paragraphs B10-1314.1, wherein a/the first layer comprises a first material, wherein a/the second layer comprises a second material, and wherein the first material is different from the second material.

B14.3. The footbed membrane of any of paragraphs B10-B14.2, wherein a/the first layer comprises a secondary membrane, a mesh, a net, cabling, and/or an elastomeric layer, wherein the first layer is positioned below, within, or above a/the second layer, and wherein the first layer is configured to prevent elongation of the second layer beyond a predetermined limit.

B15. The footbed membrane of any of paragraphs B10-B14.3, wherein a/the first layer comprises an elastomer and a/the second layer comprises a fabric.

B16. The footbed membrane of any of paragraphs B10-B15, wherein a/the first layer and/or a/the second layer comprises a polyurethane elastomer.

B16.1. The footbed membrane of any of paragraphs B10-B16, wherein a/the first layer and/or a/the second layer are positioned regionally in various portions of the footbed membrane.

B16.2. The footbed membrane of any of paragraphs B10-B16.1, wherein a/the first layer and/or a/the second layer are positioned and configured to provide greater support in an/the arch region of the footbed membrane than in one or more other regions of the footbed membrane.

B17. The footbed membrane of any of paragraphs B1-B16.2, wherein the footbed membrane comprises a first material impregnated with an elastomer.

B18. The footbed membrane of any of paragraphs B1-B17, wherein the footbed membrane comprises a first material impregnated with a polyurethane elastomer.

B19. The footbed membrane of any of paragraphs B1-B18, wherein the footbed membrane comprises a low modulus fabric impregnated with a polyurethane or other elastomer.

B20. The footbed membrane of any of paragraphs B1-B19, wherein a/the first layer and/or a/the second layer of the footbed membrane comprises silicone.

B21. The footbed membrane of any of paragraphs B1-B20, wherein the footbed membrane comprises a laminate covering coupled to the upper membrane surface.

B22. The footbed membrane of paragraph B21, wherein the laminate covering is configured to have a maximum percentage elongation of less than 85%, less than 50%, less than 25%, less than 10%, and/or less than 5%.

B23. The footbed membrane of any of paragraphs B21-B22, wherein the laminate covering is configured to provide an inert or comfortable contact with the wearer's foot.

B24. The footbed membrane of any of paragraphs B1-B23, wherein the footbed membrane comprises a solid elastomer.

B25. The footbed membrane of any of paragraphs B1-B24, wherein the footbed membrane is a non-mesh material.

B26. The footbed membrane of any of paragraphs B1-B25, wherein the footbed membrane comprises a shape memory alloy.

B27. The footbed membrane of any of paragraphs B1-B26, wherein the footbed membrane is contoured to support the wearer's foot throughout a gait cycle.

B28. The footbed membrane of any of paragraphs B1-B27, wherein the footbed membrane comprises Kevlar, Vectran, a Vectran hybrid polyester, an elastomeric polyester, Dyneema, Ultrasuede, elastomeric polyurethane, and/or silicone.

B29. The footbed membrane of any of paragraphs B1-B28, wherein a/the sew wall has a sew wall height defined as the vertical distance between a respective point on an upper sew wall surface of the sew wall and the upper membrane surface.

B30. The footbed membrane of paragraph B29, wherein the sew wall height is substantially constant along the entire sew wall.

B31. The footbed membrane of paragraph B29, wherein the sew wall height is variable along the sew wall.

B32. The footbed membrane of any of paragraphs B29-B31, wherein the sew wall height is at least 5 mm, at least 10 mm, and/or at least 15 mm.

B33. The footbed membrane of any of paragraphs B29-B32, wherein the sew wall has a Shore A durometer of 50-90.

B34. The footbed membrane of any of paragraphs B1-B33, wherein the footbed membrane comprises a plurality of membrane apertures formed in the footbed membrane, with the membrane apertures extending from the upper membrane surface to the lower membrane surface.

B35. The footbed membrane of paragraph B34, wherein the plurality of membrane apertures are spaced apart from each other.

B36. The footbed membrane of any of paragraphs B34-B36, wherein at least some of the plurality of membrane apertures are formed in a forefoot region of the footbed membrane.

B37. The footbed membrane of any of paragraphs B34-B36, wherein at least some of the plurality of membrane apertures are formed in a/the midfoot region of the footbed membrane.

B38. The footbed membrane of any of paragraphs B34-B37, wherein at least some of the plurality of membrane apertures are formed in a/the heel region of the footbed membrane.

B39. The footbed membrane of any of paragraphs B1-B38, further comprising one or more internal members positioned, formed, and/or inserted within or on the footbed membrane, wherein the one or more internal members are configured to limit elongation of the footbed membrane in a longitudinal direction corresponding to a length of the wearer's foot.

B40. The footbed membrane of paragraph B39, wherein the internal members comprise a cable, a thread, a wire, and/or a string.

B41. The footbed membrane of any of paragraphs B39-B40, wherein the internal members are at least partially embedded within the footbed membrane.

B42. The footbed membrane of any of paragraphs B39-B41, wherein the internal members form a coil, a helix, a zig-zag, and/or a different wavy pattern within or on the footbed membrane.

B43. The footbed membrane of any of paragraphs B39-B42 wherein the internal members are configured to resiliently deform.

B44. The footbed membrane of any of paragraphs B1-B43, wherein the footbed membrane comprises a plurality of ribs extending at least partially across a width of the footbed membrane, wherein the plurality of ribs project away from the lower membrane surface.

B45. The footbed membrane of paragraph B44, wherein the plurality of ribs are integrally formed with the lower membrane surface.

B46. The footbed membrane of paragraph B44 or B45, wherein the sole assembly is configured to prevent contact between the plurality of ribs and a/the upper frame side of a/the frame when the upper membrane surface is suspending the wearer's foot above the upper frame side.

B47. A plurality of footbed membranes according to any of paragraphs B1-B46, wherein a first footbed membrane of the plurality of footbed membranes is customized for a first shoe size, wherein a second footbed membrane of the plurality of footbed membranes is customized for a second shoe size, and wherein the first footbed membrane differs from the second footbed membrane in at least one of durometer, thickness, elongation, and tensile strength.

B48. The plurality of footbed membranes according to paragraph B47, wherein the first shoe size is larger than the second shoe size, wherein the first footbed membrane is configured to suspend a foot of a heavier wearer than the second footbed membrane is configured to suspend.

C1. A sole assembly for an article of footwear, the sole assembly comprising:

the frame of any of paragraphs A1-A34; and the footbed membrane of any of paragraphs B1-1346, wherein the footbed membrane is configured to engage the frame, thereby forming the sole assembly.

C2. The sole assembly of paragraph C1, wherein the footbed membrane is adhered to the frame.

C3. The sole assembly of any of paragraphs C1-C2, wherein the frame is configured to interact with the footbed membrane.

C4. The sole assembly of any of paragraphs C1-C3, wherein the frame is configured to control the topography of the footbed membrane, via the annular frame wall.

C5. The sole assembly of any of paragraphs C1-C4, wherein the annular frame wall is configured to pull the footbed membrane taut.

C6. The sole assembly of any of paragraphs C1-05, wherein the footbed membrane is configured to be operably coupled to the frame and suspend the wearer's foot above the frame cavity.

C7. The sole assembly of any of paragraphs C1-C6, wherein a/the sew wall is configured to allow for flexion of an/the upper of the article of footwear at an/the interface where the upper is attached to the sew wall of the footbed membrane.

C8. The sole assembly of any of paragraphs C1-C7, wherein the footbed membrane is adhered to the frame but is not adhered to an/the upper of the article of footwear.

C9. The sole assembly of any of paragraphs C1-C8, wherein a first height of the lower wall of the footbed membrane is less than or equal to a second height of the annular frame wall of the frame.

C10. The sole assembly of any of paragraphs C1-C9, wherein the lower wall of the footbed membrane is coupled to the annular frame wall of the frame, thereby coupling the frame to the footbed membrane.

C10.1. The sole assembly of any of paragraphs C1-C10, wherein an inner wall surface of the lower wall of the footbed membrane is coupled to an/the outer wall side of the annular frame wall.

C10.2. The sole assembly of any of paragraphs C1-C10.1, wherein a lower surface of the lower wall of the footbed membrane is engaged with a/the lip formed on an/the outer wall side of the annular frame wall, wherein the outer wall side of the annular frame wall is opposite the inner wall side of the annular frame wall.

C10.3. The sole assembly of any of paragraphs C1-C10.2, wherein an/the upper wall surface of the annular frame wall is engaged with the lower membrane surface of the footbed membrane.

C10.4. The sole assembly of any of paragraphs C1-C10.3, wherein the annular frame wall is coupled to the footbed membrane around substantially an/the entire membrane perimeter of the footbed membrane.

C10.5. The sole assembly of any of paragraphs C1-C10.4, wherein the lower wall of the footbed membrane obscures an upper portion of the annular frame wall.

C10.6. The sole assembly of any of paragraphs C1-C10.5, wherein an/the upper portion of the annular frame wall is engaged with an/the inner wall surface of the lower wall of the footbed membrane.

C11. The sole assembly of any of paragraphs C1-C10.6, wherein a second inner surface of the lower wall is adhered, cemented, or otherwise coupled to an/the outer wall side of the annular frame wall.

C12. The sole assembly of any of paragraphs C1-C11, wherein the footbed membrane and the frame are arranged with respect to one another such that the lower membrane surface of the footbed membrane faces the upper frame side of the rocker bottom, such that the frame cavity is positioned between the lower membrane surface and the upper frame side.

C13. The sole assembly of any of paragraphs C1-C12, wherein the sole assembly is configured to prevent contact between the lower membrane surface of the footbed membrane and the upper frame side of the rocker bottom when the footbed membrane is weighted by a wearer of the article of footwear.

C14. The sole assembly of any of paragraphs C1-C13, wherein the lower membrane surface of the footbed membrane is spaced apart from the upper frame side by at least 1 mm, at least 2 mm, at least 3 mm, at least 4 mm, at least 5 mm, at least 10 mm, at least 15 mm, and/or at least 20 mm when the sole assembly is not weighted.

C15. The sole assembly of any of paragraphs C1-C14, wherein the lower membrane surface of the footbed membrane is spaced apart from the upper frame side by at least 1 mm, at least 2 mm, at least 3 mm, at least 4 mm, at least 5 mm, at least 10 mm, at least 15 mm, and/or at least 20 mm when the sole assembly is weighted by the wearer.

C16. The sole assembly of any of paragraphs C1-C15, wherein the sole assembly is configured to prevent contact between the lower membrane surface of the footbed membrane and the frame when the footbed membrane is weighted by a wearer of the article of footwear.

C17. The sole assembly of any of paragraphs C1-C16, wherein the footbed membrane is configured to suspend at least 1.1 times the wearer's body weight, at least 2 times the wearer's body weight, at least 3 times the wearer's body weight, at least 4 times the wearer's body weight, at least 5 times the wearer's body weight, at least 6 times the wearer's body weight, at least 7 times the wearer's body weight, at least 8 times the wearer's body weight, at least 9 times the wearer's body weight, and/or at least 10 times the wearer's body weight, such that the lower membrane surface is prevented from contacting the upper frame side when so weighted.

C18. The sole assembly of any of paragraphs C1-C17, wherein the footbed membrane is configured resist elongation after a predetermined threshold.

C19. The sole assembly of any of paragraphs C1-C18, wherein the sole assembly is configured to reduce ground reaction forces to a/the wearer of the article of footwear.

C20. The sole assembly of any of paragraphs C1-C19, wherein the sole assembly is configured to lower the center of gravity, provide stability, enhance propulsion, reduce fatigue, and/or support soft tissues of a/the wearer of the article of footwear.

C21. The sole assembly of any of paragraphs C1-C20, wherein the frame cavity is devoid of foams, gels, and/or other materials.

C22. The sole assembly of any of paragraphs C1-C21, wherein the footbed membrane and the frame are configured to work together and support the wearer's foot throughout a/the gait cycle.

C22.1. The sole assembly of any of paragraphs C1-C22, wherein the footbed membrane is configured to transfer forces to the frame at the membrane perimeter of the lower membrane surface of the footbed membrane.

C22.2. The sole assembly of any of paragraphs C1-C22.1, wherein the frame is configured to support the membrane perimeter of the lower membrane surface of the footbed membrane when the footbed membrane is engaged with the frame.

C23. The sole assembly of any of paragraphs C1-C22.2, wherein the sole assembly is configured to be stable for static use (e.g., standing), as well as dynamic use.

C24. The sole assembly of any of paragraphs C1-C23, wherein the sole assembly is configured such that different aspects of the sole assembly activate at different points of a/the gait cycle.

C25. The sole assembly of any of paragraphs C1-C24, further comprising an inflatable element positioned between the upper frame side of the frame and the lower membrane surface of the footbed membrane.

C26. The sole assembly of paragraph C25, wherein the inflatable element comprises a pouch, a bag, and/or a balloon filled with gas or fluid.

C27. The sole assembly of any of paragraphs C25-C26, wherein the inflatable element is formed integrally with the frame.

C28. The sole assembly of any of paragraphs C25-C27, wherein the inflatable element is formed integrally with the footbed membrane.

C29. The sole assembly of any of paragraphs C25-C28, wherein a volume of the inflatable element is substantially fixed.

C30. The sole assembly of any of paragraphs C25-C28, wherein a volume of the inflatable element is selectively adjustable.

C31. The sole assembly of any of paragraphs C25-C30, wherein the inflatable element is compressible.

C32. The sole assembly of any of paragraphs C25-C30, wherein the inflatable element is substantially incompressible.

C33. The sole assembly of any of paragraphs C25-C32, wherein the inflatable element is configured to limit elongation of the footbed membrane.

D1. An outsole for an article of footwear, the outsole comprising:

an outer outsole side configured to engage with a ground surface on which a wearer of the article of footwear is striding and/or standing; and an inner outsole side configured to engage with the rocker bottom of the frame of any of paragraphs A1-A34.

D2. The outsole of paragraph D1, wherein the outsole is cemented or adhered to the lower frame side of the rocker bottom.

D3. The outsole of any of paragraphs D1-D2, wherein the outsole is configured to conform to contours of the rocker bottom.

D4. The outsole of any of paragraphs D1-D3, wherein the outsole comprises one or more prominences extending from the outer outsole side of the outsole, wherein the one or more prominences are configured to provide stability for standing and static use of the article of footwear.

D5. The outsole of paragraph D4, wherein the durometer of the one or more prominences is between 20 and 80 Shore A, and/or between 50 and 95 on the 00 foam scale.

D6. The outsole of paragraph D4 or D5, wherein the one or more prominences are non-rigid.

D7. The outsole of any of paragraphs D4-D6, wherein at least one of the one or more prominences extends substantially from a medial edge region of the outsole to a lateral edge region of the outsole.

D8. The outsole of any of paragraphs D4-D7, wherein at least one of the one or more prominences is positioned within a forefoot region of the article of footwear.

D9. The outsole of any of paragraphs D4-D8, wherein at least one of the one or more prominences is positioned within a midfoot region of the article of footwear.

D10. The outsole of any of paragraphs D4-D9, wherein at least one of the one or more prominences is positioned within a heel region of the article of footwear.

D11. The outsole of any of paragraphs D4-D10, wherein at least one of the one or more prominences is oriented substantially perpendicularly to a longitudinal axis of the outsole.

D12. The outsole of any of paragraphs D4-D11, wherein at least one of the one or more prominences is oriented at a non-parallel and non-perpendicular angle with respect to a/the longitudinal axis of the outsole.

D13. The outsole of any of paragraphs D4-D12, wherein at least one of the one or more prominences is positioned within a lateral portion of a/the heel region of the outsole.

D14. The outsole of any of paragraphs D4-D13, wherein at least one of the one or more prominences is formed integrally with the outsole.

D15. The outsole of any of paragraphs D4-D14, wherein at least one of the one or more prominences has a width of between 10 mm and 2 cm.

D16. The outsole of any of paragraphs D4-D15, wherein the one or more prominences comprises a first prominence and a second prominence spaced apart from one another.

D17. The outsole of paragraph D16, wherein the first prominence is positioned between a longitudinal midpoint of the outsole and an anterior end of the outsole.

D18. The outsole of paragraph D16 or D17, wherein the second prominence is positioned between a/the longitudinal midpoint of the outsole and a posterior end of the outsole.

D19. The outsole of any of paragraphs D16-D18, wherein the first prominence and the second prominence are positioned with respect to one another such that they both contact the ground surface under the outsole when in a static use condition.

D20. The outsole of any of paragraphs D4-D19, wherein at least one of the one or more prominences has a substantially hemispheric cross-sectional area.

D21. The outsole of any of paragraphs D1-D20, further comprising a lateral heel plug positioned within a/the lateral portion of a/the heel region of the outsole, wherein the lateral heel plug is configured to prevent premature wear in the lateral portion of the heel region.

D21.1. The outsole of paragraph D21, wherein the lateral heel plug comprises a first plug layer and a second plug layer.

D21.2. The outsole of paragraph D21.1, wherein the first plug layer is configured to contact the ground surface on which the wearer is striding, and wherein the second plug layer is positioned cranial to the first plug layer.

D21.3. The outsole of any of paragraphs D21.1-D21.2, wherein the second layer is softer than (e.g., has a lower durometer than) the first layer.

D21.4. The outsole of any of paragraphs D21.1-D21.3, wherein the first layer has a Shore A durometer of between 35 and 95.

D21.5. The outsole of any of paragraphs D21.1-D21.4, wherein the second layer has a Shore A durometer of between 20 and 70.

D21.6. The outsole of any of paragraphs D21.1-D21.5, wherein the first plug layer and/or the second plug layer is substantially non-compressible.

D21.7. The outsole of any of paragraphs D21.1-D21.6, wherein the first plug layer and/or the second plug layer comprises a polyurethane.

D22.8. The outsole of any of paragraphs D21.1-D21.2, wherein the first layer is selectively removable from the second layer, optionally via the use of a hook-and-loop fastener and/or a removable adhesive.

D21.9. The outsole of any of paragraphs D21-D21.8, wherein the lateral heel plug is substantially triangular in shape.

D22. The outsole of any of paragraphs D1-D21.9, wherein a/the heel region of the outsole is asymmetrical.

D23. The outsole of any of paragraphs D1-D22, wherein a/the lateral portion of a/the heel region of the outsole rolls up from the ground surface more than does a medial portion of the heel region.

D24. The outsole of any of paragraphs D1-D23, wherein a/the lateral portion of a/the heel region of the outsole forms an angle of between 5 and 35 degrees with the ground surface when the outsole is in use.

D25. The outsole of any of paragraphs D1-D24, wherein a/the lateral portion of a/the heel region of the outsole is configured to contact the ground surface at a later time in a gait cycle of a/the wearer than is a/the medial portion of the heel region.

E1. An article of footwear, comprising:

an upper configured to engage with a wearer's foot when the article of footwear is worn by the wearer; and the frame of any of paragraphs A1-A34, the footbed membrane of any of paragraphs B1-B46, the sole assembly of any of paragraphs C1-C33, and/or the outsole of any of paragraphs D1-D25.

E2. The article of footwear of paragraph E1, wherein, when including the sole assembly of any of paragraphs C1-C33, the sole assembly is coupled to the upper such that the upper is configured to limit elongation of the footbed membrane.

E3. The article of footwear of any of paragraphs E1-E2, wherein at least a portion of the upper extends under a/the footbed membrane, adjacent a/the lower membrane surface, to limit elongation/bottoming out of the footbed membrane.

E4. The article of footwear of any of paragraphs E1-E3, further comprising an annular ring positioned around an outer upper surface of the article of footwear and configured to enhance attachment of the upper to a/the frame, a/the footbed membrane, and/or to a/the sole assembly.

E5. The article of footwear of paragraph E4, wherein the annular ring is cemented or adhered to the article of footwear.

E6. The article of footwear of any of paragraphs E1-E5, wherein the upper is sewn to a/the sew wall of a/the footbed membrane.

E7. The article of footwear of any of paragraphs E1-E6, wherein the upper is not cemented or adhered to a/the footbed membrane.

E8. The article of footwear of any of paragraphs E1-E7, wherein the article of footwear comprises work boots, high heels, athletic shoes, ballet shoes, and/or military boots.

E9. The article of footwear of any of paragraphs E1-E8, further comprising a soft heel plug coupled to an/the outsole of the article of footwear, wherein the soft heel plug is configured to decrease wear of a/the heel region of the footbed membrane.

F1. A bicycle seat comprising:

a suspension membrane comprising:

a contoured upper membrane surface configured to support a rider's pelvis;

a lower membrane surface opposite the upper membrane surface, wherein the lower membrane surface is contoured to correspond to the upper membrane surface;

a sew wall projecting away from the upper membrane surface and extending around a membrane perimeter of the upper membrane surface; and a lower wall projecting away from the lower membrane surface and extending around the membrane perimeter, wherein the membrane perimeter also is a perimeter of the lower membrane surface; and a frame having an annular frame wall that extends around a frame perimeter of an upper frame side of the frame and projects away from the upper frame side, wherein the annular frame wall is arranged with respect to the upper frame side such that a frame cavity is defined by the upper frame side and an inner wall side of the annular frame wall, wherein the suspension membrane is coupled to the frame by securing the lower wall to the annular frame wall, wherein the lower membrane surface faces the frame cavity, and wherein the suspension membrane is configured to prevent contact between the lower membrane surface and the upper frame side when the bicycle seat is weighted by a rider.

F2. A ballet pointe shoe, comprising:

a suspension membrane comprising:

an upper membrane surface configured to support a dancer's toe;

a lower membrane surface opposite the upper membrane surface; and a lower wall projecting away from the lower membrane surface and extending around a membrane perimeter of the lower membrane surface; and a frame having an annular frame wall that extends around a frame perimeter of an upper frame side of the frame and projects away from the upper frame side, wherein the annular frame wall is arranged with respect to the upper frame side such that a frame cavity is defined by the upper frame side and an inner wall side of the annular frame wall, wherein the suspension membrane is coupled to the frame by securing the lower wall to the annular frame wall, wherein the lower membrane surface faces the frame cavity, and wherein the suspension membrane is configured to suspend the dancer's toe and prevent contact between the frame and the dancer's foot.

F3. A high heel shoe, comprising:

a suspension membrane comprising:

a contoured upper membrane surface configured to support at least a portion of a wearer's foot;

a lower membrane surface opposite the upper membrane surface, wherein the lower membrane surface is contoured to correspond to the upper membrane surface;

a sew wall projecting away from the upper membrane surface and extending around a membrane perimeter of the upper membrane surface; and a lower wall projecting away from the lower membrane surface and extending around the membrane perimeter, wherein the membrane perimeter also is a perimeter of the lower membrane surface; and a frame having an annular frame wall that extends around a frame perimeter of an upper frame side of the frame and projects away from the upper frame side, wherein the annular frame wall is arranged with respect to the upper frame side such that a frame cavity is defined by the upper frame side and an inner wall side of the annular frame wall, wherein the suspension membrane is coupled to the frame by securing the lower wall to the annular frame wall, wherein the lower membrane surface faces the frame cavity, and wherein the suspension membrane is configured to prevent contact between the lower membrane surface and the upper frame side when the suspension membrane is weighted by a wearer.

F4. The high heel shoe of paragraph F3, wherein the suspension membrane is positioned within a forefoot region of the high heel shoe.

F5. The high heel shoe of paragraph F3 or F4, wherein the suspension membrane is positioned within a heel region of the high heel shoe.

F6. The high heel shoe of any of paragraphs F3-F5, wherein the suspension membrane is not positioned within a midfoot region of the high heel shoe.

G1. A method of limiting elongation of an elastomeric material for use in a suspension membrane, the method comprising:

engineering an elastomeric material having one or more desired characteristics, wherein the elastomeric material is selected and/or engineered to limit a percentage of elongation of the elastomeric material, such that the elastomeric material is configured to suspend a wearer's foot when the elastomeric material supports the wearer's foot.

G2. The method of paragraph G1, wherein the method comprises chemically altering the elastomeric material.

G3. The method of paragraph G1 or G2, comprising engineering the elastomeric material to limit elongation to less than 3%, less than 4%, less than 5%, less than 6%, less than 7%, less than 8%, less than 9%, less than 10%, less than 11%, less than 12%, less than 13%, less than 14%, less than 15%, and/or less than 20%.

G4. The method of any of paragraphs G1-G3, comprising engineering the elastomeric material to stretch less than a threshold amount per area per force at a given temperature.

G5. The method of any of paragraphs G1-G4, comprising selecting a durometer of the elastomeric material.

G6. The method of any of paragraphs G1-G5, comprising selecting a thickness of the elastomeric material.

G7. The method of any of paragraphs G1-G6, comprising selecting a resilience and/or rebound rate of the elastomeric material.

G8. The method of any of paragraphs G1-G7, comprising undercuring the elastomeric material to increase cross-reactions.

G9. The method of any of paragraphs G1-G8, comprising altering the chemistry of the elastomeric material to create different properties for different applications for the elastomeric material, such as for different shoe sizes, different weights of users, and/or different activities.

G10. The method of any of paragraphs G1-G9, comprising controlling a load-deformation profile of the footbed membrane by varying material properties in various regions of the suspension membrane.

G11. The method of any of paragraphs G1-G10, comprising controlling elongation of the suspension membrane and energy return rates of the suspension membrane by varying a chemistry of the suspension membrane through pre-polymers, curatives, stoichiometry, additives, and/or processing.

H1. A method of limiting elongation of an elastomeric material for use in a suspension membrane, the method comprising mechanically limiting elongation of the elastomeric material.

H2. The method of paragraph H1, comprising creating a mold to form the suspension membrane, wherein the mold is optimized based on a wearer's gait cycle.

H3. The method of paragraph H1 or H2, comprising positioning, forming, and/or inserting one or more internal members within or on the suspension membrane to limit elongation of the elastomeric material.

H3.1. The method of paragraph H3, wherein the internal members comprise a cable, a thread, a wire, and/or a string.

H3.2. The method of any of paragraphs H3-H3.1, wherein the internal members are at least partially embedded within the elastomeric material.

H3.3. The method of any of paragraphs H3-H3.2, wherein the internal members form a coil, a helix, a zig-zag, and/or a different wavy pattern within or on the elastomeric material.

H3.4. The method of any of paragraphs H3-H3.3, wherein the internal members are configured to resiliently deform.

H4. The method of any of paragraphs H1-H3.4, comprising varying a thickness of the suspension membrane to limit elongation of the elastomeric material.

H5. The method of any of paragraphs H1-H4, comprising tapering one or more portions of the suspension membrane to limit elongation of the elastomeric material.

H6. The method of any of paragraphs H1-H5, comprising securing an upper of an article of footwear to the suspension membrane such that the upper limits elongation of the elastomeric material.

H7. The method of paragraph H6, wherein a portion of the upper is positioned underneath the suspension membrane.

H8. The method of any of paragraphs H1-H7, comprising pre-tensioning the suspension membrane when assembling it together with other components.

H9. The method of any of paragraphs H1-H8, comprising applying a laminate covering onto the suspension membrane, wherein the laminate covering is configured to limit elongation of the suspension membrane.

H10. The method of any of paragraphs H1-H9, comprising sandwiching the suspension membrane between one, two, or more other layers, wherein at least one of the other layers has a higher durometer than the suspension membrane and/or wherein at least one of the other layers exhibits less elongation than the suspension membrane.

H11. The method of any of paragraphs H1-H10, comprising controlling a load-deformation profile of the suspension membrane by varying the cross-sectional shape in various regions of the suspension membrane.

I1. The use of the method of any of paragraphs G1-G11 to make the suspension membrane, wherein the suspension membrane is the footbed membrane of any of paragraphs B1-B46.

I2. The use of the method of any of paragraphs H1-H11 to make the suspension membrane, wherein the suspension membrane is the footbed membrane of any of paragraphs B1-B46.

I3. The use of the footbed membrane of any of paragraphs B1-B46 in an article of footwear to suspend a wearer's foot above a/the frame cavity.

I4. The use of the sole assembly of any of paragraphs C1-C33 in an article of footwear to suspend a wearer's foot above a/the frame cavity.

I5. The use of the frame of any of paragraphs A1-A34 in an article of footwear to suspend a wearer's foot above the frame cavity.

J1. A method of making an article of footwear, the method comprising:

securing an upper to the frame of any of paragraphs A1-A34, the footbed membrane of any of paragraphs B1-B46, the sole assembly of any of paragraphs C1-C33, and/or the outsole of any of paragraphs D1-D25, wherein the upper is configured to engage with a wearer's foot when the footwear is worn by the wearer.

J2. The method of paragraph J1, wherein the securing the upper comprises sewing the upper to the footbed membrane of any of paragraphs B1-B46 via the sew wall of the footbed membrane.

J3. The method of paragraph J2, wherein the sewing the upper to the footbed membrane comprises sewing through both the upper and the sew wall to secure the upper to the footbed membrane.

J4. The method of paragraph J2 or J3, wherein the upper is not cemented or otherwise adhered to the footbed membrane.

J5. The method of any of paragraphs J1-J4, further comprising limiting elongation of the footbed membrane by performing the method of any of paragraphs G1-G11.

J6. The method of any of paragraphs J1-J5, further comprising limiting elongation of the footbed membrane by performing the method of any of paragraphs H1-H11.

J7. The method of any of paragraphs J1-J6, comprising securing the footbed membrane of any of paragraphs B1-B46 to the frame of any of paragraphs A1-A34, wherein the sole assembly is configured to prevent contact between the lower membrane surface of the footbed membrane and the upper frame side of the frame, when the footbed membrane is weighted by a wearer's foot.

J8. The method of any of paragraphs J1-J7, further comprising forming the footbed membrane of any of paragraphs B1-B46, wherein the forming the footbed membrane comprises injecting or pouring an elastomeric material into a mold and curing the elastomeric material.

J9. The method of paragraph J8, wherein the injecting or pouring the elastomeric material comprises injecting or pouring a first elastomeric material having a first durometer into a first portion of the mold, and injecting or pouring a second elastomeric material having a second durometer into a second portion of the mold, wherein the first durometer is different from the second durometer.

J10. The method of any of paragraphs J1-J9, further comprising cementing, adhering, or otherwise coupling the footbed membrane of any of paragraphs B1-B46 to the frame of any of paragraphs A1-A34 by cementing, adhering, or otherwise coupling the lower wall of the footbed membrane to the annular frame wall of the frame.

J11. The method of any of paragraphs J1-J10, further comprising designing the footbed membrane and selecting material characteristics of the footbed membrane to configure the footbed membrane to prevent contact between the lower membrane surface and the upper frame side of the frame of any of paragraphs A1-A34 when the footbed membrane is weighted by a wearer's foot and the footbed membrane is secured to the frame.

J12. The method of paragraph J11, wherein the designing the footbed membrane comprises determining a desired thickness for one or more portions of the footbed membrane of any of paragraphs B1-B46.

J13. The method of paragraph J11 or J12, wherein the designing the footbed membrane comprises designing the footbed membrane to have a maximum percentage of elongation in a given weighted configuration.

J14. The method of paragraph J13, wherein the maximum percentage of elongation is less than 15%, less than 10%, and/or less than 5%.

J15. The method of any of paragraphs J11-J14, wherein the designing the footbed membrane comprises mapping out a plurality of different portions of the footbed membrane having different durometers.

J16. The method of any of paragraphs J11-J15, wherein the designing the footbed membrane comprises mapping out a plurality of different portions of the footbed membrane having different thicknesses.

J17. The method of any of paragraphs J1-J16, comprising wrapping the upper around a last board, sewing the upper along a longitudinal seam on an underside of the upper, and removing the last board.

J18. The method of any of paragraphs J1-J17, further comprising coupling a first layer having a first maximum percentage elongation to a second layer having a second maximum percentage elongation, thereby forming the upper membrane surface and the lower membrane surface of the footbed membrane of any of paragraphs B1-B46, wherein the first maximum percentage elongation is different from the second maximum percentage elongation.

J19. The method of any of paragraphs J1-J18, further comprising coupling a layer of elastomeric polyurethane to a fabric layer, thereby forming the upper membrane surface and the lower membrane surface of the footbed membrane of any of paragraphs B1-B46, wherein the fabric layer is configured to have a lower percentage of elongation than the layer of elastomeric polyurethane.

J20. The method of any of paragraphs J1-J19, comprising laminating a polyurethane elastomer to a layer of silicone, thereby forming the upper membrane surface and the lower membrane surface of the footbed membrane of any of paragraphs B1-1346.

J21. The method of any of paragraphs J1-J20, comprising saturating a layer of fabric with a polyurethane elastomer, thereby forming the upper membrane surface and the lower membrane surface of the footbed membrane of any of paragraphs B1-B46.

The various disclosed elements of footwear, footbed membranes, and frames disclosed herein are not required to be included in all footwear, footbed membranes, and frames according to the present disclosure, and the present disclosure includes all novel and non-obvious combinations and subcombinations of the various elements disclosed herein. Moreover, one or more of the various elements disclosed herein may define independent inventive subject matter that is separate and apart from the whole of a disclosed article of footwear, footbed membrane, and/or frame. Accordingly, such inventive subject matter is not required to be associated with the specific footwear, footbed membranes, and frames that are expressly disclosed herein, and such inventive subject matter may find utility in footwear, footbed membranes, and frames that are not expressly disclosed herein.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, the terms "selective" and "selectively," when modifying an action, movement, configuration, or other activity of one or more components or characteristics of an apparatus, mean that the specific action, movement, configuration, or other activity is a direct or indirect result of user manipulation of an aspect of, or one or more components of, the apparatus.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, when the disclosure or subsequently filed claims recite "a" or "a first" element or the equivalent thereof, such disclosure and/or claims should be understood to include incorporation of one or more such elements, neither requiring nor excluding two or more such elements.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

Applicant reserves the right to submit claims directed to certain combinations and subcombinations that are directed to one of the disclosed inventions and are believed to be novel and non-obvious. Inventions embodied in other combinations and subcombinations of features, functions, elements and/or properties may be claimed through amendment of those claims or presentation of new claims in that or a related application. Such amended or new claims, whether they are directed to a different invention or directed to the same invention, whether different, broader, narrower or equal in scope to the original claims, are also regarded as included within the subject matter of the inventions of the present disclosure.

The invention claimed is:

1. An article of footwear comprising a rigid frame, the rigid frame comprising: a rocker bottom comprising:

a lower frame side; and an upper frame side opposite the lower frame side; and an annular frame wall that extends around a perimeter of the upper frame side and projects away from the upper frame side, wherein the annular frame wall comprises:

an inner wall side;

an outer wall side opposite the inner wall side; and a lip projecting outwardly from on the outer wall side, wherein the annular frame wall is arranged with respect to the rocker bottom such that a frame cavity is defined by the upper frame side and the inner wall side of the annular frame wall, wherein the annular frame wall is integrally formed with the rocker bottom such that the rigid frame is formed as a monolithic body, and wherein the lip is configured to engage a footbed membrane configured to suspend a wearer's foot above the upper frame side when the wearer wears the article of footwear, wherein the outer wall side of the annular frame wall is configured to be engaged with the footbed membrane.

2. The article of footwear according to claim 1, wherein the rigid frame is configured to prevent flexion of the rigid frame during a gait cycle of the wearer, and further wherein the rigid frame is configured to propel the wearer forward during the gait cycle.

3. The article of footwear according to claim 1, wherein the annular frame wall has a wall height defined as the vertical distance between a respective point on an upper wall surface of the annular frame wall and a corresponding respective point on the lip of the annular frame wall, wherein the wall height is variable along the annular frame wall.

4. The article of footwear according to claim 1, wherein the rocker bottom comprises a plurality of apertures extending from the upper frame side to the lower frame side, wherein the plurality of apertures are formed through the rocker bottom without intersecting the annular frame wall, and wherein the annular frame wall comprises one or more wall holes formed through the annular frame wall such that the one or more wall holes extend from the inner wall side to the outer wall side of the annular frame wall.

5. The article of footwear according to claim 4, wherein a first subset of the plurality of apertures is positioned within a forefoot region of the rigid frame, and wherein a second subset of the plurality of apertures is positioned within a heel region of the rigid frame.

6. The article of footwear according to claim 4, wherein at least one of the one or more wall holes is positioned within a midfoot region of the rigid frame, wherein at least one of the one or more wall holes is formed within a lateral portion of the annular frame wall, and wherein at least one of the one or more wall holes is formed within a medial portion of the annular frame wall.

7. The article of footwear according to claim 1, wherein the rigid frame comprises one or more support braces positioned adjacent the upper frame side and the inner wall side of the annular frame wall, thereby supporting the annular frame wall with respect to the rocker bottom, wherein the one or more support braces are spaced apart around at least a portion of the perimeter of the upper frame side, wherein at least a first support brace of the one or more support braces extends across at least a majority of a width of the rocker bottom, and wherein at least a second support brace of the one or more support braces extends across less than the majority of the width of the rocker bottom.

8. An article of footwear comprising a sole assembly, the sole assembly comprising:

a rigid frame, comprising:

a rocker bottom comprising:

a lower frame side; and an upper frame side opposite the lower frame side; and an annular frame wall that extends around a frame perimeter of the upper frame side and projects away from the upper frame side, wherein the annular frame wall is arranged with respect to the rocker bottom such that a frame cavity is defined by the upper frame side and an inner wall side of the annular frame wall, wherein the annular frame wall is integrally formed with the rocker bottom such that the rigid frame is formed of a monolithic body, and wherein the frame cavity is devoid of foams, gels, or other cushioning materials; and a footbed membrane coupled to the rigid frame to form the sole assembly, wherein the footbed membrane comprises:

an upper membrane surface configured to support and suspend a wearer's foot above the upper frame side when the wearer wears the article of footwear;

a lower membrane surface opposite the upper membrane surface, wherein the sole assembly is configured to prevent contact between the lower membrane surface and the upper frame side when the upper membrane surface is suspending the wearer's foot above the upper frame side; and a lower wall projecting away from the lower membrane surface and extending around a membrane perimeter of the footbed membrane, wherein the lower wall is coupled to the annular frame wall, and wherein the upper membrane surface, the lower membrane surface, and the lower wall of the footbed membrane comprise a non-mesh, molded elastomeric material.

9. The article of footwear according to claim 8, wherein the upper membrane surface is integrally formed with the lower wall.

10. The article of footwear according to claim 9, wherein the upper membrane surface is contoured to correspond to the wearer's foot, and wherein the lower membrane surface is contoured to correspond to the upper membrane surface.

11. The article of footwear according to claim 8, wherein a thickness of the footbed membrane is variable across different regions of the footbed membrane, and wherein the thickness of the footbed membrane in a medial region of the footbed membrane underlying an arch of the wearer's foot is greater than the thickness of the footbed membrane in a lateral region of the footbed membrane.

12. The article of footwear according to claim 8, wherein the footbed membrane is configured to resiliently deform in response to a load applied to the upper membrane surface of the footbed membrane by the wearer's foot, wherein the footbed membrane is configured to store energy as a result of the resilient deformation, and wherein the footbed membrane is further configured to return the stored energy back to the wearer's foot when the wearer lifts the wearer's foot, thereby removing the load from the footbed membrane.

13. The article of footwear according to claim 8, wherein the footbed membrane comprises a plurality of membrane apertures formed in the footbed membrane, wherein the membrane apertures extend from the upper membrane surface to the lower membrane surface, wherein each respective membrane aperture of the plurality of membrane apertures is spaced apart from the other membrane apertures of the plurality of membrane apertures, wherein a first subset of the plurality of membrane apertures are formed in a forefoot region of the footbed membrane, wherein a second subset of the plurality of membrane apertures are formed in a midfoot region of the footbed membrane, wherein a third subset of the plurality of membrane apertures are formed in a heel region of the footbed membrane, wherein an arch region of the footbed membrane is devoid of membrane apertures, and wherein the arch region underlies an arch of the wearer's foot when the article of footwear is worn.

14. The article of footwear according to claim 8, wherein the footbed membrane comprises a plurality of ribs extending at least partially across a width of the footbed membrane, wherein the plurality of ribs project away from the lower membrane surface, wherein the plurality of ribs are integrally formed with the lower membrane surface, and wherein the sole assembly is configured to prevent contact between the plurality of ribs and the upper frame side when the upper membrane surface is suspending the wearer's foot above the upper frame side.

15. The article of footwear according to claim 8, wherein the footbed membrane comprises:

a first layer forming the upper membrane surface; and a second layer forming the lower membrane surface, wherein the first layer and the second layer are configured to have different material properties in at least one selected from the group consisting of thickness, elongation, durometer, resilience, UV light resistance, abrasion resistance, and tensile strength.

16. The article of footwear according to claim 8, further comprising one or more internal members at least partially embedded within the footbed membrane, wherein the one or more internal members are configured to limit elongation of the footbed membrane in a longitudinal direction corresponding to a length of the wearer's foot.

17. The article of footwear according to claim 8, wherein the footbed membrane comprises a sew wall projecting away from the upper membrane surface and extending around the membrane perimeter, wherein the sew wall and the lower wall are substantially parallel to one another, wherein the sew wall is configured to be attached to an upper of the article of footwear and allow for flexion of the upper at an interface where the upper is attached to the sew wall.

18. The article of footwear according to claim 8, wherein the annular frame wall of the rigid frame comprises:

a first inner wall side;

an outer wall side opposite the first inner wall side; and a lip formed in the outer wall side, wherein the lip is configured to prevent the lower wall of the footbed membrane from extending past the lip towards the upper frame side when the footbed membrane is coupled to the rigid frame.

19. The article of footwear according to claim 18, wherein a second inner wall of the lower wall of the footbed membrane is coupled to the outer wall side of the annular frame wall, wherein a lower surface of the lower wall of the footbed membrane is engaged with the lip of the annular frame wall, and wherein an upper wall surface of the annular frame wall is engaged with the lower membrane surface of the footbed membrane.

20. The article of footwear according to claim 8, further comprising:

an upper configured to engage with the wearer's foot when the article of footwear is worn by the wearer; and an outsole comprising:

an outer outsole side configured to engage with a ground surface under the article of footwear;

an inner outsole side coupled to the rocker bottom of the rigid frame, wherein the outsole is configured to conform to contours of the rocker bottom; and a lateral heel plug positioned within a lateral portion of a heel region of the outsole, wherein the lateral heel plug is configured to prevent premature wear in the lateral portion of the heel region, wherein the upper is coupled to the sole assembly such that the sole assembly is positioned between the upper and the outsole.

21. The article of footwear according to claim 8, further comprising:

an upper configured to engage with the wearer's foot when the article of footwear is worn by the wearer; and an outsole comprising:

an outer outsole side configured to engage with a ground surface under the article of footwear;

a plurality of prominences extending from the outer outsole side and configured to provide stability for standing and static use of the article of footwear, wherein the plurality of prominences are positioned with respect to one another such that they all contact the ground surface when in a static use condition; and an inner outsole side coupled to the rocker bottom of the rigid frame, wherein the outsole is configured to conform to contours of the rocker bottom.

22. The article of footwear according to claim 21, wherein the plurality of prominences comprises a first prominence and a second prominence spaced apart from one another, wherein the first prominence is positioned between a longitudinal midpoint of the outsole and an anterior end of the outsole, wherein the second prominence is positioned between the longitudinal midpoint of the outsole and a posterior end of the outsole.

* * * * *